US006568794B2

(12) United States Patent
Yamanaka et al.

(10) Patent No.: US 6,568,794 B2
(45) Date of Patent: May 27, 2003

(54) INK-JET HEAD, METHOD OF PRODUCING THE SAME, AND INK-JET PRINTING SYSTEM INCLUDING THE SAME

(75) Inventors: Kunihiro Yamanaka, Kanagawa (JP); Kaihei Isshiki, Tokyo (JP); Shuya Abe, Hyogo (JP); Kouji Ohnishi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/940,096

(22) Filed: Aug. 27, 2001

(65) Prior Publication Data

US 2002/0027576 A1 Mar. 7, 2002

(30) Foreign Application Priority Data

Aug. 30, 2000 (JP) ..... 2000-260643
Sep. 29, 2000 (JP) ..... 2000-297817
Nov. 6, 2000 (JP) ..... 2000-336819

(51) Int. Cl.[7] ..... B41J 2/015; B41J 2/135; B41J 2/04; B41J 2/06

(52) U.S. Cl. ..... 347/54; 347/55; 347/20; 347/44

(58) Field of Search ..... 347/54, 55, 20, 347/68–72, 44, 47, 27, 111, 112; 29/890.1

(56) References Cited

U.S. PATENT DOCUMENTS 5,563,634 A * 10/1996 Fujii et al. ..... 347/55

FOREIGN PATENT DOCUMENTS

| | | |
|---|---|---|
| JP | 5-50601 | 3/1993 |
| JP | 6008449 | 1/1994 |
| JP | 6-23986 | 2/1994 |
| JP | 6-71882 | 3/1994 |
| JP | 9267479 | 10/1997 |
| JP | 9286101 | 11/1997 |
| JP | 10286954 | 10/1998 |

OTHER PUBLICATIONS

Application S.N. 09/632,047 filed Aug. 3, 2000.
Application S.N. 09/610,807 filed Jul. 6, 2000.
Application S.N. 09/458,355 filed Dec. 9, 1999.
Application S.N. 09/793,478 filed Feb. 26, 2001.
Application S.N. 09/632,046 filed Aug. 3, 2000.

* cited by examiner

*Primary Examiner*—John Barlow
*Assistant Examiner*—An H. Do
(74) *Attorney, Agent, or Firm*—Cooper & Dunham LLP

(57) ABSTRACT

An ink-jet head includes a nozzle which discharges an ink drop to a recording medium. A discharging chamber communicates with the nozzle and contains ink therein. An oscillation plate is provided on a first substrate of silicon, the oscillation plate defining a bottom surface of the discharging chamber, the oscillation plate pressurizing the ink in the discharging chamber when the oscillation plate is actuated. An electrode is provided on a second substrate of silicon, the electrode facing the oscillation plate via a gap between the oscillation plate and the electrode. In the ink-jet head, at least one of a first bonding area of the first substrate and a second bonding area of the second substrate is provided with a silicon oxide film, and the silicon oxide film contains boron on a surface thereof where the first substrate and the second substrate are bonded together.

27 Claims, 62 Drawing Sheets

ETCHING

POLISHING

INK-JET HEAD, METHOD OF PRODUCING THE SAME, AND INK-JET PRINTING SYSTEM INCLUDING THE SAME

BACKGROUND OF THE INVENTION

1. Field of the Invention

The present invention relates to an ink-jet head, a method of production of the ink-jet head, and an ink-jet printing system including the ink-jet head.

2. Description of the Related Art

Ink-jet printing systems are commonly used in various image forming systems, such as printers, facsimiles, copiers and plotters, to perform a printing process in which an image is printed on a recording medium (e.g., paper). Generally, an electrostatic ink-jet head is provided in such an ink-jet printing system. The ink-jet head of this type normally includes a nozzle which discharges an ink drop onto recording paper, a discharging chamber which communicates with the nozzle and contains ink therein, an oscillation plate which is provided to define a bottom of the discharging chamber and pressurizes the ink in the discharging chamber when the oscillation plate is actuated, and an electrode which is provided to face the oscillation plate via a gap between the oscillation plate and the electrode.

Upon application of a driving voltage to the electrode, the electrode actuates the oscillation plate by electrostatic force, so that the ink-jet head ejects an ink drop from the nozzle onto the recording paper by pressurizing the ink in the discharging chamber. The discharging chamber of the ink-jet head may be also called a pressure chamber, a pressurizing chamber, a fluid chamber or an ink passage.

In the above-described ink-jet head, the mechanical deflection characteristics of the oscillation plate significantly affect the ink discharging characteristics of the head. In order to achieve the desired ink discharging characteristics, it is needed to provide a thin-film structure of the oscillation plate having high accuracy, and to provide highly accurate dimension of the gap between the oscillation plate and the electrode.

For example, Japanese Laid-Open Patent Application Nos. 6-23986 and 6-71882 disclose an improved oscillation plate for use in an electrostatic ink-jet head. In the ink-jet head disclosed in the above documents, a boron diffusion layer in which a high concentration of boron is diffused is formed on a silicon substrate on which the oscillation plate is provided. By performing the anisotropic etching on the silicon substrate, the oscillation plate having the boron diffusion layer with the high concentration of boron is formed on the silicon substrate.

In order to provide highly accurate dimension of the gap between the oscillation plate and the electrode, Japanese Laid-Open Patent Application Nos. 6-23986 and 9-267479 disclose that a silicon substrate for forming the oscillation plate thereon and a silicon substrate for forming the electrode thereon are bonded together at a temperature around 1100 deg. C. The direct bonding method is known as the method for creating highly reliable and rigid adhesion, and it is commonly used for the manufacture of a silicon-on-insulator (SOI) wafer. The above-mentioned direct bonding method is performed at a high temperature in a range of 1100 deg. C. to 1200 deg. C., and the silicon dioxide film on the substrate is melted so that a highly reliable and rigid adhesion of the two silicon substrates is created.

However, in the conventional ink-jet head disclosed in the above documents, the direct bonding method must be performed at a high temperature in the range of 1100 deg. C. to 1200 deg. C. The manufacturing equipment for bonding the silicon substrates becomes bulky and complicated while the temperature management is required. Hence, the manufacturing cost of ink-jet head will be increased. Further, when forming the oscillation plate by etching after the direct bonding method is performed, the components on the electrode substrate require a high temperature resistance to withstand the high-temperature bonding. The source materials of the components on the electrode substrate are limited due to the requirement of temperature resistance.

Further, in the conventional ink-jet head disclosed in the above documents, when forming the oscillation plate having the boron diffusion layer with a high concentration of boron, on the silicon substrate, the re-distribution of boron over the oscillation plate is caused by the high-temperature heating during the direct bonding. This will produce variation of the thickness of the oscillation plate, variation of the ink discharging characteristics of the head, or lowering of the concentration of boron in the boron diffusion layer. In such cases, it is very difficult to form the oscillation plate having high accuracy.

Japanese Laid-Open Patent Application Nos. 5-50601 and 6-71882 disclose an electrostatic ink-jet head in which the recessed portions of the oscillation plate and/or the electrode, or the alternative silicon dioxide films, are formed the bonding surfaces of the oscillation plate substrate and/or the electrode substrate. The conventional ink-jet head disclosed in the above documents effectively maintains the gap between the oscillation plate and the electrode at a given distance. However, it is difficult to provide reliable ink discharging characteristics and low manufacturing cost of the head.

Japanese Laid-Open Patent Application No. 9-286101 discloses an ink-jet head production method in which the oscillation plate substrate and the electrode substrate are bonded together by an anodic bonding process. However, it is difficult to provide reliable ink discharging characteristics and low manufacturing cost of the head.

Japanese Laid-Open Patent Application No. 10-286954 discloses an ink-jet head production method in which the oscillation plate substrate and the electrode substrate are bonded together by forming a polysilazan layer on the bonding surfaces of the two silicon substrates. However, steam or other gases may be produced out of the polysilazan layer, and it is difficult to provide reliable ink discharging characteristics and low manufacturing cost of the head.

Japanese Laid-Open Patent Application No. 6-8449 discloses an ink-jet head production method using the direct bonding in which the oscillation plate substrate and the electrode substrate are directly bonded together. However, it is difficult to provide reliable ink discharging characteristics and low manufacturing cost of the head.

SUMMARY OF THE INVENTION

An object of the present invention is to provide an improved ink-jet head in which the above-described problems are eliminated.

Another object of the present invention is to provide an ink-jet head that enables the direct bonding method to be performed at a comparatively low temperature and with reliability and provides an accurate and dense configuration of the components of the ink-jet head.

Another object of the present invention is to provide an ink-jet head that provides reliable ink discharging characteristics and low manufacturing cost.

Another object of the present invention is to provide a method of production of an ink-jet head, which provides reliable ink discharging characteristics and low manufacturing cost of the ink-jet head.

Another object of the present invention is to provide an ink-jet printing system including an ink-jet head that provides reliable ink discharging characteristics and low manufacturing cost.

The above-mentioned objects of the present invention are achieved by an ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; and an electrode which is provided on a second substrate of silicon, the electrode facing the oscillation plate via a gap between the oscillation plate and the electrode, the electrode actuating the oscillation plate by electrostatic force upon application of a driving voltage to the electrode, wherein at least one of a first bonding area of the first substrate and a second bonding area of the second substrate is provided with a silicon oxide film, and the silicon oxide film contains boron on a surface thereof where the first substrate and the second substrate are bonded together.

The above-mentioned objects of the present invention are achieved by an ink-jet head comprising: a nozzle which discharges discharging an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; and an electrode which is provided on a second substrate of silicon, the electrode facing the oscillation plate via a gap between the oscillation plate and the electrode, the electrode actuating the oscillation plate by electrostatic force upon application of a driving voltage to the electrode, wherein the first substrate is bonded to the second substrate via a silicon oxide film, the silicon oxide film being provided to have a lowered melting point that allows the bonding of the first and second substrates at a temperature lower than 1000 deg. C.

The above-mentioned objects of the present invention are achieved by an ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; and an electrode which is provided on a second substrate of silicon, the electrode facing the oscillation plate via a gap between the oscillation plate and the electrode, the electrode actuating the oscillation plate by electrostatic force upon application of a driving voltage to the electrode, wherein the first substrate is bonded to the second substrate via a silicon oxide layer, the silicon oxide layer containing phosphorus and/or boron on a surface thereof where the first substrate and the second substrate are bonded together.

The above-mentioned objects of the present invention are achieved by an ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; an electrode which is provided on a second substrate of silicon, the electrode facing the oscillation plate via a gap between the oscillation plate and the electrode, the electrode actuating the oscillation plate by electrostatic force upon application of a driving voltage to the electrode; and a spacer which is provided on the second substrate such that the spacer forms the gap between the oscillation plate and the electrode, the spacer having a silicon oxide layer where the first substrate is bonded to the second substrate via the spacer, the silicon oxide layer being provided to have a lowered melting point that allows the bonding of the first substrate and the second substrate at a temperature lower than 1000 deg. C.

The above-mentioned objects of the present invention are achieved by an ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; an electrode which is provided on a second substrate of silicon, the electrode facing the oscillation plate via a gap between the oscillation plate and the electrode, the electrode actuating the oscillation plate by electrostatic force upon application of a driving voltage to the electrode; and a spacer which is provided on the second substrate such that the spacer forms the gap between the oscillation plate and the electrode, the spacer having a silicon oxide layer thereon, the silicon oxide layer containing phosphorus and/or boron on a surface thereof where the first substrate is bonded to the second substrate via the spacer.

The above-mentioned objects of the present invention are achieved by an ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; an electrode which is provided on a second substrate of silicon, the electrode facing the oscillation plate via a gap between the oscillation plate and the electrode, the electrode actuating the oscillation plate by electrostatic force upon application of a driving voltage to the electrode; and a spacer which is provided on the second substrate such that the spacer forms the gap between the oscillation plate and the electrode, the spacer having a silicon oxide film on a surface thereof where the first substrate is bonded to the second substrate via the spacer, and a dummy groove being provided on the silicon oxide film.

The above-mentioned objects of the present invention are achieved by an ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; an electrode which is provided on a second substrate of silicon, the electrode facing the oscillation plate via a gap between the oscillation plate and the electrode, the electrode actuating the oscillation plate by electrostatic force upon application of a driving voltage to the electrode; and a spacer which is provided on the second substrate such that the spacer forms the gap between the oscillation plate and the electrode, the spacer having a silicon oxide layer on a surface thereof where the first substrate is bonded to the second substrate via the spacer, wherein a dummy electrode is provided on a base layer of the silicon oxide layer.

The above-mentioned objects of the present invention are achieved by a method of production of an ink-jet head, the ink-jet head including a nozzle discharging an ink drop to a recording medium, a discharging chamber communicating with the nozzle and containing ink therein, an oscillation plate provided on a first substrate of silicon, the oscillation plate defining a bottom surface of the discharging chamber, and an electrode provided on a second substrate of silicon, the electrode facing the oscillation plate via a gap between the oscillation plate and the electrode, the method comprising the steps of: providing a silicon oxide layer on one of the first substrate and the second substrate, the silicon oxide layer containing phosphorus and/or boron on a surface thereof where the first substrate and the second substrate are bonded together; thermally treating the silicon oxide layer at a temperature above a softening point of the silicon oxide layer; and bonding the first substrate to the second substrate via the silicon oxide layer at a temperature that is lower than the temperature of the thermal treatment step.

The above-mentioned objects of the present invention are achieved by a method of production of an ink-jet head, the ink-jet head including a nozzle discharging an ink drop to a recording medium, a discharging chamber communicating with the nozzle and containing ink therein, an oscillation plate provided on a first substrate of silicon, the oscillation plate defining a bottom surface of the discharging chamber, and an electrode provided on a second substrate of silicon, the electrode facing the oscillation plate via a gap between the oscillation plate and the electrode, the method comprising the steps of: providing a silicon oxide layer on one of the first substrate and the second substrate, the silicon oxide layer containing phosphorus and/or boron on a surface thereof where the first substrate and the second substrate are bonded together; thermally treating the silicon oxide layer at a temperature above a softening point of the silicon oxide layer; and bonding the first substrate to the second substrate via the silicon oxide layer at a temperature that is lower than the temperature of the thermal treatment step.

The above-mentioned objects of the present invention are achieved by an ink-jet printing system in which an ink-jet head is provided, the ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; and an electrode which is provided on a second substrate of silicon, the electrode facing the oscillation plate via a gap between the oscillation plate and the electrode, the electrode actuating the oscillation plate by electrostatic force upon application of a driving voltage to the electrode, wherein the first substrate is bonded to the second substrate via a silicon oxide layer, the silicon oxide layer containing phosphorus and/or boron on a surface thereof where the first substrate and the second substrate are bonded together.

The above-mentioned objects of the present invention are achieved by an ink-jet printing system in which an ink-jet head is provided, the ink-jet head comprising: a nozzle which discharges an ink drop to a recording medium; a discharging chamber which communicates with the nozzle and contains ink therein; an oscillation plate which is provided on a first substrate of silicon, the oscillation plate defining a bottom surface of the discharging chamber, the oscillation plate pressurizing the ink in the discharging chamber when the oscillation plate is actuated; an electrode which is provided on a second substrate of silicon, the electrode facing the oscillation plate via a gap between the oscillation plate and the electrode, the electrode actuating the oscillation plate by electrostatic force upon application of a driving voltage to the electrode; and a spacer which is provided on the second substrate such that the spacer forms the gap between the oscillation plate and the electrode, the spacer having a silicon oxide layer on a surface thereof where the first substrate is bonded to the second substrate via the spacer.

In the ink-jet head of the present invention, at least one of the first bonding area of the first substrate and the second bonding area of the second substrate is provided with the silicon oxide film, and the silicon oxide film contains boron on a surface thereof where the first substrate and the second substrate are bonded together. The ink-jet head of the present invention and the production method thereof are effective in providing reliable ink discharging characteristics and low manufacturing cost. The ink-jet head of the present invention and the production method thereof enable the direct bonding of the first substrate and the second substrate at a low temperature and with reliability, and is effective in providing an accurate and dense configuration of the components of the ink-jet head.

BRIEF DESCRIPTION OF THE DRAWINGS

Other objects, features and advantages of the present invention will be apparent from the following detailed description when read in conjunction with the accompanying drawings.

DETAILED DESCRIPTION OF PREFERRED EMBODIMENTS

A description will now be provided of the preferred embodiments of the present invention with reference to the accompanying drawings.

Figure 1:
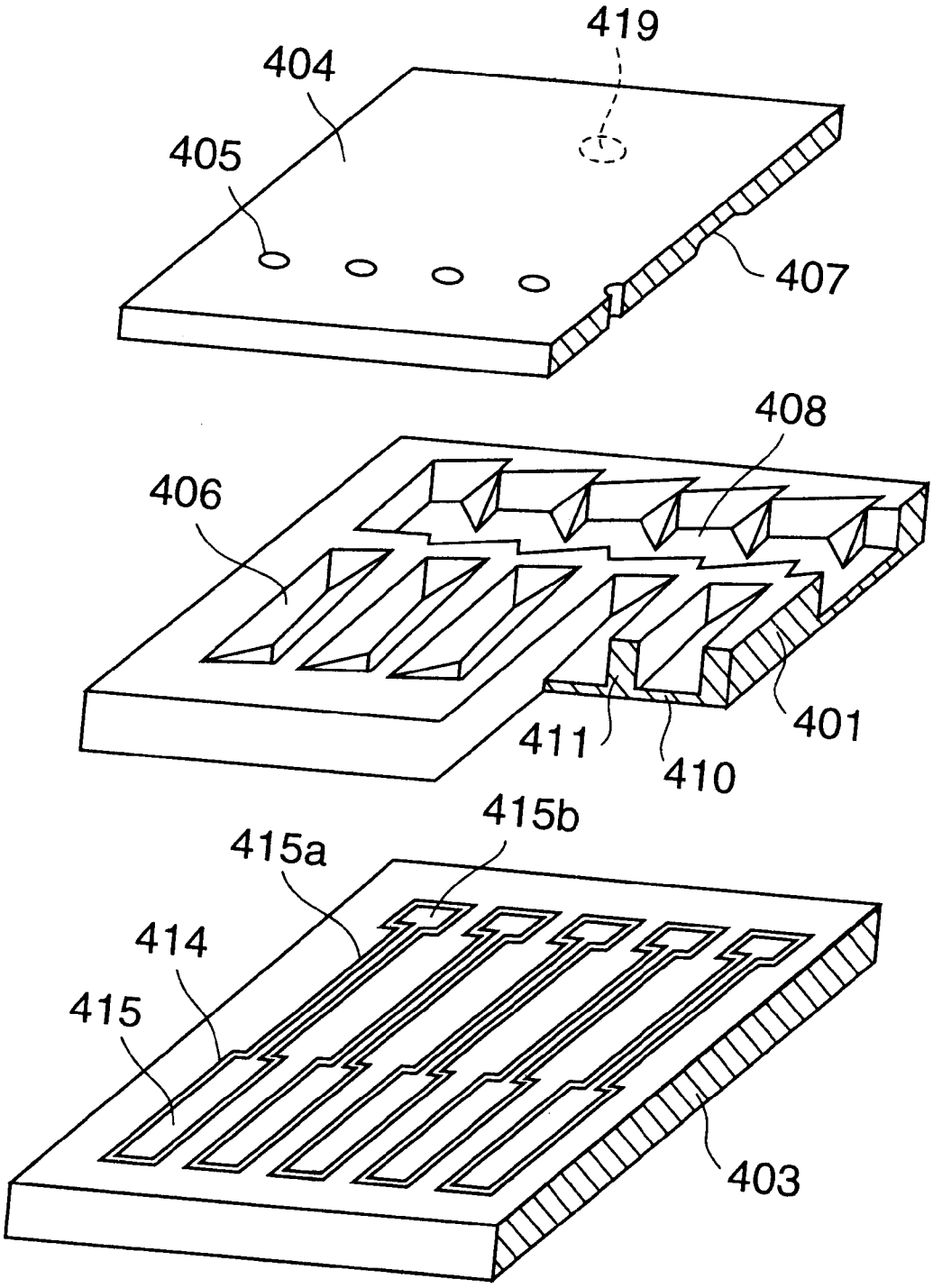
FIG. 1 is an exploded view of one preferred embodiment of an electrostatic ink-jet head of the invention.
Figure 2:
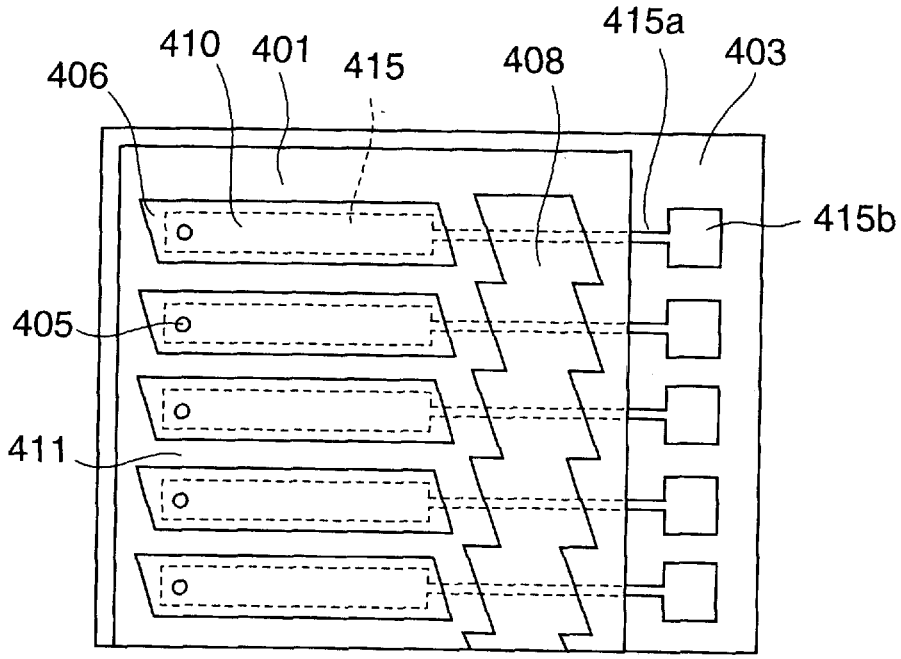
FIG. 2 is a top view of the ink-jet head of the present embodiment in which a nozzle plate is removed.
Figure 3:
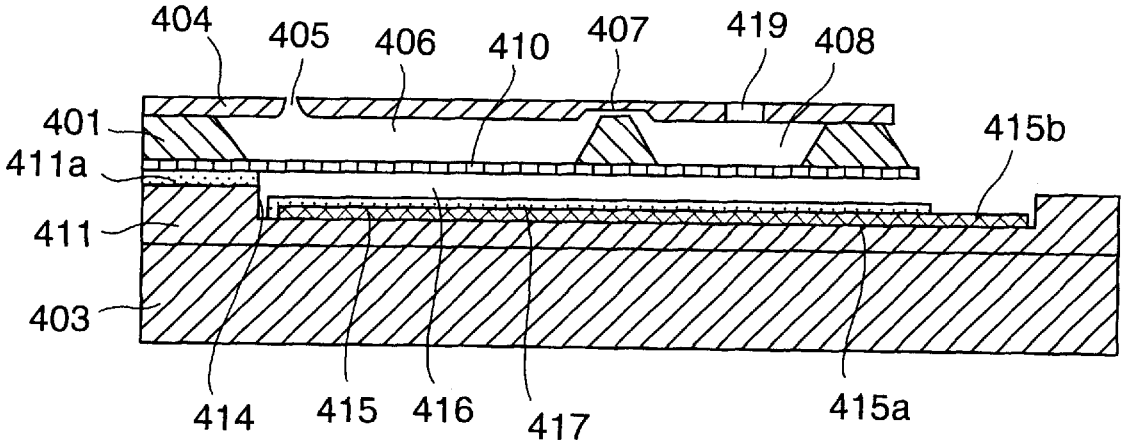
FIG. 3 is a longitudinal cross-sectional view of the ink-jet head of the present embodiment along a longitudinal line of an oscillation plate thereof.
Figure 4:
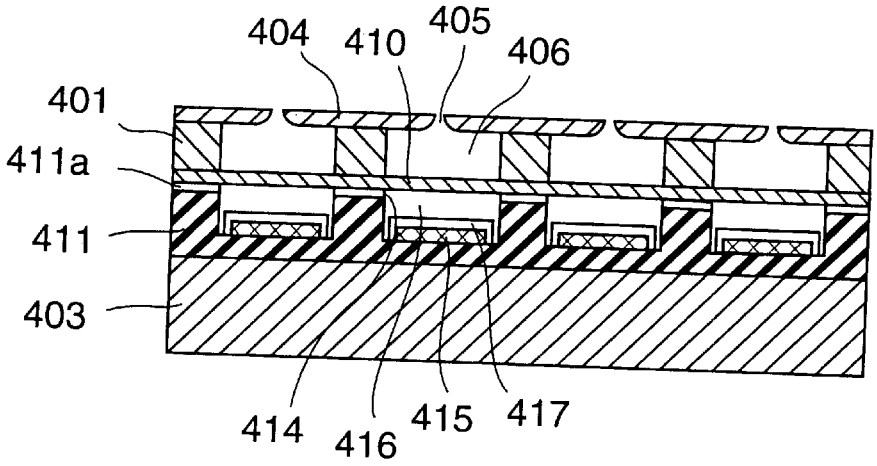
FIG. 4 is a transverse cross-sectional view of the ink-jet head of the present embodiment along a transverse line of the oscillation plate.

FIG. 1 is an exploded view of one preferred embodiment of an electrostatic ink-jet head of the invention. FIG. 2 is a top view of the ink-jet head of the present embodiment in which a nozzle plate is removed. FIG. 3 is a longitudinal cross-sectional view of the ink-jet head of the present embodiment along a longitudinal line of an oscillation plate thereof. FIG. 4 is a transverse cross-sectional view of the ink-jet head of the present embodiment along a transverse line of the oscillation plate thereof.

As shown, the ink-jet head of the present embodiment generally includes an ink-passage substrate 401 of silicon (which is also called a first substrate), an electrode substrate 403 of silicon (which is also called a second substrate) provided on bottom of the ink-passage substrate 401, and a nozzle plate 404 provided on top of the ink-passage substrate 401. The ink-passage substrate 401, the electrode substrate 403 and the nozzle plate 404 are bonded together to provide a laminated structure of the ink-jet head. These components of the ink-jet head form a plurality of nozzles 405, a corresponding number of discharging chambers 406, and a common ink chamber 408. Each discharging chamber 406 communicates with one of the plurality of nozzles 405 and contains ink therein. The common ink chamber 408 communicates with each of the respective discharging chambers 406 via a corresponding one of fluid resistance portions 407.

In the ink-passage substrate 401, the discharging chambers 406, oscillation plates 410 each defining the bottom surface of a corresponding one of the discharging chambers 406, recessed portions each defining partition walls 411 forming a corresponding one of the discharging chambers 406 therebetween, and a recessed portion defining the common ink chamber 408 are provided by using the silicon substrate.

For the sake of simplicity of description, it is assumed, in the following description, that the ink-jet head of the present embodiment comprises the nozzle 405, the discharging chamber 406, the oscillation plate 410 and the electrode 415. However, it should be noted that the actual ink-jet head includes, as shown in FIG. 1, the plural nozzles 405, the plural discharging chambers 406, the plural oscillation plates 410 and the plural electrodes 415.

In the ink-jet head of the present embodiment, the ink-passage substrate 401 includes a boron diffusion layer containing boron as a high concentration of p-type dopants in the silicon substrate. The boron as the high-concentration p-type dopants is diffused onto the silicon substrate 401 through ion implantation or the like. After anisotropic etching is performed on the silicon substrate, the boron diffusion layer is left on the silicon substrate, and the recessed portion defining the discharging chamber 406 is formed in the silicon substrate, and the oscillation plate 410 having the desired thickness is provided.

The source materials of the p-type dopants that may be used in the present embodiment include, in addition to boron, gallium and aluminum. A silicon oxide film or a silicon nitride film may be used as the anisotropic etching stop layer, and a single-crystal silicon or a polysilicon may be used as the source material of the oscillation plate 410.

In the electrode substrate 403, the thermal oxidation film 411 (the silicon dioxide film) having a thickness 1 $\mu$m is formed on the silicon substrate (the second substrate) by a thermal oxidation process. The thermal oxidation film 411 includes the recessed portion 414 having a depth 0.3 $\mu$m in which the electrode 415 is formed on the bottom of the recessed portion 414. The electrode 415 confronts the oscillation plate 410 via the gap 416 between the oscillation plate 410 and the electrode 415. The electrode 415 actuates the oscillation plate 410 by an electrostatic force generated when a driving voltage is applied to the electrode 415, so that the oscillation plate 410 pressurizes the ink in the discharging chamber 406 so as to discharge an ink drop from the nozzle 405.

In the present embodiment, the electrode 415 is formed through sputtering using a pattern of titanium nitride having a thickness 0.1 $\mu$m. After the ink-jet head is assembled by bonding the ink-passage substrate 401 and the electrode substrate 403 together, the gap 416 (or the distance between the oscillation plate 410 and the electrode 415) is set to 0.2 $\mu$m. The source material of the electrode 415 may include a doped polysilicon and a metal having a high melting point, such as tungsten, in addition to titanium nitride.

The surface of the electrode 415 is covered with an insulating layer 417. For example, the insulating layer 417 is formed by chemical vapor deposition (CVD) into a silicon dioxide film having a thickness 0.1 $\mu$m. The insulating layer 417 serves to avoid the occurrence of dielectric breakdown or short circuit of the ink-jet head when it is driven. In addition, the insulting layer 417 serves to prevent the oxidation of titanium nitride components contained in the electrode 415 during the production of the ink-jet head. As shown in FIG. 2, the electrode 415 includes a lead portion 415*a* and a pad 415*b* which are provided to electrically connect the electrode 415 to an external driving circuit (not shown).

In the ink-jet head of the present embodiment, the ink-passage substrate 401 (silicon) is bonded directly to the electrode substrate 403 (silicon) via the thermal oxidation film 411 (the silicon dioxide film). The thermal oxidation film 411 includes bonding areas 411*a* where the first substrate 401 and the second substrate 403 are bonded, and the bonding areas 411*a* are provided to have a lowered melting point such that the direct bonding of the substrates 401 and 403 is allowed at a temperature lower than 1000 deg. C. (for example, 800 deg. C.). To facilitate the direct bonding, the bonding surface of the ink-passage substrate 401 is polished to have a small surface roughness.

The bonding areas 411*a* of the thermal oxidation film 411 (the silicon oxide film) contain boron or $B_2O_3$ that is introduced by ion implantation. The bonding areas 411*a* of the thermal oxidation film 411, where the electrode substrate 401 is bonded to the ink-passage substrate 401, are provided to have a lowered melting point such that the direct bonding of the first silicon substrate 401 and the second silicon substrate 403 is allowed at a temperature lower than 1000 deg. C. (for example, 800 deg. C.).

In the above-described embodiment, the thermal oxidation film 411 on the electrode substrate 403, which includes the recessed portion 414 in which the electrode 15 is formed, is provided with the bonding areas 411*a* having the lowered melting point that is achieved by ion implantation of boron. Alternatively, the bonding areas of the oscillation plate 410 of the ink-passage substrate 401 may be solely or additionally provided to have the lowered melting point.

The nozzle plate 404 is made of a stainless steel (SUS) material having a thickness 50 μm, and the nozzles 405, the fluid resistance portions 407 and an ink supply opening 419 are formed in the nozzle plate 404. Ink is supplied from an external ink source to the common ink chamber 408 via the ink supply opening 419.

In the ink-jet head of the above-described embodiment, upon application of a pulsed driving voltage in the range of 0 to 35 V to the electrode 415 by a driving circuit (not shown), the surface of the electrode 415 is positively charged. The opposing surface of the oscillation plate 410 to the electrode 415 is negatively charged. The electrode 415 at this time actuates the oscillation plate 410 by a downward electrostatic force, and the oscillation plate 410 is deflected downward. On the other hand, when the driving voltage applied to the electrode 415 is turned off, the deflected oscillation plate 410 is recovered to the original position. By this movement of the oscillation plate 410, the ink in the discharging chamber 406 is pressurized so that an ink drop is discharged from the nozzle 405 onto a recording medium. After this, when the oscillation plate 410 is deflected downward again, the discharging chamber 406 is replenished with ink that is supplied from the common ink chamber 408 through the fluid resistance portion 407.

In the present embodiment, the surface of the oscillation plate 410 confronting the electrode 415, which is brought into contact with the insulating layer 417, is polished so that the polished surface has an adequately small surface roughness. When the oscillation plate 410 is actuated by the electrode 415 by the contact driving method such that the oscillation plate 410 contacts the insulating layer 417, it is possible to ensure that the damages of the insulating layer 17 by the oscillation plate 410 are reduced so as to provide adequate reliability against dielectric breakdown.

Next, a description will be given of a production method for the ink-jet head according to the present invention with reference to FIG. 5A through FIG. 8E.

Figure 5A:
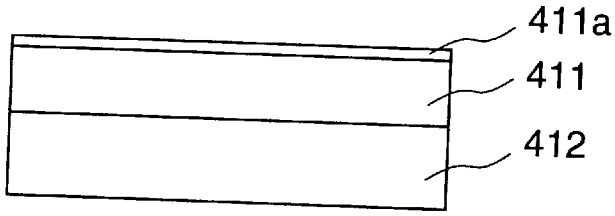
FIG. 5A, FIG. 5B and FIG. 5C are diagrams for explaining a production method for an electrode substrate of the ink-jet head of the present embodiment.
Figure 5B:
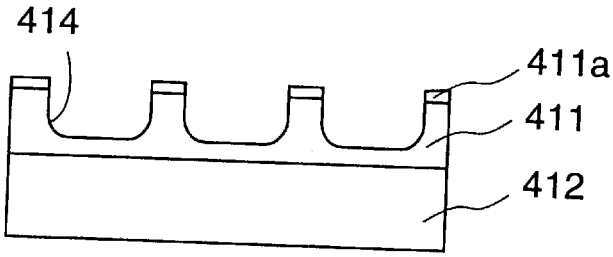
Figure 5C:
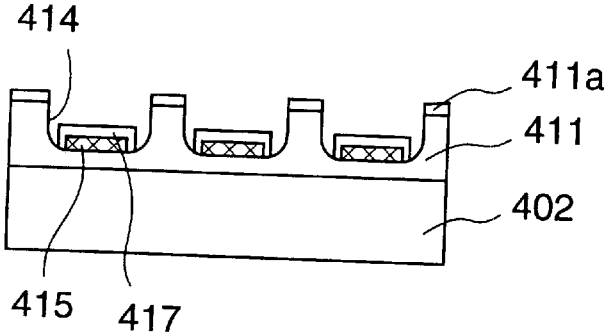

FIG. 5A, FIG. 5B and FIG. 5C show a production method for the electrode substrate of the ink-jet head of the present embodiment.

As shown in FIG. 5A, at a first step of the electrode substrate production, the thermal oxidation film 411 having a thickness 1 μm is formed on a surface of the source electrode substrate 402 that is a silicon substrate (the second substrate) having a thickness 625 μm and being in the crystal orientation <100>. Then, boron (B) is introduced into the surface of the thermal oxidation film 411 by performing ion implantation at 30 keV, 1.0E16 (/cm$^3$), and heat treatment is conducted in oxygen atmosphere at 900 deg. C. for 10 minutes. Hence, the bonding areas 411*a* are provided on the thermal oxidation film 411 so that the bonding areas 411*a* have a lowered melting point such that the direct bonding of the first substrate and the second substrate is allowed at a temperature lower than 1000 deg. C. It is preferred that the bonding areas 411*a* containing boron are located only on the bonding surfaces of the first and second substrates, since they tends to be charged and their insulation resistance tends to be reduced.

As shown in FIG. 5B, at a second step, the thermal oxidation film 411 is subjected to photolithography and wet etching using an aqueous solution of hydrofluoric acid, and the recessed portions 414 having a depth 0.3 μm are formed in the thermal oxidation film 411. Alternatively, a dry etching process may be performed instead of the wet etching process.

As shown in FIG. 5C, at a final step, a pattern of titanium nitride having a thickness 0.1 μm is formed on the bottom of the recessed portion 414 of the thermal oxidation film 414 in the electrode substrate 402 through reactive sputtering. The patterning of the electrodes 415 is performed through photolithography and dry etching, and the electrodes 415 are formed. A silicon dioxide film is produced by chemical vapor deposition (CVD), and photolithography and dry etching is conducted so that a pattern of the insulating layer 417 is formed so as to cover the electrodes 415 with the silicon dioxide film.

Figure 6A:
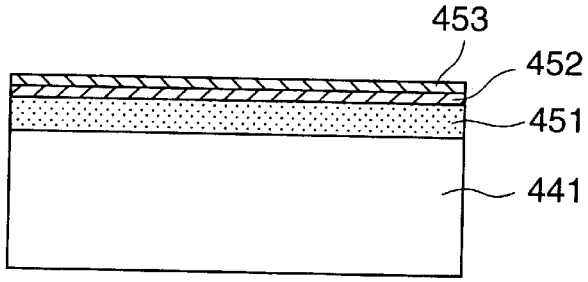
FIG. 6A, FIG. 6B and FIG. 6C are diagrams for explaining a production method for an ink-passage substrate of the ink-jet head of the present embodiment.
Figure 6B:
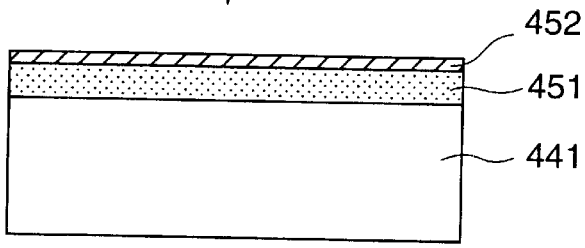
Figure 6C:
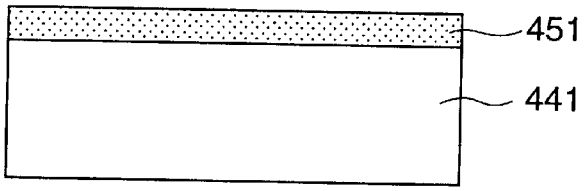
Figure 7:
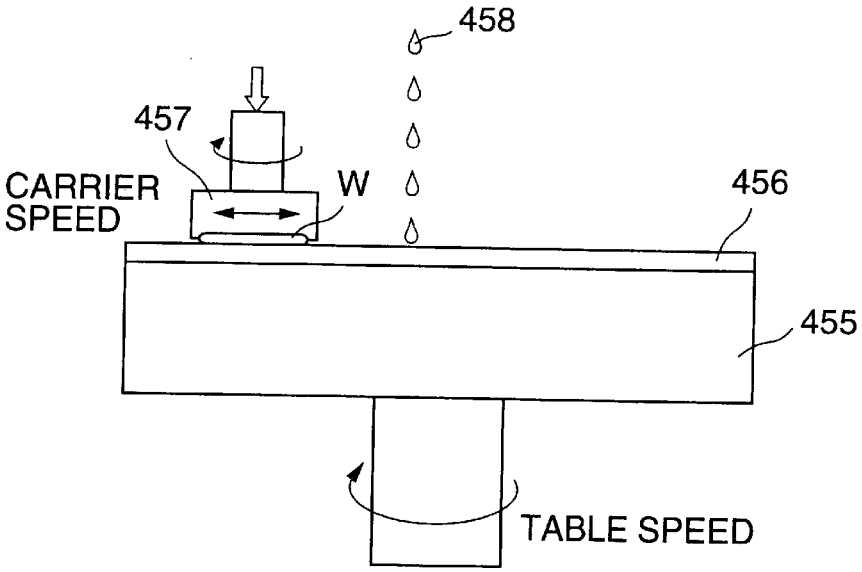
FIG. 7 is a diagram for explaining a polishing step of the production method of the ink-passage substrate.

FIG. 6A, FIG. 6B and FIG. 6C show a production method for an ink-passage substrate of the ink-jet head of the present embodiment. FIG. 7 shows a polishing step of the production method of the ink-passage substrate.

As shown in FIG. 6A, at a first step of the ink-passage substrate production, boron (B) is diffused through a solid diffusion process to a surface of the source ink-passage substrate 441 that is a silicon substrate (the first substrate) having a thickness 500 μm and being in the crystal orientation <110>. Alternatively, the boron diffusion method may be a vapor diffusion process using $BBr_3$, an ion implantation process, or a coating implantation process in which boron oxide $B_2O_3$, diffused in an organic solution, is spin coated onto the wafer, instead of the solid diffusion process.

After the solid implantation process is conducted in an oxygen-nitrogen atmosphere ($O_2$:$N_2$=0.25:1) at 1150 deg. C. for one hour, the high-concentration boron-doped silicon layer 451 is formed. In the born-doped silicon layer 451, the peak concentration of boron is 1.5E20/cm$^3$, and the concentration at depth 2.0 μm is 1.0E20/cm$^3$. When the boron-doped silicon layer 451 is formed, the glass layer 453 having a thickness about 150 nm is formed on the outermost surface of the substrate 441, and the silicon-boron alloy ($SiB_{4-6}$) layer 452 having a thickness about 30 nm is formed between the glass layer 453 and the born-doped silicon layer 451.

As shown in FIG. 6B, a second step is that the glass layer 453 is subjected to wet etching using a 10% aqueous solution of hydrofluoric acid for 15 minutes, and the glass layer 453 is removed. As a result, the silicon-boron alloy layer 452 on the first substrate 441 is exposed. A measurement of the surface of the alloy layer 452 performed by using an AFM microscope results in a comparatively large surface roughness (Ra=1.8 nm, the measurement area 10 μm□), showing that this surface of the alloy layer 451 does not allow the direct bonding of the first substrate 441 and the second substrate 402 at a temperature lower than 1000 deg. C.

As shown in FIG. 6C, at a final step, the silicon-boron alloy layer 452 on the first substrate 441 is subjected to chemical-mechanical polishing (CMP), so that the alloy layer 452 is completely removed.

In the CMP process, as shown in FIG. 7, the wafer "W" (the first substrate 441) is attached to an abrasion head 457 that is rotated at a given carrier speed, and the surface (the silicon-boron alloy layer 452) of the wafer "W" to be polished is placed on an abrasion pad 456 attached to an abrasion plate 455 that is rotated at a given table rotation speed. The surface of the wafer "W" is polished while compression force is applied and drops of slurry fluid 458 are applied to the abrasion pad 456.

In the present embodiment, the slurry fluid 458 used in the CMP process is a KOH-based slurry containing a fumed silica (the product name: SEMI-SPRESE25) which is diluted with demineralized water (the slurry: the water=1:1). The pH value of the diluted slurry fluid is 10.8. The polishing rate of the slurry fluid 458 varies depending on the source material being polished. It is preferred to select the slurry fluid of the type that is most suitable for the source material (the silicon-boron alloy) being polished. In addition, it is preferred to select the abrasion pad 456 of the type that is most suitable for the source material being polished. In the present embodiment, the abrasion pad 456 used in the CMP process is IC1000-SUBA or a soft-type abrasion pad for mirror finish polishing of silicon wafer.

In the present embodiment, the surface of the wafer "W" is polished under the following conditions:

table speed/carrier speed=38 rpm/25 rpm, polishing pressure=100 g/cm$^2$, polishing time=2 minutes (the polishing rate=45 nm/min).

After the polishing process is performed, the wafer is subjected to scrubbing cleaning (1% HF dip) for one minute, and the wafer is rinsed with pure water for 20 minutes.

When a certain degree of cleanness is needed, it is preferred to clean the wafer after the polishing process by using a sulfuric acid peroxide solution ($H_2SO_4$:$H_2O_2$:$H_2O$=1:1:5) or an aqueous ammonia peroxide solution ($NH_4OH$:$H_2O_2$:$H_2O$=1:1:5).

After the polishing process is performed, the alloy layer 452 is completely removed, and it is possible to obtain the high-concentration boron-doped silicon layer 451 having an adequately small surface roughness that allows the direct bonding of the first substrate 441 and the second substrate 402 at a temperature lower than 1000 deg. C. A measurement of the surface of the boron-doped silicon layer 451 performed by using the AFM microscope results in a surface roughness (Ra=0.2 nm, the measurement area 10 $\mu$m□).

During the polishing process, the entire alloy layer 452 and a part of the boron-doped silicon layer 451 are removed. The amount of the removed boron-doped silicon layer 451 significantly affects the thickness of the oscillation plate 410. It is necessary to control the amount of the removed boron-doped silicon layer 451 with high accuracy during the polishing process. For this purpose, the amount of the removed boron-doped silicon layer 451 is made as small as possible (preferably, 2000 Å or less) in the present embodiment. A measurement of the amount of the removed boron-doped silicon layer 451 indicates 900 Å, and the variations of the amount fall within the range of ±150 Å.

FIG. 8A, FIG. 8B, FIG. 8C, FIG. 8D and FIG. 8E show a production method of the ink-jet head of the present embodiment.

Figure 8A:
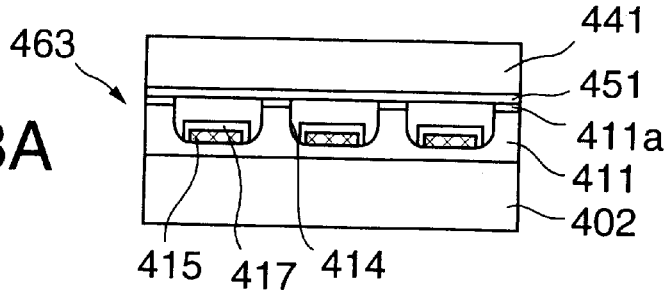
FIG. 8A, FIG. 8B, FIG. 8C, FIG. 8D and FIG. 8E are diagrams for explaining one embodiment of the production method of the ink-jet head according to the invention.

As shown in FIG. 8A, the electrode substrate 402 (the second substrate), including the recessed portions 414 and the electrodes 415, and the ink-passage substrate 441 (the first substrate) are subjected to cleaning using a sulfuric acid solution ($H_2SO_4$:$H_2O_2$=2:1, temperature 100 deg. C.). After they dry up, the ink-passage substrate 441 is attached to the electrode substrate 401 in a reduced pressure at room temperature. They are heated in a nitrogen atmosphere at 800 deg. C. for 2 hours, so that the ink-passage substrate 441 is bonded directly to the electrode substrate 402.

At the time of the direct bonding, since the bonding areas 411*a* of the thermal oxidation film 411 on the electrode substrate 402 are provided to have a lowered melting point, the bonding areas 411*a* are easily melted at 800 deg. C. so that good adhesion of the first and second substrates 441 and 402 is provided. As described earlier, the boron-doped silicon layer 451 of the ink-passage substrate 441 is provided with the polished surface having an adequately small surface roughness, and it is possible to provide an increased strength of the bonding of the two substrates 441 and 402 with good reliability. Further, because of the small surface roughness of the boron-doped silicon layer 451, the accuracy of the gap 416 between the oscillation plate 410 and the electrode 415 can be maintained at a high level.

Figure 8B:
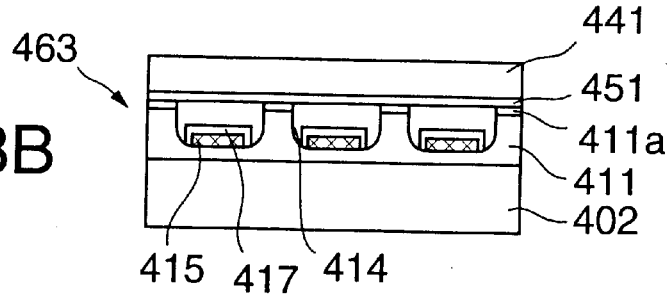
Figure 8C:
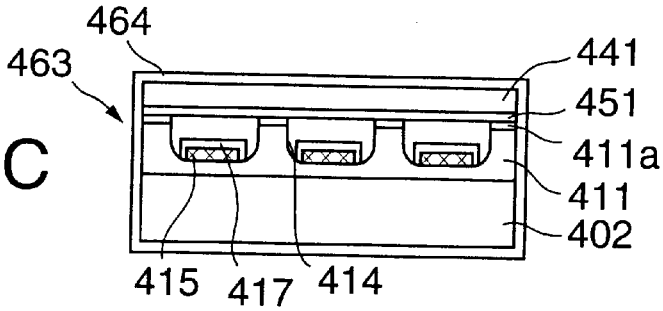
Figure 8D:
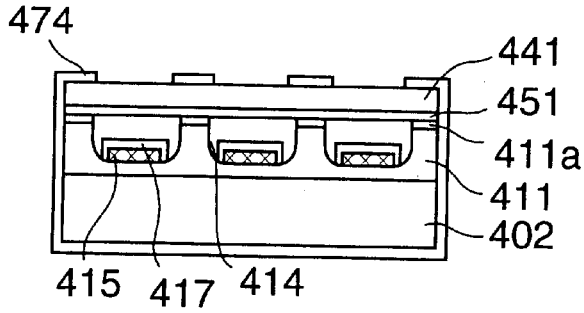

As shown in FIG. 8B, the ink-passage substrate 441 having the thickness 500 $\mu$m is polished so that it is thinned to a thickness 100 $\mu$m. After the polishing is performed, as shown in FIG. 8C, a silicon nitride film 464 is formed on the entire bonded substrate 463 by low-pressure CVD, and the silicon nitride film 464 is subjected to resist coating, light exposure and development, so that a resist pattern of the discharging chambers 406 and the common ink chamber 408 is formed therein. Adjustment of the position of the resist pattern is performed to match with the position of the electrodes 415 of the electrode substrate 403. After this, as shown in FIG. 8D, the resist pattern is subjected to dry etching, and a mask pattern of the silicon nitride film 464 is formed.

After the pattern forming is performed, the ink-passage substrate 441 of the bonded substrate 463 is subjected wet etching using a KOH solution (10% by weight), and the etching of the silicon nitride film 464 in the ink-passage substrate 441 is processed until the depth where the boron concentration is 1.0E20/cm$^3$ is reached. The etching rate is extremely reduced at that depth, and the boron-doped silicon layer 451 serves as the etching stop layer.

Figure 8E:
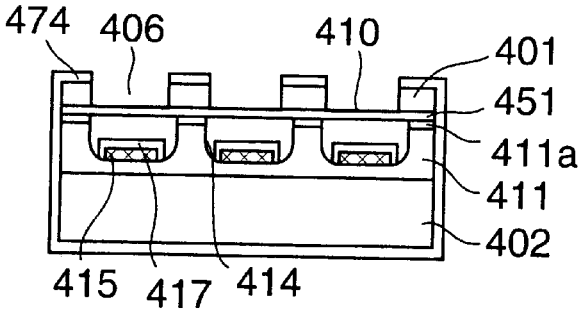

As shown in FIG. 8E, the ink-passage substrate 401, which has the oscillation plates 410, including the high-concentration boron-doped silicon layer 451, and the discharging chambers 406, is produced. The thickness of the resulting oscillation plate 410 after the above production method is performed can be controlled to 2 $\mu$m±0.1 $\mu$m. The variations of the thickness of the resulting oscillation plate 410 are inclusive of the variations (±0.015 $\mu$m) of the thickness of the boron-doped silicon layer 451 caused during the CMP process.

In the above embodiment, the side-shooter type ink-jet head to which the present invention is applied has been described. However, the present invention is not limited to the above embodiment. For example, the present invention is applicable to the edge-shooter type ink-jet head in which the ink discharging direction is perpendicular to the direction of actuation of the oscillation plate.

Figure 9:
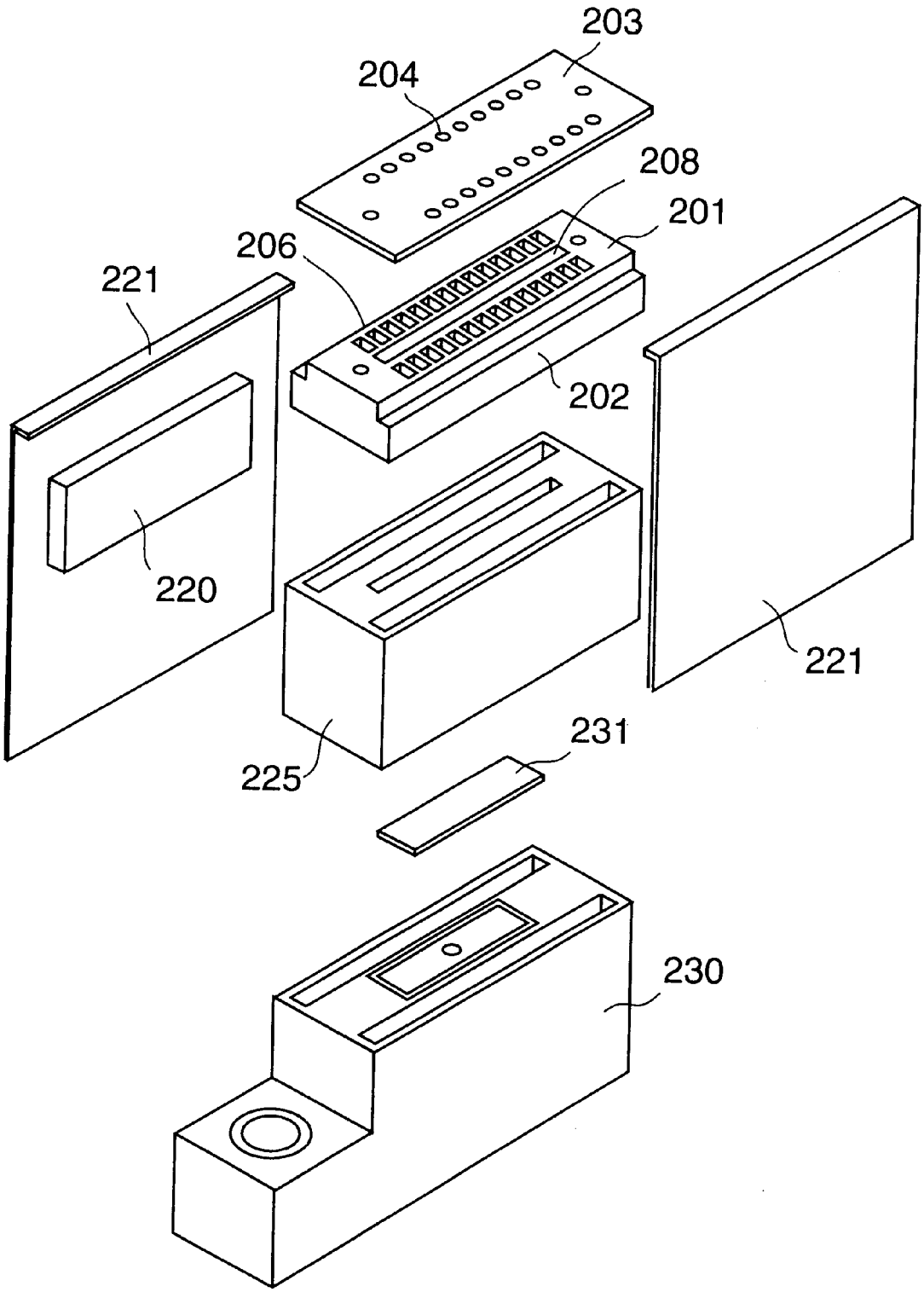
FIG. 9 is an exploded view of another preferred embodiment of the ink-jet head of the invention.

Next, FIG. 9 is an exploded view of another preferred embodiment of the ink-jet head of the invention.

Figure 10:
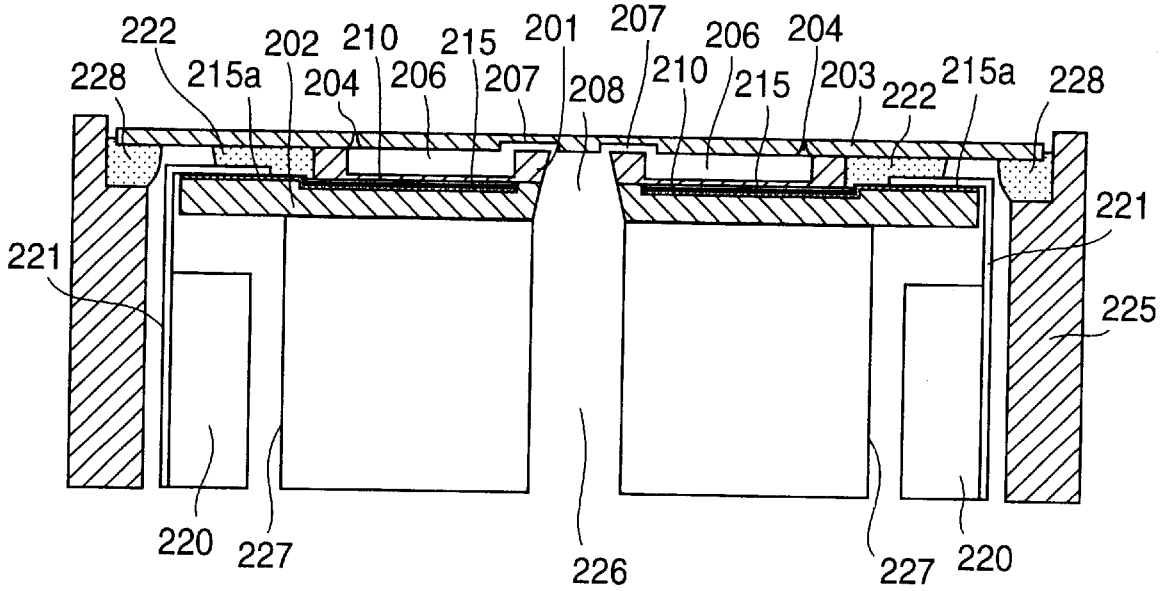
FIG. 10 is a longitudinal cross-sectional view of the ink-jet head of the present embodiment along a longitudinal line of an oscillation plate thereof.
Figure 11:
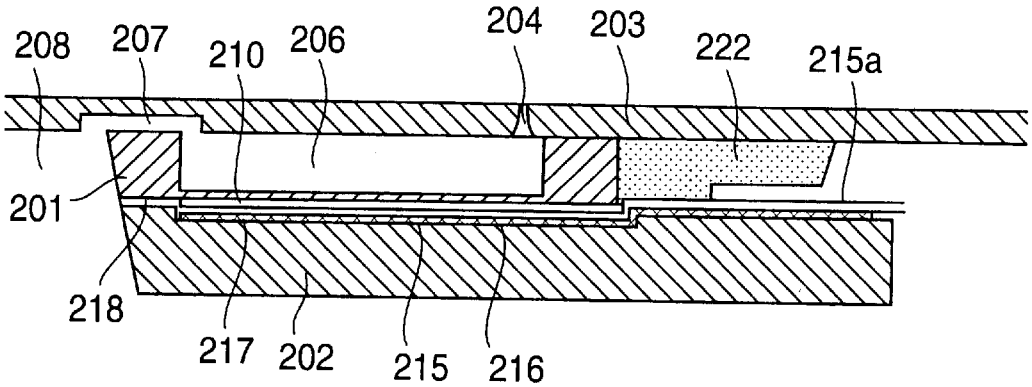
FIG. 11 is an enlarged view of the ink-jet head of the present embodiment in FIG. 10.
Figure 12:
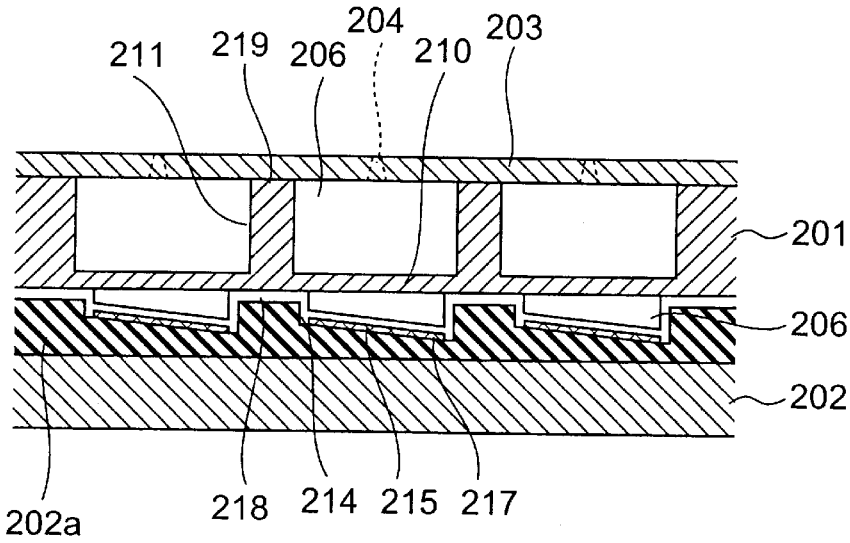
FIG. 12 is a transverse cross-sectional view of the ink-jet head of the present embodiment along a transverse line of the oscillation plate.

FIG. 10 is a longitudinal cross-sectional view of the ink-jet head of the present embodiment along a longitudinal line of an oscillation plate thereof. FIG. 11 is an enlarged view of the ink-jet head of the present embodiment in FIG. 10. FIG. 12 is a transverse cross-sectional view of the ink-jet head of the present embodiment along a transverse line of the oscillation plate.

As shown, the ink-jet head of the present embodiment generally includes an ink-passage substrate 201 of single-crystal silicon (also called the first substrate), an electrode substrate 202 of single-crystal silicon (also called the second substrate) provided on bottom of the ink-passage substrate 201, and a nozzle plate 203 of single-crystal silicon (also called the third substrate) provided on top of the ink-passage substrate 201. The ink-passage substrate 201, the electrode substrate 202 and the nozzle plate 203 are bonded together to provide a laminated structure of the ink-jet head. These components of the ink-jet head form a plurality of nozzles 204, a corresponding number of discharging chambers 206, and a common ink chamber 208. Each discharging chamber 206 communicates with one of the plurality of nozzles 204 and contains ink therein. The common ink chamber 208 communicates with each of the respective discharging chambers 206 via a corresponding one of fluid resistance portions 207.

In the ink-passage substrate 201, the discharging chambers 206 communicating with the nozzles 204, the oscillation plates 210 each defining the bottom surface of a corresponding one of the discharging chambers 206, the recessed portions 214 each defining partition walls forming a corresponding one of the discharging chambers 206 therebetween, and a recessed portion defining the common ink chamber 208 are provided by using the silicon substrate.

For the sake of simplicity of description, it is assumed, in the following description, that the ink-jet head of the present embodiment comprises the nozzle 204, the discharging chamber 206, the oscillation plate 210 and the electrode 215. However, it should be noted that the actual ink-jet head includes, as shown in FIG. 9, the plural nozzles 204, the plural discharging chambers 206, the plural oscillation plates 210 and the plural electrodes 215.

In the ink-jet head of the present embodiment, the ink-passage substrate 201 includes a boron diffusion layer containing boron as a high concentration of p-type dopants in the silicon substrate. The boron as the high-concentration p-type dopants is diffused onto the silicon substrate 201 through ion implantation or the like. After anisotropic etching is performed on the silicon substrate, the boron diffusion layer is left on the silicon substrate, and the recessed portion defining the discharging chamber 206 is formed in the silicon substrate, and the oscillation plate 210 having the desired thickness is provided.

In the nozzle plate 203, the nozzles 204 and the grooves defining the fluid resistance portions 207 are provided by using the silicon substrate. Alternatively, a SOI (silicon-on-insulator) substrate in which a base silicon substrate and an activation layer substrate are bonded via a silicon dioxide layer, may be used, and the activation layer substrate may be configured into the oscillation plate 210.

In the electrode substrate 202, by using the single-crystal silicon substrate, a silicon dioxide layer 202*a* is formed through a thermal oxidation process. In the silicon dioxide layer 202*a*, the recessed portion 214 is formed. The electrode 215 is provided on the bottom of the recessed portion 214 such that the electrode 215 confronts the oscillation plate 210 via the gap 216 between the electrode 215 and the oscillation plate 210. The electrode 215 and the oscillation plate 210 form the electrostatic actuator of the ink-jet head. Namely, the electrode 215 actuates the oscillation plate 210 by an electrostatic force generated when a driving voltage is applied to the electrode 215, so that the oscillation plate 210 pressurizes the ink in the discharging chamber 206 so as to discharge an ink drop from the nozzle 204. The depth of the recessed portion 214 in the electrode substrate 202 is predetermined so as to define an appropriate dimension of the gap 216 (or the distance between the electrode 215 and the oscillation plate 10).

As shown in FIG. 12, the recessed portion 214 of the electrode substrate 202 has a slanted configuration in the transverse cross-section thereof. As the electrode 215 is provided on the bottom of the recessed portion 214, the oscillation plate 210 and the electrode 215 are opposed to each other in a non-parallel position in the transverse cross-section thereof. Hereinafter, the gap 216 in which the oscillation plate 210 and the electrode 215 confront each other in the non-parallel position will be referred to as the non-parallel gap. Alternatively, the ink-jet head may be configured so that the oscillation plate 210 and the electrode 215 are opposed to each other in a parallel position in the transverse cross-section thereof. Alternatively, the ink-jet head may be configured so that the oscillation plate 210 and the electrode 215 are opposed to each other in a non-parallel position in the longitudinal cross-section thereof.

The source materials of the electrode 215 on the electrode substrate 202 may include gold (Au), aluminum (Al), chromium (Cr), nickel (Ni), titanium (Ti), titanium nitride (TiN), and tungsten (W).

In the nozzle plate 203, the nozzles 204 and the grooves defining the fluid resistance portions 207 are provided, each fluid resistance portion 207 being provided to interconnect the common ink chamber 208 and the discharging chamber 206. A water-repellent film is formed on the ink-discharging surface of the nozzle plate 203. In the present embodiment, the source material of the nozzle plate 203 is a stainless steel substrate. A nickel plating may be applied to the nozzle plate 203 by an electroforming process. A resin substrate, such as polyimide, which is processed by an excimer laser, or a metal plate which is perforated with nozzle openings by a press forming process may be used as the source material of the nozzle plate 203.

In the ink-jet head of the present embodiment, the ink-passage substrate 201 is bonded to the electrode substrate 202 via the silicon dioxide layer 218 that contains phosphorus and/or boron. The silicon dioxide layer 218 is provided on the entire electrode substrate surface, and the silicon dioxide layer 218 on the surface of the electrode 215 serves as the electrode protecting film 217.

The silicon dioxide layer 218 of the present embodiment may have a two-layer structure including a silicon oxide film (non-doped silicate glass NSG) containing neither phosphorus nor boron and a silicon oxide film (borophospho-silicate glass BPSG) containing phosphorus and boron.

Alternatively, the silicon dioxide layer 218 of the present embodiment may have a three-layer structure including a silicon oxide film (non-doped silicate glass NSG) containing neither phosphorus nor boron, a silicon oxide film (borophospho-silicate glass BPSG) containing phosphorus and boron, and a silicon oxide film (boro-silicate glass BSG) containing boron but containing no phosphorus.

Alternatively, the silicon dioxide layer 218 of the present embodiment may have a three-layer structure including a silicon oxide film (non-doped silicate glass NSG) containing neither phosphorus nor boron, a silicon oxide film (borophospho-silicate glass BPSG) containing phosphorus and boron, and a silicon oxide film (phospho-silicate glass PSG) containing phosphorus but containing no boron.

Alternatively, the silicon dioxide layer 218 of the present embodiment may be a silicon oxide film (spin-on glass SOG) that is coated onto one of the ink-passage substrate 201 and the electrode substrate 202.

In the ink-jet head of the present embodiment, the nozzles 204 are arranged in two rows, and, in correspondence with the nozzles 204, the discharging chambers 206, the oscillation plates 210 and the electrodes 215 are also arranged in two rows. The common ink chamber 208 is arranged in the middle of the two nozzle rows, and the ink is supplied from the common ink chamber 208 to each of the two discharging chamber rows. The ink-jet head of the present embodiment can provide a simple structure for a multiple-nozzle head including the multiple nozzles.

Each of the electrodes 215 includes a pad 215*a* which is externally extended. A pair of FPC cables 221 to which a driver circuit (driver IC) 220 is bonded by wire bonding, are connected to the pad 215*a* of each electrode 215 via an isotropic conductive film or the like. The driver circuit 220 supplies a driving voltage to each of the electrodes 215 when the electrode 215 actuates the oscillation plate 210 so as to pressurize the ink in the discharging chamber 206 and discharge an ink drop from the nozzle 204. The circumferential portion between the electrode substrate 202 and the nozzle plate 203, which is located at the inlet to the gap 216, is sealed by a gap sealing agent 222 that uses an epoxy-based adhesive agent. The gap sealing agent 222 serves to prevent the inclusion of humid air into the gap 216, which will cause the hardening of the oscillation plate 210.

The whole ink-jet head is bonded to a frame member 225 by an adhesive agent. An ink supply opening 226 is provided in the frame member 225 such that the ink can be externally supplied from the ink supply opening 226 to the common ink chamber 226. The frame member 225 further includes a pair of recessed portions 227, and the FPC cables 221 are included in the recessed portions 227 so that the electrical connection between the FPC cables 221 and the pads 215*a* of the electrodes 215 is established.

The circumferential portion between the frame member 225 and the nozzle plate 203 is sealed by a gap sealing agent 228 that uses an epoxy-based adhesive agent. The gap sealing agent 228 serves to prevent the inclusion of the ink on the water-repellent surface of the nozzle plate 203 into the electrode substrate 202 or the FPC cables 221. A joint member 230, which is connected to an ink cartridge (not shown), is attached to the frame member 225 via a filter 231. The filter 213 is thermally bonded to the frame member 225. The ink from the ink cartridge is supplied to the common ink chamber 208 via the filter 213 and the ink supply opening 226.

In the ink-jet head of the above-described embodiment, upon application of a driving voltage to the electrode 215 by the driving circuit 220, the electrode 215 actuates the oscillation plate 210 by a downward electrostatic force, and the oscillation plate 210 is deflected downward. On the other hand, when the driving voltage applied to the electrode 215 is turned off, the deflected oscillation plate 210 is recovered to the original position. By this movement of the oscillation plate 210, the ink in the discharging chamber 206 is pressurized so that an ink drop is discharged from the nozzle 204 onto a recording medium. After this, when the oscillation plate 210 is deflected downward again, the discharging chamber 206 is replenished with ink that is supplied from the common ink chamber 208 through the fluid resistance portion 207.

In the present embodiment, the ink-passage substrate 201 (the first substrate) is bonded to the electrode substrate 202 (the second substrate) via the silicon oxide layer 218, and the silicon oxide layer 218 contains phosphorus and/or boron on the surface thereof where the first substrate 201 and the second substrate 202 are bonded together. The softening point of the silicon oxide film 218 is lowered from the softening point of a simple silicon oxide film containing neither phosphorus nor boron. Hence, the direct bonding of the first substrate 201 and the second substrate 202 is allowed at a temperature lower than the temperature needed for the simple silicon oxide film. A re-flow of the surface of the silicon oxide layer 218 occurs when heated, and the surface roughness of the surface of the silicon oxide layer 218 is reduced (Ra<0.2 nm). Therefore, it is possible for the ink-jet head of the present embodiment to provide good adhesion of the first and second substrates 201 and 202 with low cost.

When the silicon dioxide layer 218 having the two-layer structure including the NSG film and the BPSG film, is provided in the ink-jet head of the present embodiment, the BPSG film is placed to cover the bonding areas between the first and second substrates 201 and 202. It is possible to increase the ink-sealing property of the ink-jet head by the use of the BSG film.

When the silicon dioxide layer 218 having the three-layer structure including the NSG film, the BPSG film and the BSG film, is provided in the ink-jet head of the present embodiment, the BSG film is placed to cover the bonding areas between the first and second substrates 201 and 202. It is possible to increase the accuracy of the gap between the electrode 215 and the oscillation plate 210 with no variation by the use of the BPSG film. Further, when the boron components of the silicon dioxide layer 218 are used as the dopants on the silicon substrate of the ink-passage substrate 201, variation of the electrical characteristics of the ink-jet head can be reduced by the presence of the boron components.

When the silicon dioxide layer 218 having the three-layer structure including the NSG film, the BPSG film and the PSG film, is provided in the ink-jet head of the present embodiment, the PSG film is placed to cover the bonding areas between the first and second substrates 201 and 202. It is possible to prevent the degradation of the electrode material by the use of the PSG film. Further, when the phosphorus components of the silicon dioxide layer 218 are used as the dopants on the silicon substrate of the ink-passage substrate 201, variation of the electrical characteristics of the ink-jet head can be reduced by the presence of the phosphorus components.

When the silicon oxide layer 218 that is the silicon oxide film SOG coated onto one of the first substrate 201 and the second substrate 202, is provided in the ink-jet head of the present embodiment, it is possible to easily produce the silicon dioxide layer 218 having an adequately large thickness. A silicon substrate with non-polished surfaces can be used, and the manufacturing cost can be further reduced.

Figure 13:
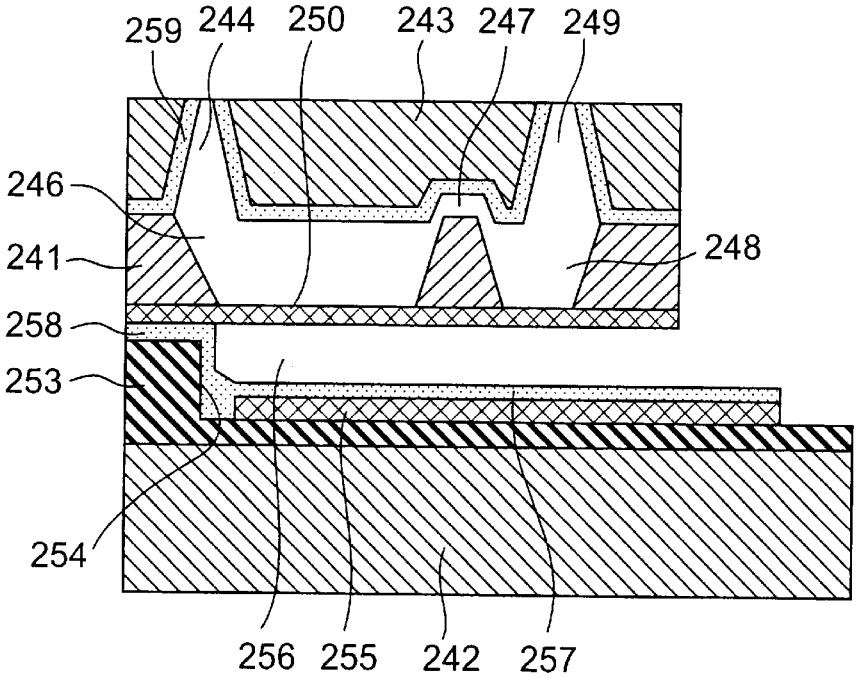
FIG. 13 is a longitudinal cross-sectional view of another preferred embodiment of the ink-jet head of the invention along a longitudinal line of an oscillation plate thereof.
Figure 14:
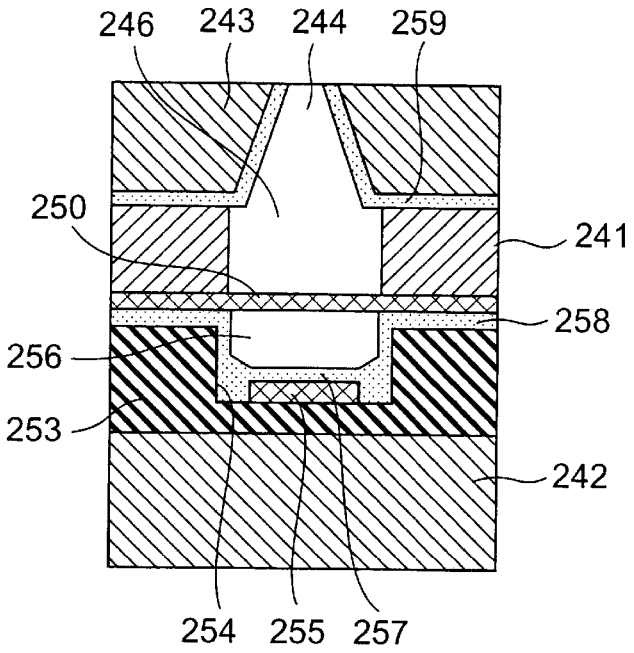
FIG. 14 is a transverse cross-sectional view of the ink-jet head of the present embodiment along a transverse line of the oscillation plate.
Figure 15:
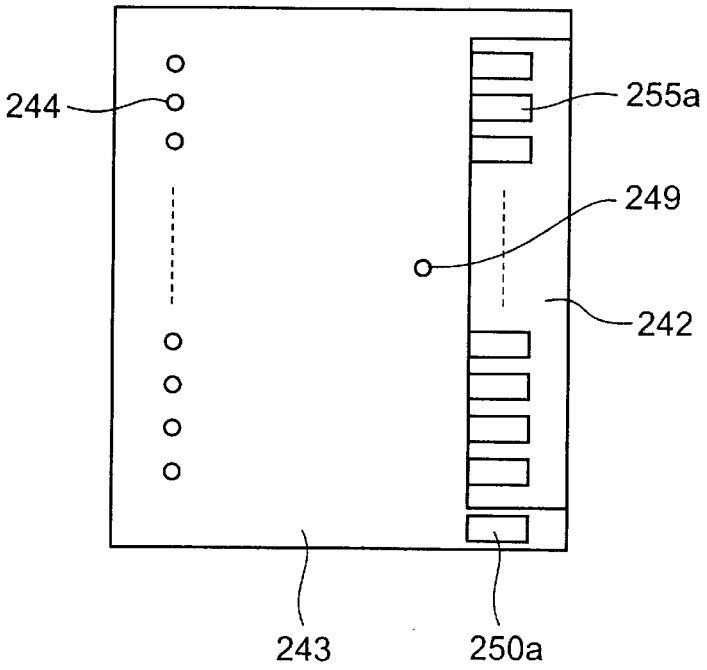
FIG. 15 is a top view of the ink-jet head of the present embodiment.

Next, FIG. 13 is a longitudinal cross-sectional view of another preferred embodiment of the ink-jet head of the invention along a longitudinal line of an oscillation plate thereof. FIG. 14 is a transverse cross-sectional view of the ink-jet head of the present embodiment along a transverse line of the oscillation plate. FIG. 15 is a top view of the ink-jet head of the present embodiment.

As shown, the ink-jet head of the present embodiment generally includes an ink-passage substrate 241 of single-crystal silicon (also called the first substrate), an electrode substrate 242 of single-crystal silicon (also called the second substrate) provided on bottom of the ink-passage substrate 241, and a nozzle plate 243 of single-crystal silicon (also called the third substrate) provided on top of the ink-passage substrate 241. The ink-passage substrate 241, the electrode substrate 242 and the nozzle plate 243 are bonded together to provide a laminated structure of the ink-jet head. These components of the ink-jet head form a plurality of nozzles 244, a corresponding number of discharging chambers 246, and a common ink chamber 248. Each discharging chamber 226 communicates with one of the plurality of nozzles 244 and contains ink therein. The common ink chamber 248 communicates with each of the respective discharging chambers 246 via a corresponding one of fluid resistance portions 247. In the nozzle plate 243, an ink supply opening 249 which communicates with the common ink chamber 248 is provided.

In the ink-passage substrate 241, the discharging chambers 246 communicating with the nozzles 244, the oscillation plates 250 each defining the bottom surface of a corresponding one of the discharging chambers 246, the recessed portions 254 each defining partition walls forming a corresponding one of the discharging chambers 246 therebetween, and a recessed portion defining the common ink chamber 248 are provided by using the silicon substrate.

For the sake of simplicity of description, it is assumed, in the following description, that the ink-jet head of the present embodiment comprises the nozzle 244, the discharging chamber 246, the oscillation plate 250 and the electrode 255. However, it should be noted that the actual ink-jet head includes the plural nozzles 244, the plural discharging chambers 246, the plural oscillation plates 250, and the plural electrodes 255.

In the nozzle plate 243, the nozzles 244 and the grooves defining the fluid resistance portions 247 are provided by using the silicon substrate. Alternatively, a SOI (silicon-on-insulator) substrate in which a base silicon substrate and an activation layer substrate are bonded via a silicon dioxide layer, may be used, and the activation layer substrate may be configured into the oscillation plate 240.

In the electrode substrate 242, by using the single-crystal silicon substrate, a silicon dioxide layer 253 is formed through a thermal oxidation process. In the silicon dioxide layer 253, the recessed portion 244 is formed. The electrode 255 is provided on the bottom of the recessed portion 244 such that the electrode 255 confronts the oscillation plate 250 via the gap 256 between the electrode 255 and the oscillation plate 250. The electrode 255 and the oscillation plate 250 form the electrostatic actuator of the ink-jet head. Namely, the electrode 255 actuates the oscillation plate 250 by an electrostatic force generated when a driving voltage is applied to the electrode 255, so that the oscillation plate 250 pressurizes the ink in the discharging chamber 246 so as to discharge an ink drop from the nozzle 244. The depth of the recessed portion 254 in the electrode substrate 242 is predetermined so as to define an appropriate dimension of the gap 256 (or the distance between the electrode 255 and the oscillation plate 250).

In the ink-jet head of the present embodiment, the ink-passage substrate 241 and the electrode substrate 242 are bonded together via a silicon oxide layer 258 containing phosphorus and boron (the BPSG film). In the present embodiment, the silicon oxide layer 258 is formed on the entire surface of the electrode substrate 242. The silicon oxide layer 258 includes an electrode protecting film 257 that is provided on the surface of the electrode 255.

Alternatively, the silicon oxide layer 258 may have a two-layer structure including the BPSG film and one of the BSG film, the PSG film and the NSG film, instead of the BPSG film 258 of the above embodiment. Alternatively, the silicon oxide layer 258 may have a three-layer structure including the NSG film, the BPSG film and the BSG film, or a three-layer structure including the NSG film, the BPSG film and the PSG film.

As shown in FIG. 12, each of the electrodes 255 on the electrode substrate 242 includes a pad 255*a* which is externally extended. Further, each of the oscillation plates 250 includes a pad 250*a* which is externally extended on the nozzle plate 243.

Further, in the ink-jet head of the present embodiment, the ink-passage substrate 241 and the nozzle substrate 243 are bonded together via a silicon oxide layer 259 containing phosphorus and boron (the BPSG film). Alternatively, the silicon oxide layer 259 may have a two-layer structure including the BPSG film and one of the BSG film, the PSG film and the NSG film, instead of the BPSG film 259 of the above embodiment. Alternatively, the silicon oxide layer 259 may have a three-layer structure including the NSG film, the BPSG film and the BSG film, or a three-layer structure including the NSG film, the BPSG film and the PSG film.

Next, a description will be given of a production method for the ink-jet head of the above embodiment shown in FIG. 13, with reference to FIG. 16A through FIG. 21B.

FIG. 16A through FIG. 16D, FIG. 17A through FIG. 17C and FIG. 18A and FIG. 18B are transverse cross-sectional views of the ink-jet head along a transverse line of the oscillation plate thereof for explaining the production method of the present embodiment. FIG. 19A through FIG. 19D, FIG. 20A through FIG. 20C and FIG. 21A and FIG. 21B are longitudinal cross-sectional views of the ink-jet head along a longitudinal line of the oscillation plate thereof for explaining the production method of the present embodiment.

In FIG. 16A through FIG. 21B, the elements that are essentially the same as corresponding elements in FIG. 13 through FIG. 15 are designated by the same reference numerals.

Figure 16A:
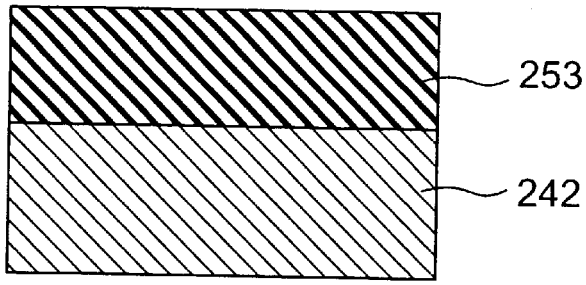
FIG. 16A, FIG. 16B, FIG. 16C and FIG. 16D are diagrams for explaining another embodiment of the production method of the ink-jet head according to the invention.
Figure 19A:
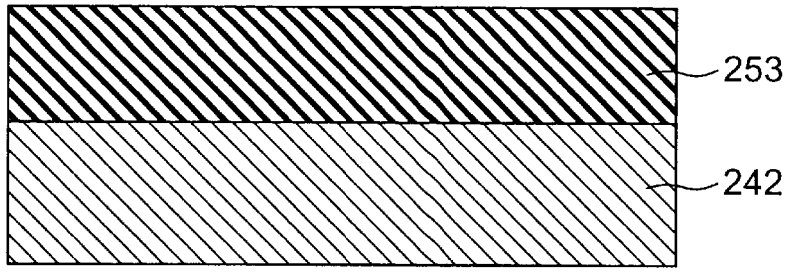
FIG. 19A, FIG. 19B, FIG. 19C and FIG. 19D are diagrams for explaining another embodiment of the production method of the ink-jet head according to the invention.

As shown in FIG. 16A and FIG. 19A, a silicon oxide layer 253 having a thickness about 2 $\mu$m is formed on a surface of the source electrode substrate 242 that is a p-type single-crystal silicon substrate (the second substrate) and being in the crystal orientation <110> or <100>. A wet or dry thermal oxidation process is performed to form the silicon oxide layer 253 on the second substrate 242. Alternatively, an n-type single-crystal silicon substrate may be used as the second substrate 242, instead of the p-type single-crystal silicon substrate.

Figure 16B:
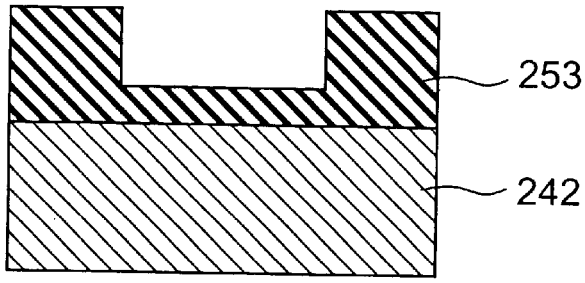
Figure 19B:
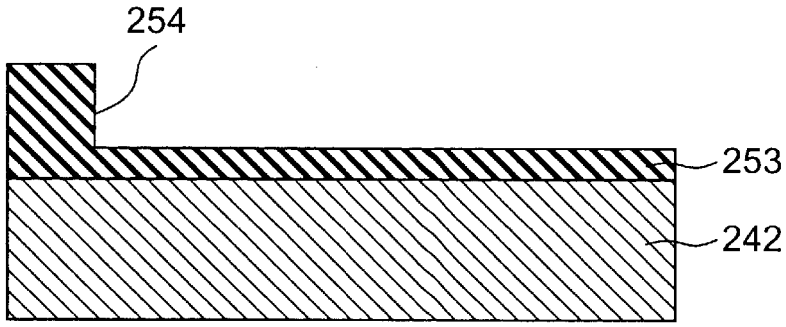

As shown in FIG. 16B and FIG. 19B, the recessed portion 254 for providing the electrode on the bottom of the recessed portion 254 is formed in the silicon oxide layer 253. In the present embodiment, the photo-resist is applied to the silicon oxide layer 253, a patterning of the photo-resist to form the electrode is performed, and the recessed portion 254 is formed by etching using a solution of hydrofluoric acid including ammonium fluoride as the buffer component (e.g., the product name: BHF-63U from Daikin Kogyo Co. Ltd.).

The depth of the etching in the present embodiment that includes the thickness of the electrode and the internal space needed to form the gap between the oscillation plate and the electrode is very small (about 1 $\mu$m), and variations of the depth of the etching will be negligible.

Figure 16C:
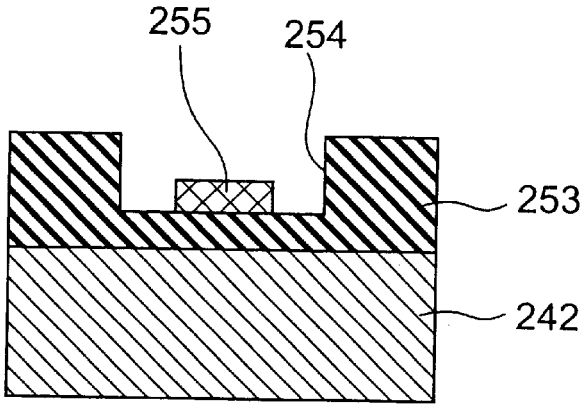
Figure 19C:
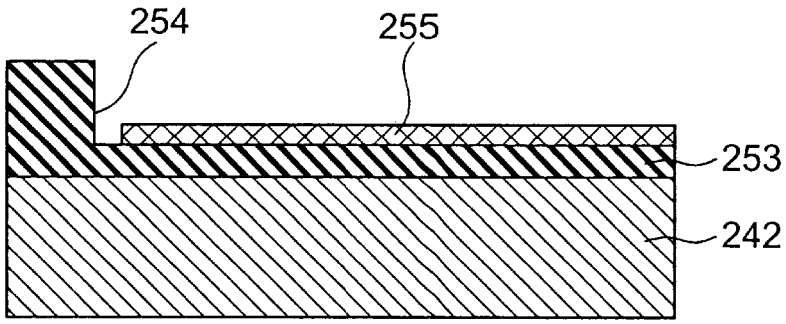

As shown in FIG. 16C and FIG. 19C, the electrode 255 is formed on the bottom of the recessed portion 254. In the present embodiment, a polysilicon film having a thickness about 300 nm is deposited on the entire surface of the silicon oxide layer 253, and the desired shape of the electrode is formed by performing a photo-etching process. In the present embodiment, the polysilicon film having the dopants on the surface thereof is used as the material of the electrode 255. Alternatively, a high-melting-point metal or a conductive ceramic, such as titanium nitride, may be used as the material of the electrode 255.

Figure 16D:
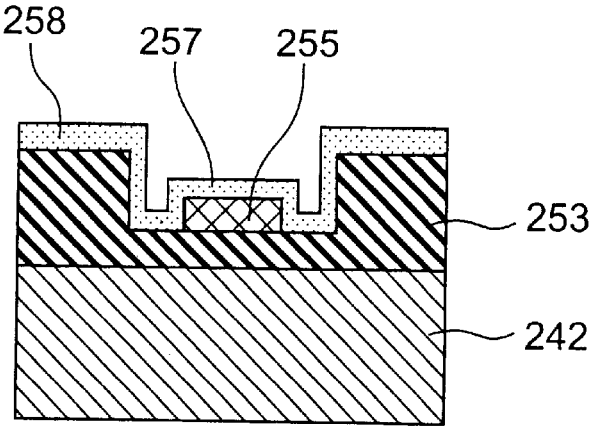
Figure 19D:
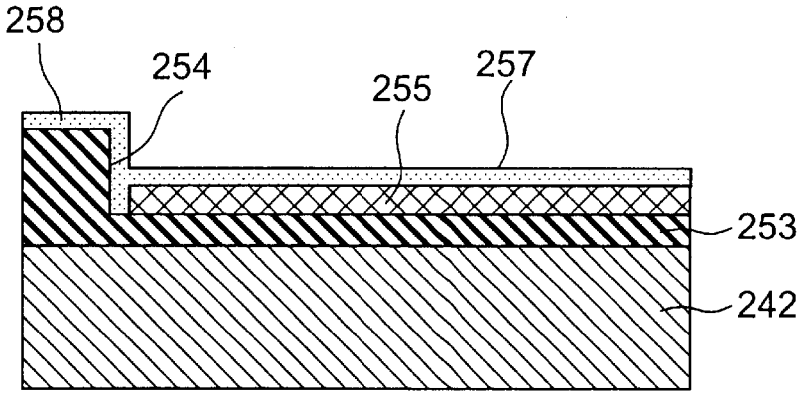

As shown in FIG. 16D and FIG. 19D, the silicon oxide layer 258 containing phosphorus and/or boron (the BPSG film), which has a thickness about 150 nm, is deposited on the entire surface of the silicon oxide layer 253 by performing a CVD process or the like. The silicon oxide layer 258 in the present embodiment serves as the electrode protecting film 257 that protects the electrode 255.

In the present embodiment, the silicon oxide layer 258 (the BPSG film) contains 4.5% phosphorus and 4.0% boron. However, the composition of the silicon oxide layer 258 is not limited to this embodiment. As described above, the silicon oxide layer 258 may have a two-layer structure including the BPSG film and one of the BSG film, the PSG film and the NSG film, instead of the BPSG film 258 of the above embodiment.

Alternatively, the silicon oxide layer 258 may have a three-layer structure including the NSG film, the BPSG film and the BSG film, or a three-layer structure including the NSG film, the BPSG film and the PSG film.

In the ink-jet head of the present embodiment, the silicon oxide layer 258 is provided to have a lowered melting point that allows the bonding of the first substrate 241 and the second substrate 242 at a temperature lower than 800 deg. C.

Figure 17A:
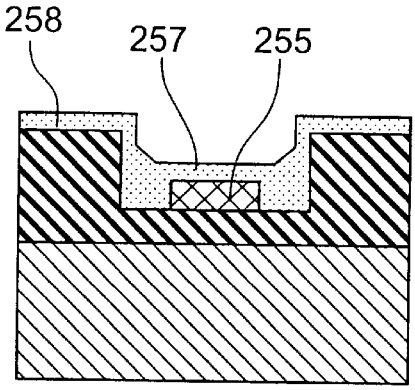
FIG. 17A, FIG. 17B and FIG. 17C are diagrams for explaining subsequent steps of the production method of the present embodiment.
Figure 20A:
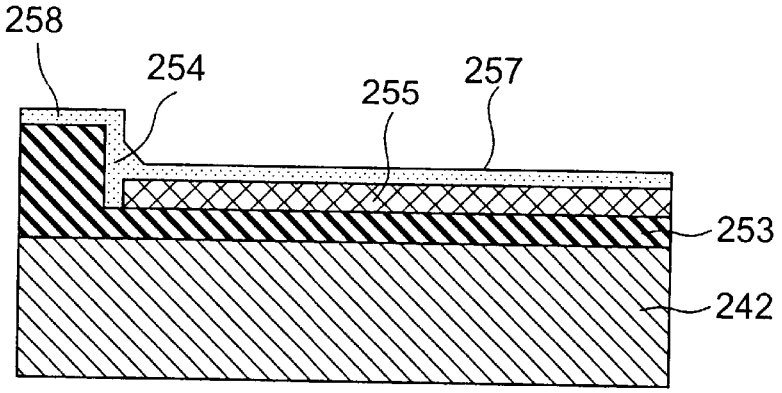
FIG. 20A, FIG. 20B and FIG. 20C are diagrams for explaining subsequent steps of the production method of the present embodiment.

As shown in FIG. 17A and FIG. 20A, the above silicon wafer (the electrode substrate 242) is subjected to heat treatment in a nitrogen gas atmosphere. Hence, the silicon oxide layer 258 is softened so that the circumferential portion between the side walls of the recessed portion 254 and the electrode 255 is adequately filled with the silicon oxide layer 258.

The temperature and time conditions of the above-described heat treatment are 850 deg. C. and 2 hours. The temperature (850 deg. C.) of the heat treatment is higher than the temperature at which the re-flow characteristic of the silicon oxide layer 258 occurs. During the heat treatment, the moisture or the hydrogen gas contained in the silicon oxide layer 258 is discharged, and the occurrence of the void will be prevented. The re-flow of the surface of the silicon oxide layer 258 occurs, and the surface roughness of the silicon oxide layer 258 is reduced from the Ra value in a range of 1 to 3 nm to the Ra value in a range of 0.1 to 0.2 nm. It is possible for the ink-jet head of the present embodiment to provide good adhesion between the first substrate 241 and the second substrate 242 via the silicon oxide layer 258.

Figure 17B:
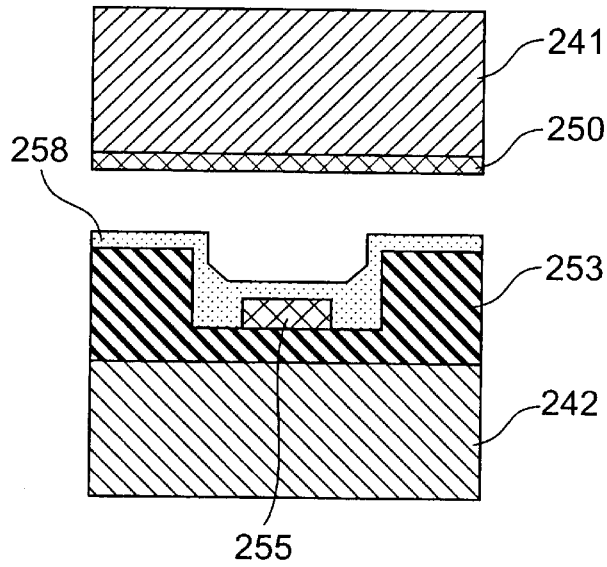
Figure 20B:
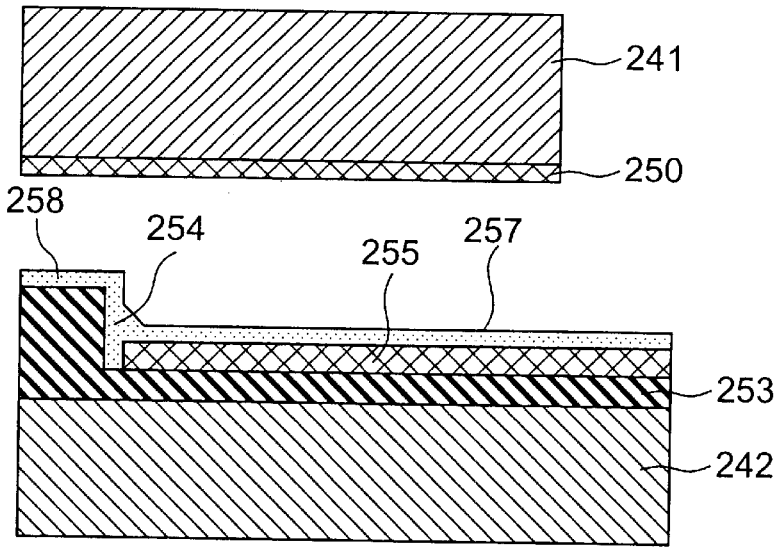

As shown in FIG. 17B and FIG. 20B, the source ink-passage substrate 241 that is a p-type single-crystal silicon substrate (the first substrate) and being in the crystal orientation <110> is used. The top and bottom surfaces of the source ink-passage substrate 241 are polished. On the bottom surface of the ink-passage substrate 241 where the first and second substrates 241 and 242 are bonded together, a boron diffusion layer 250 including a high concentration of boron ($5\times10^{19}$ atoms/cm$^3$ or above) is formed to provide the oscillation plate 250. The boron diffusion layer 250 is activated, and boron is diffused to the desired depth needed to form the oscillation plate 250.

In the present embodiment, the silicon substrate containing the boron diffusion layer 250 is used. Alternatively, a SOI (silicon-on-insulator) substrate in which a base silicon substrate and an activation layer substrate are bonded via a silicon dioxide layer, may be used, and the activation layer substrate may be configured into the oscillation plate 250.

Figure 17C:
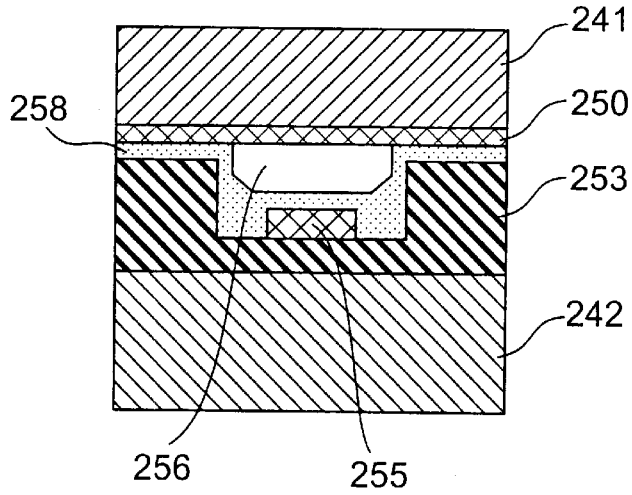
Figure 20C:
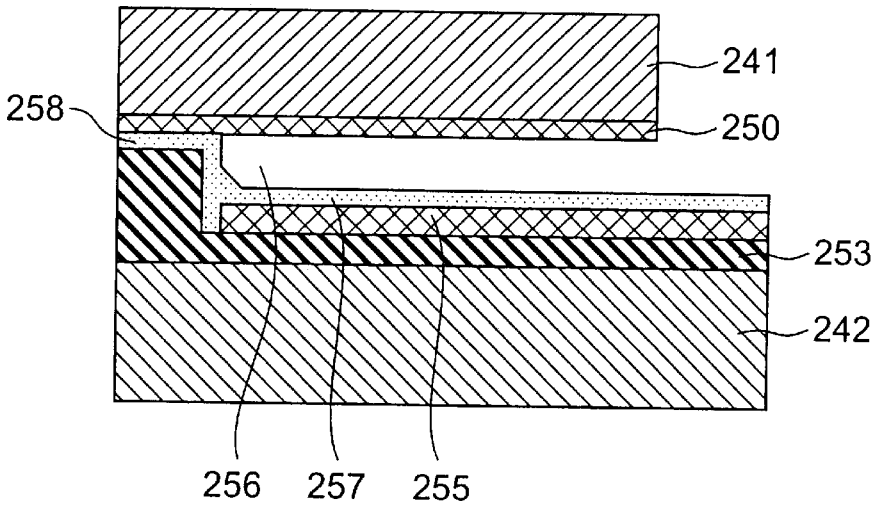

As shown in FIG. 17C and FIG. 20C, the first substrate 241 (which becomes the ink-passage substrate 241) and the second substrate 242 (which becomes the electrode substrate 242) are bonded via the silicon oxide layer 258. In the present embodiment, the first and second substrates 241 and 242 are subjected to RCA cleaning. After the RCA cleaning is performed, the first and second substrates 241 and 242 are immersed in a heated mixture of sulfuric acid and hydrogen peroxide, so that the bonding surfaces of the first and second substrates 241 and 242 are hydrophilic. After the immersion is performed, the alignment of the first and second substrates 241 and 242 is performed and the bonding of the first and second substrates 241 and 242 via the silicon oxide layer 258 is performed. In order to obtain good adhesion of the first and second substrates 241 and 242, they are heated in a nitrogen atmosphere at 800 deg. C. for 2 hours, so that the ink-passage substrate 241 is bonded to the electrode substrate 242 via the silicon oxide layer 258.

After the above process is performed, the silicon substrate 241 is subjected to polishing, chemical-mechanical polishing (CMP) or the like, so that the thickness of the substrate 241 is reduced. During the polishing, the bonding areas of the first and second substrates are not separated or broken. The initial thickness of the source silicon substrate 241 is about 400 $\mu$m, and after the polishing is done, the thickness of the silicon substrate 241 is reduced and the height of the discharging chamber is about 95±5 $\mu$m. In a case in which the initial thickness of the source silicon substrate 241 is used without change, the polishing process is unneeded.

Figure 18A:
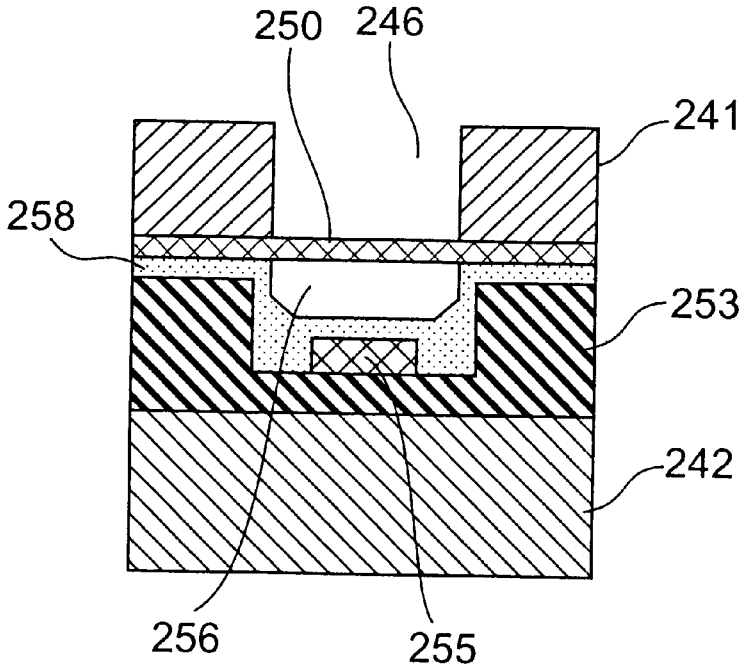
FIG. 18A and FIG. 18B are diagrams for explaining a production method for the ink-jet head of the present embodiment.
Figure 21A:
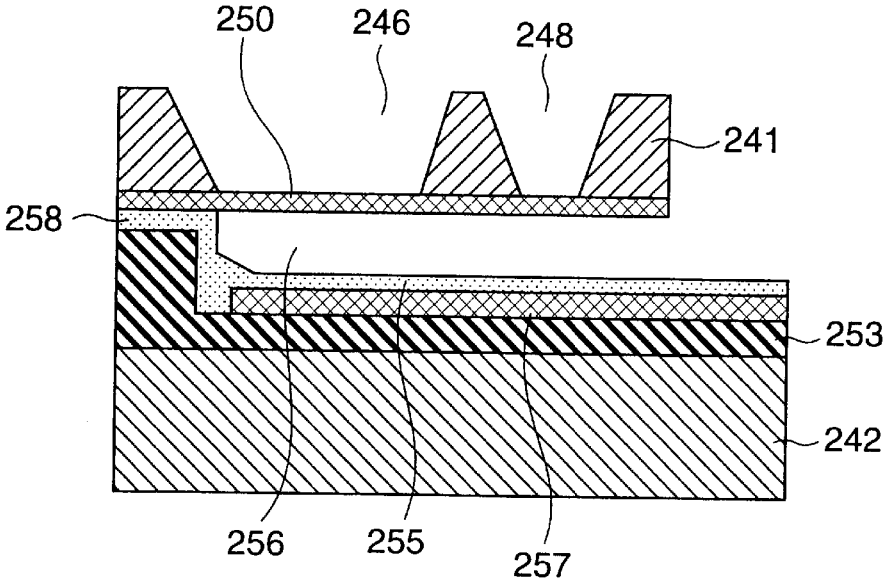
FIG. 21A and FIG. 21B are diagrams for explaining subsequent steps of the production method of the present embodiment.

As shown in FIG. 18A and FIG. 21A, the silicon substrate 241 is subjected to etching so that the recessed portion for providing the discharging chamber 246 and the oscillation plate 250 is formed in the silicon substrate 241.

In the present embodiment, the silicon substrate 241 is thermally treated, and the buffer silicon oxide film having a thickness about 50 nm is formed through the CVD process. In addition, the silicon nitride film (which becomes the etching barrier layer in the subsequent process) having a thickness about 100 nm is formed. By performing the photo-etching process, a pattern of the discharging chamber is produced. The photo-resist film is used as the mask, and the silicon nitride film and the silicon oxide film are etched so that the pattern of the discharging chamber is formed on the silicon substrate 241.

The silicon substrate 241 is immersed in a 30% KOH (potassium hydroxide) solution at a temperature 80 deg. C., and the silicon substrate 241 is subjected to anisotropic etching, so that the recessed portion for providing the discharging chamber 246 and the common ink chamber 248 is formed in the silicon substrate 241. When the etchant reaches the high-concentration boron diffusion layer 250, the rate of the etching is extremely reduced and the etching is stopped. Hence, the oscillation plate 250 including the boron diffusion layer is formed in the silicon substrate 241.

Instead of the KOH solution, the wet etching using the TMAH (tetra methyle ammonium hydroxide) solution may be performed. In such a case, after the wet etching is performed, the silicon substrate 241 is rinsed with pure water for ten minutes. After the rinsing is performed, the silicon substrate 241 is subjected to spin drying.

Figure 18B:
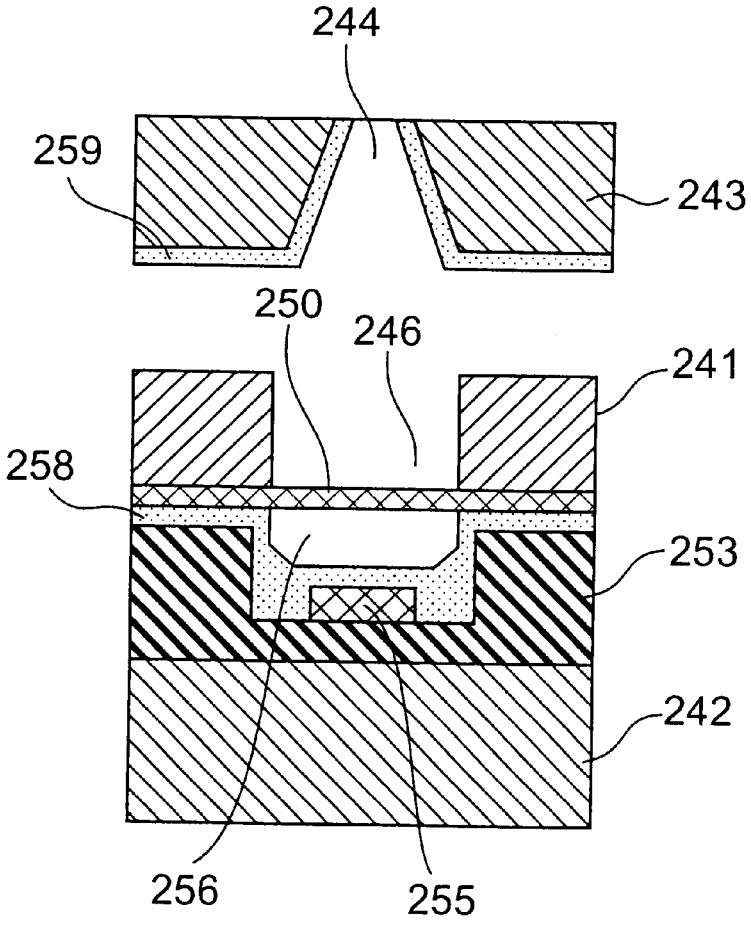
Figure 21B:
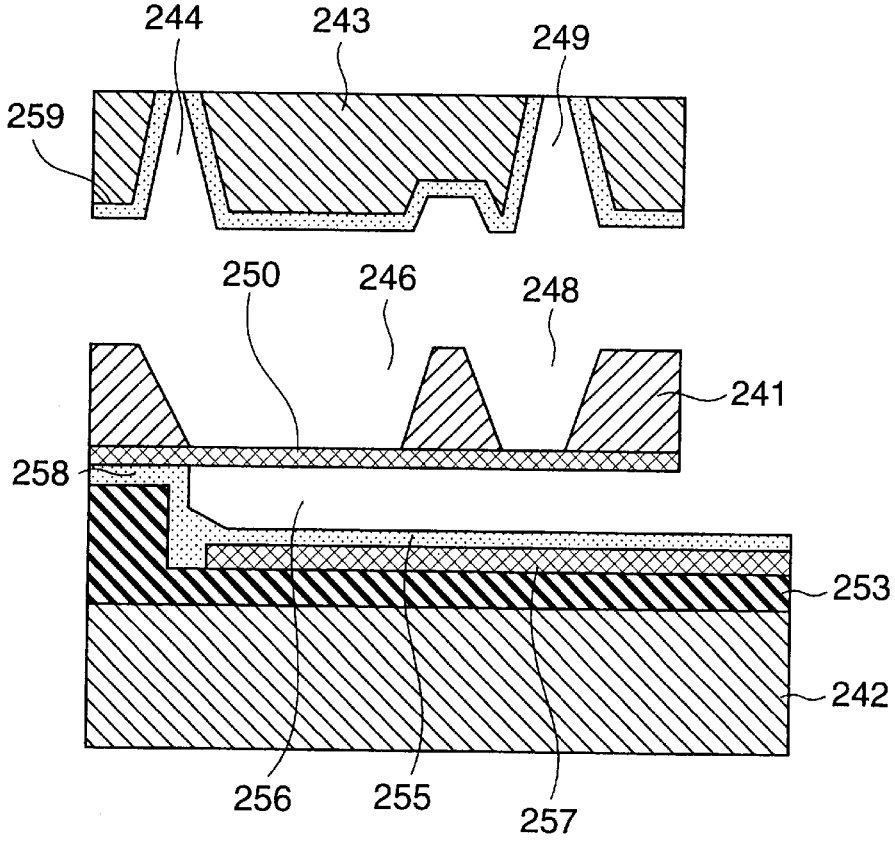

As shown in FIG. 18B and FIG. 21B, the BPSG film 259 (or the silicon oxide layer) is deposited on the nozzle plate 243 of a silicon substrate through the CVD process in the same manner as the BPSG film 258 on the electrode substrate 242.

Similar to the electrode substrate 242, the nozzle plate 243 in which the BPSG film 259 is formed is heated in a nitrogen atmosphere at 850 deg. C. for 2 hours, so that the nozzle plate 243 is bonded to the electrode substrate 242 via the silicon oxide layer 259.

The temperature and time conditions of the above-described heat treatment are 850 deg. C. and 2 hours. The temperature (850 deg. C.) of the heat treatment is higher than the temperature at which the re-flow characteristic of the silicon oxide layer 259 occurs. During the heat treatment, the moisture or the hydrogen gas contained in the silicon oxide layer 259 is discharged, and the occurrence of the void will be prevented. The re-flow of the surface of the silicon oxide layer 259 occurs, and the surface roughness of the silicon oxide layer 259 is reduced from the initial Ra value in a range of 1 to 3 nm to the Ra value in a range of 0.1 to 0.2 nm. It is possible for the ink-jet head of the present embodiment to provide good adhesion between the nozzle plate 243 and the first substrate 241 via the silicon oxide layer 259.

Figure 22:
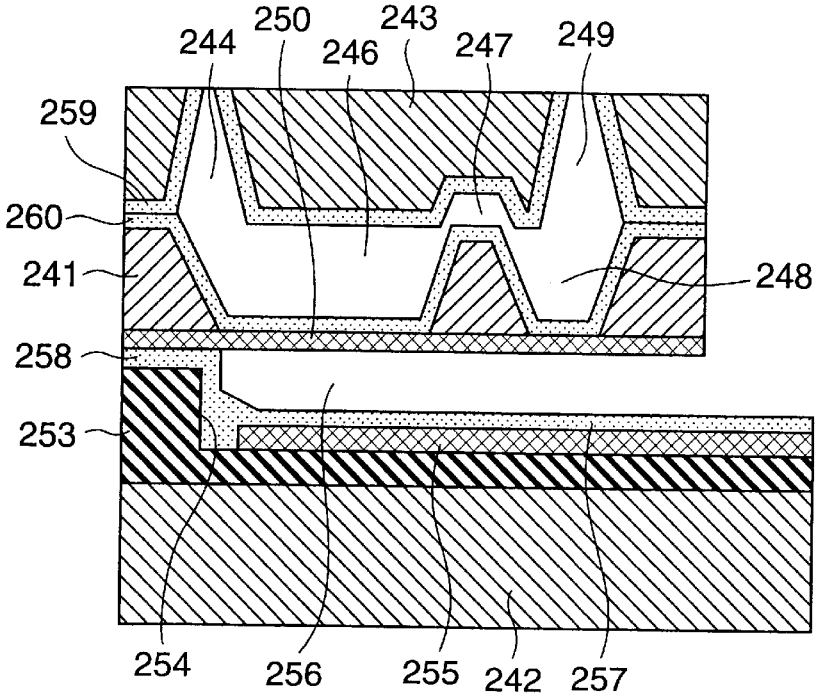
FIG. 22 is a longitudinal cross-sectional view of another preferred embodiment of the ink-jet head of the invention along a longitudinal line of an oscillation plate thereof.
Figure 23:
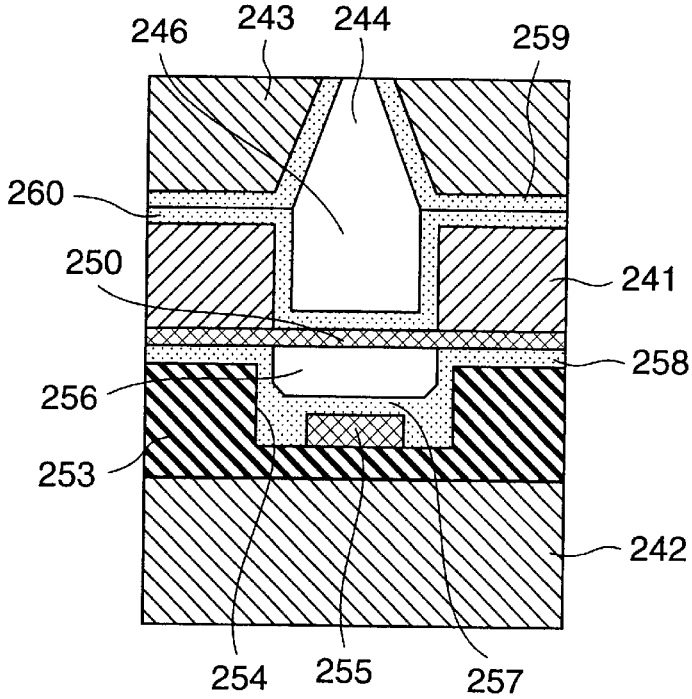
FIG. 23 is a transverse cross-sectional view of the ink-jet head of the present embodiment along a transverse line of the oscillation plate.

Next, FIG. 22 is a longitudinal cross-sectional view of another preferred embodiment of the ink-jet head of the invention along a longitudinal line of an oscillation plate thereof. FIG. 23 is a transverse cross-sectional view of the ink-jet head of the present embodiment along a transverse line of the oscillation plate.

As shown, the ink-jet head of this embodiment is essentially the same as the ink-jet head of the previous embodiment shown in FIG. 13, except that the ink-passage substrate 241 of this embodiment includes the silicon oxide layer 260, which contains phosphorus and/or boron (the BPSG film), on the entire surface of the silicon substrate 241. The configuration and production method of silicon oxide layer 260 are similar to those of the silicon oxide layer 258 that is described earlier with respect to the previous embodiment of FIG. 13. In the present embodiment, the nozzle plate 243 is bonded to the ink-passage substrate 241 via the silicon oxide layers 259 and 260.

Alternatively, the silicon oxide layer 260 may have a two-layer structure including the BPSG film and one of the BSG film, the PSG film and the NSG film, instead of the BPSG film 260 of the above embodiment. Alternatively, the silicon oxide layer 260 may have a three-layer structure including the NSG film, the BPSG film and the BSG film, or a three-layer structure including the NSG film, the BPSG film and the PSG film.

In the ink-jet head of the present embodiment, the ink-passage substrate 241 obtained after the production process is performed is covered with the silicon oxide layer 260 (the BPSG film). Hence, the flaws on the ink passages of the ink-passage substrate 241 can be reduced, and the flowability of the ink within the ink-jet head can be stabilized.

Figure 24:
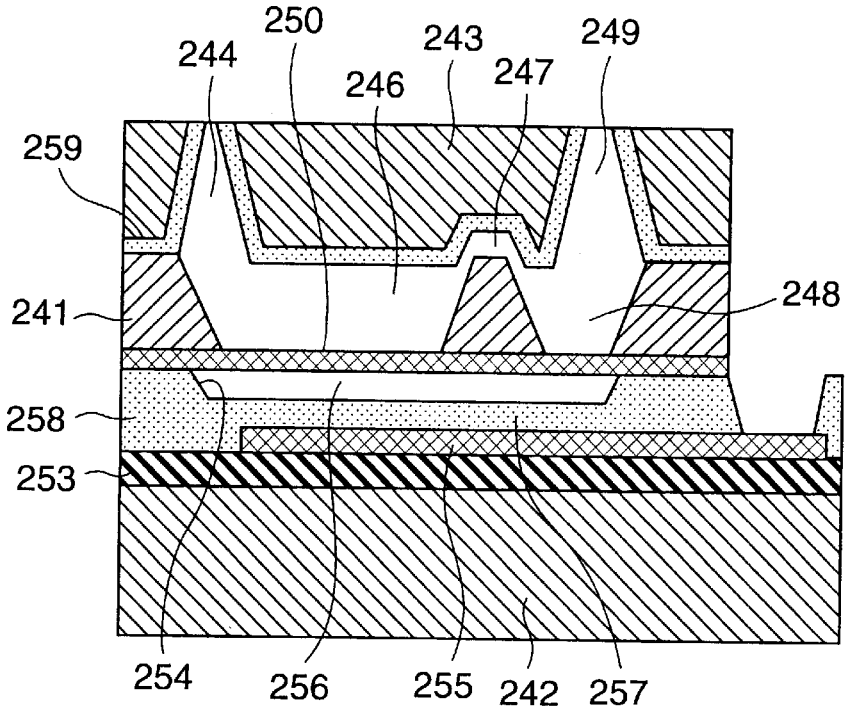
FIG. 24 is a longitudinal cross-sectional view of another preferred embodiment of the ink-jet head of the invention along a longitudinal line of an oscillation plate thereof.
Figure 25:
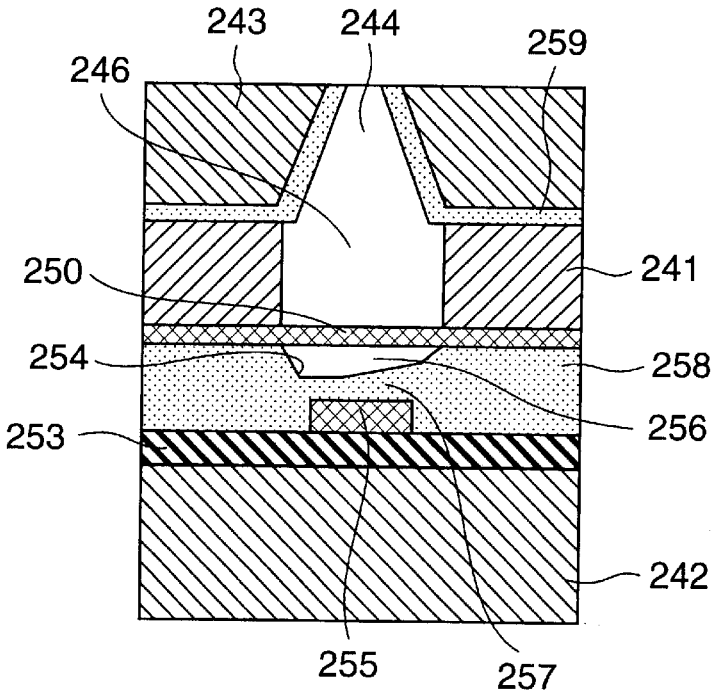
FIG. 25 is a transverse cross-sectional view of the ink-jet head of the present embodiment along a transverse line of the oscillation plate.

Next, FIG. 24 is a longitudinal cross-sectional view of another preferred embodiment of the ink-jet head of the invention along a longitudinal line of an oscillation plate thereof. FIG. 25 is a transverse cross-sectional view of the ink-jet head of the present embodiment along a transverse line of the oscillation plate.

As shown, the ink-jet head of this embodiment is essentially the same as the ink-jet head of the previous embodiment shown in FIG. 13, except that the electrode substrate 242 of this embodiment differs from that of the previous embodiment of FIG. 13.

In the ink-jet head of the present embodiment, the silicon oxide layer 253 is formed on the electrode substrate 242, and the electrode 255, facing the oscillation plate 250 via the gap 256, is formed on the silicon oxide layer 253. The silicon oxide layer 258 containing phosphorus and/or boron (the BPSG film) is deposited on both the silicon oxide layer 253 and the electrode 255. The recessed portion 254 for providing the gap 256 between the oscillation plate 250 and the electrode 255 is formed in the silicon oxide layer 258. The recessed portion 254 in this embodiment is configured such that the oscillation plate 250 and the electrode 255 are opposed to each other in a non-parallel position in the transverse cross-section thereof. As shown in FIG. 25, the gap 256 in this embodiment is formed into the non-parallel type gap.

Next, a description will be given of a production method of the ink-jet head shown in FIG. 24 and FIG. 25 with reference to FIG. 26A through FIG. 29B.

FIG. 26A through FIG. 26D and FIG. 27A and FIG. 27B are transverse cross-sectional views of the ink-jet head of FIG. 24 and FIG. 25 along a transverse line of the oscillation plate thereof for explaining the production method of the present embodiment. FIG. 28A through FIG. 28D and FIG. 29A and FIG. 29B are longitudinal views of the ink-jet head along a longitudinal line of the oscillation plate for explaining the production method of the present embodiment. In FIG. 26A through FIG. 29B, the elements that are essentially the same as corresponding elements in FIG. 24 and FIG. 25 are designated by the same reference numerals.

Figure 26A:
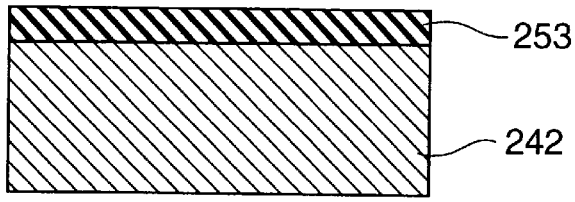
FIG. 26A, FIG. 26B, FIG. 26C and FIG. 26D are diagrams for explaining another embodiment of the production method of the ink-jet head according to the invention.
Figure 28A:
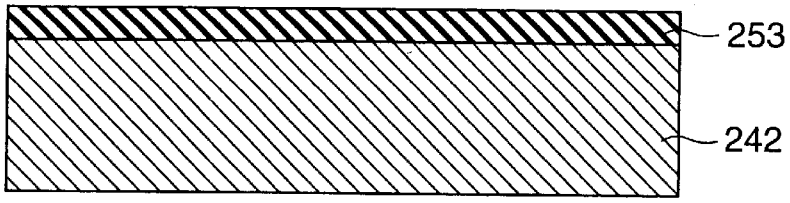
FIG. 28A, FIG. 28B, FIG. 28C and FIG. 28D are diagrams for explaining subsequent steps of the production method of the present embodiment.

As shown in FIG. 26A and FIG. 28A, the silicon oxide layer 253 having a thickness about 2.5 μm is formed on a surface of the source electrode substrate 242 that is a p-type single-crystal silicon substrate (the second substrate) and being in the crystal orientation <110> or <100>. A wet or dry thermal oxidation process is performed to form the silicon oxide layer 253 on the second substrate 242. Alternatively, an n-type single-crystal silicon substrate may be used as the second substrate 242, instead of the p-type single-crystal silicon substrate.

Figure 26B:
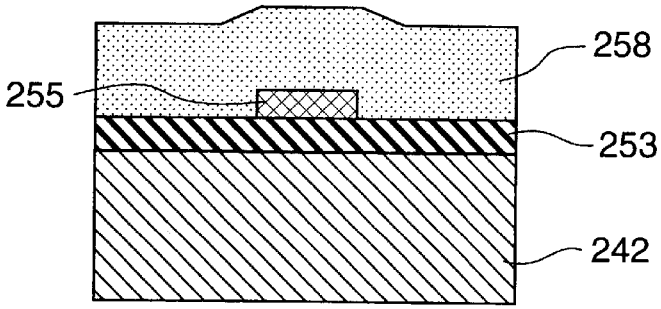
Figure 28B:
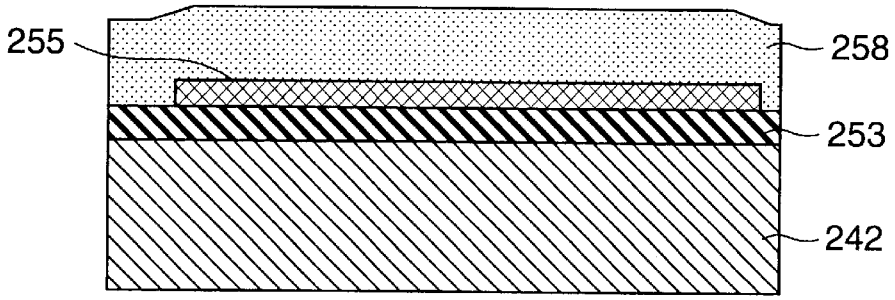

As shown in FIG. 26B and FIG. 28B, the electrode 255 is formed on the silicon oxide layer 253. In the present embodiment, the film of titanium nitride is deposited on the entire surface of the silicon oxide layer 253 by the sputtering process, and the silicon oxide film as the mask is deposited thereon by the CVD process. A pattern of the electrode is produced by using the photo-etching process, and, by using the photo-resist film as the mask, the silicon oxide film is etched by a hydrofluoric acid. Further, by using the photo-resist film and the silicon oxide film as the mask, the titanium nitride film is etched by a mixed solution of ammonia, hydrogen peroxide and pure water, so that the desired shape of the electrode 255 is formed.

Further, the silicon oxide layer 258 containing phosphorus and boron (the BPSG film) is formed on the entire surface of the silicon oxide layer 253 on which the electrode 255 is formed by the CVD process. The thickness of the silicon oxide layer 258 is about 400 nm. In the present embodiment, the silicon oxide layer 258 (the BPSG film) contains 4.5% phosphorus and 4.0% boron. However, the composition of the silicon oxide layer 258 is not limited to this embodiment. The silicon oxide layer 258 may have a two-layer structure including the BPSG film and one of the BSG film, the PSG film and the NSG film, instead of the BPSG film 258 of the above embodiment.

Figure 26C:
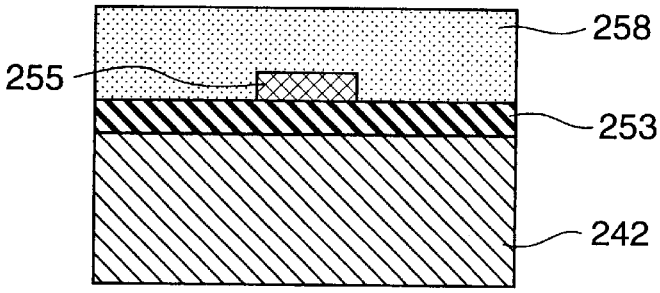
Figure 28C:
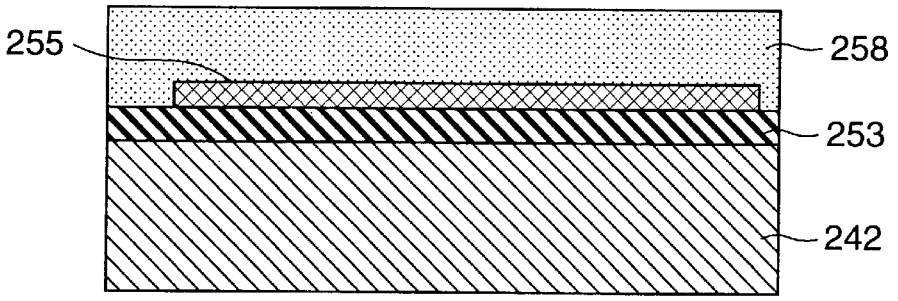

As shown in FIG. 26C and FIG. 28C, the surface of the BPSG film 258 is flattened by polishing or the like. In the present embodiment, the surface of the BPSG film 258 is polished through the CMP process. According to the current CMP process, with the polishing amount 0.01 μm, the surface roughness of the silicon oxide layer is reduced to 0.008 μm after finishing. It is possible to provide good flatness of the surface of the silicon oxide layer. The Ra value of the surface roughness of the silicon oxide layer 258 is in a range of 0.1 to 0.2 nm. It is possible to provide good adhesion of the bonding of the first substrate 241 and the second substrate 242.

After the above polishing is performed, the silicon wafer (the electrode substrate 242) is heated in a nitrogen gas atmosphere at 850 deg. C. for two hours. The temperature (850 deg. C.) of the heat treatment is higher than the temperature at which the re-flow characteristic of the silicon oxide layer 258 occurs. During the heat treatment, the moisture or the hydrogen gas contained in the silicon oxide layer 258 is discharged, and the occurrence of the void will be prevented.

Another flattening method is to thermally treat the silicon wafer (the electrode substrate 242) in a nitrogen gas atmosphere at 1000 deg. C. for two hours. During the heat treatment, the moisture or the hydrogen gas contained in the silicon oxide layer 258 is discharged, and the occurrence of the void will be prevented. The flowability of the BPSG film 258 is increased, and the convex portion of the silicon oxide layer 258 due to the electrode 255 is flattened. The re-flow of the surface of the silicon oxide layer 258 occurs, and the surface roughness of the silicon oxide layer 258 is reduced from the Ra value in a range of 1 to 3 nm to the Ra value in a range of 0.1 to 0.2 nm. It is possible for the ink-jet head of the present embodiment to provide good adhesion between the first substrate 241 and the second substrate 242 via the silicon oxide layer 258.

Figure 26D:
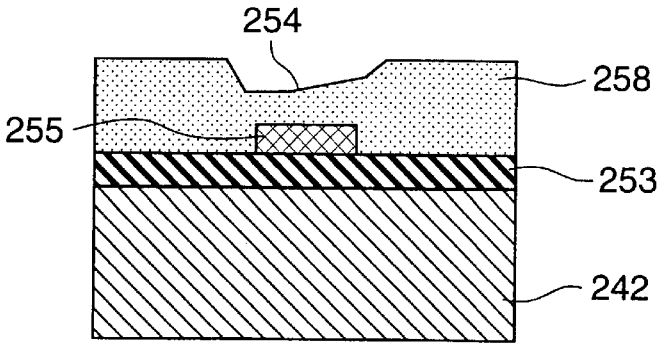
Figure 28D:
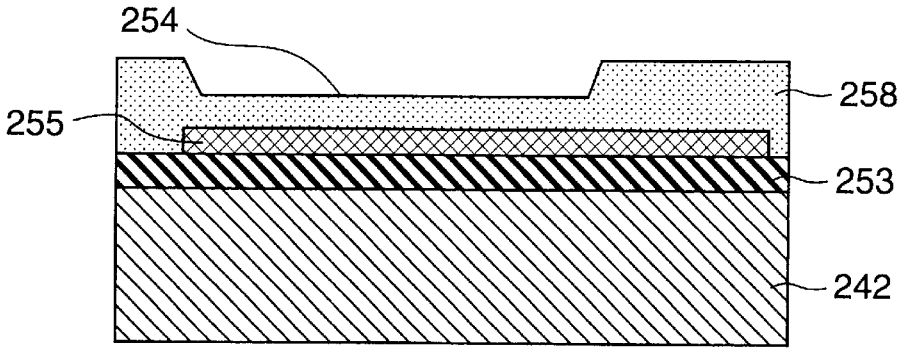

As shown in FIG. 26D and FIG. 28D, the recessed portion 254 for providing the electrode on the bottom of the recessed portion 254 is formed in the silicon oxide layer 258 after the flattening process is performed. In the present embodiment, the photo-resist is applied to the silicon oxide layer 258, a patterning of the photo-resist to form the gap 256 is performed, and the recessed portion 254 is formed by etching using a solution of hydrofluoric acid including ammonium fluoride as the buffer component (e.g., the product name: BHF-63U from Daikin Kogyo Co. Ltd.).

The depth of the etching in the present embodiment needed to form the gap 256 between the oscillation plate and the electrode is very small (about 1 $\mu$m), and variations of the depth of the etching will be negligible. In the present embodiment, the thickness of the resist pattern is inclined, and the non-parallel gap 256 is formed.

Figure 27A:
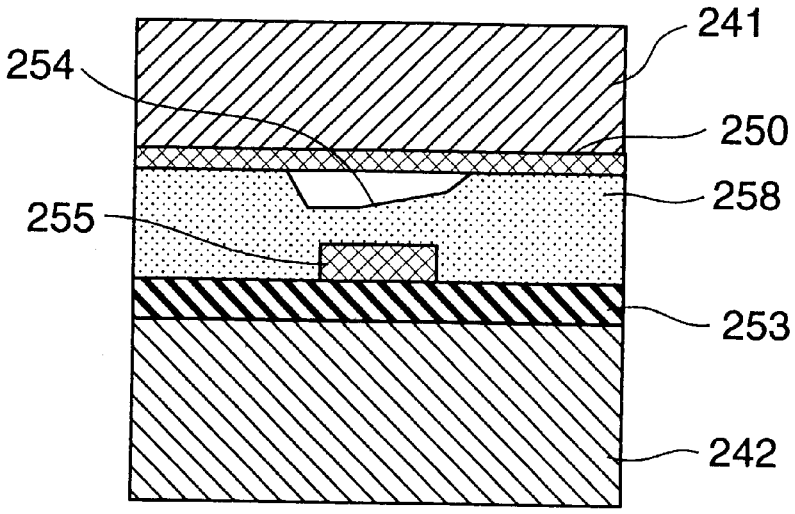
FIG. 27A and FIG. 27B are diagrams for explaining subsequent steps of the production method of the present embodiment.
Figure 27B:
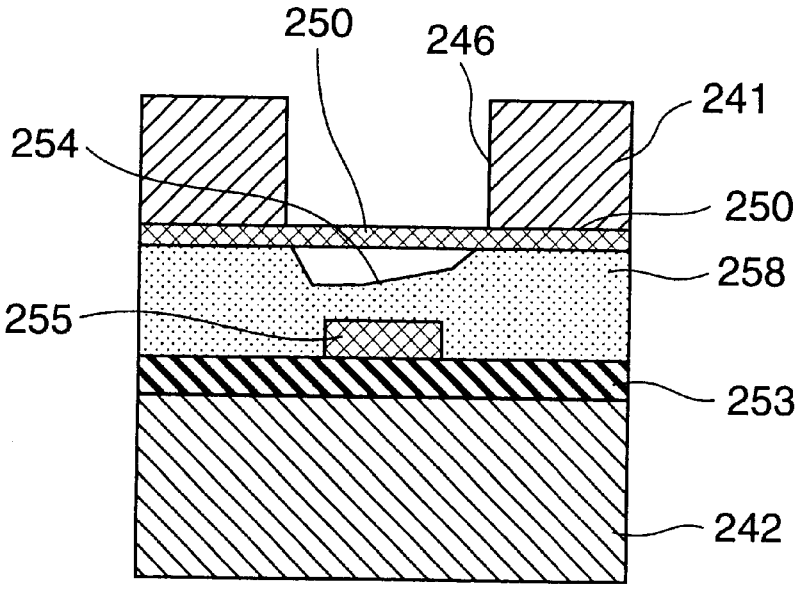
Figure 29A:
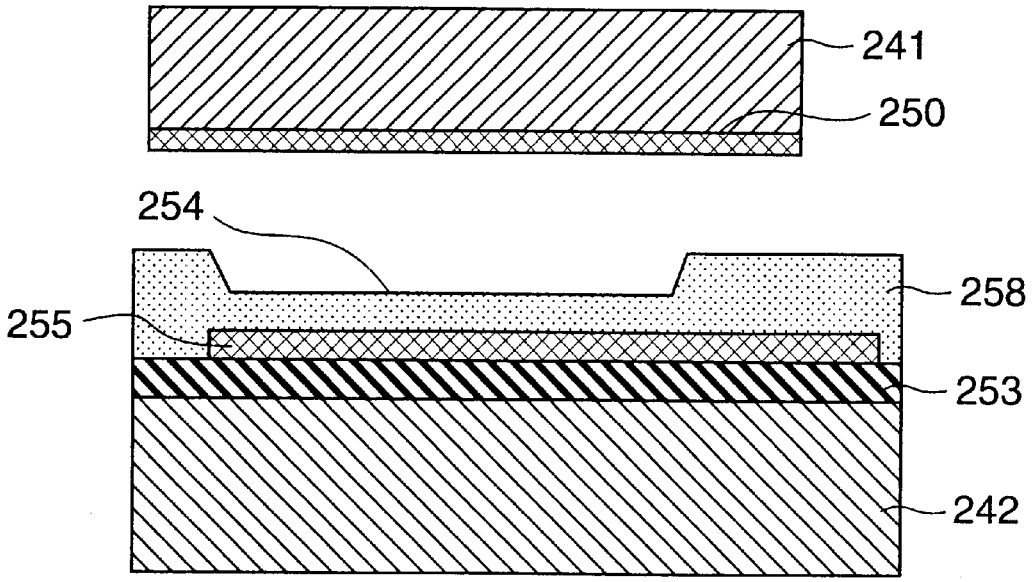
FIG. 29A and FIG. 29B are diagrams for explaining subsequent steps of the production method of the present embodiment.
Figure 29B:
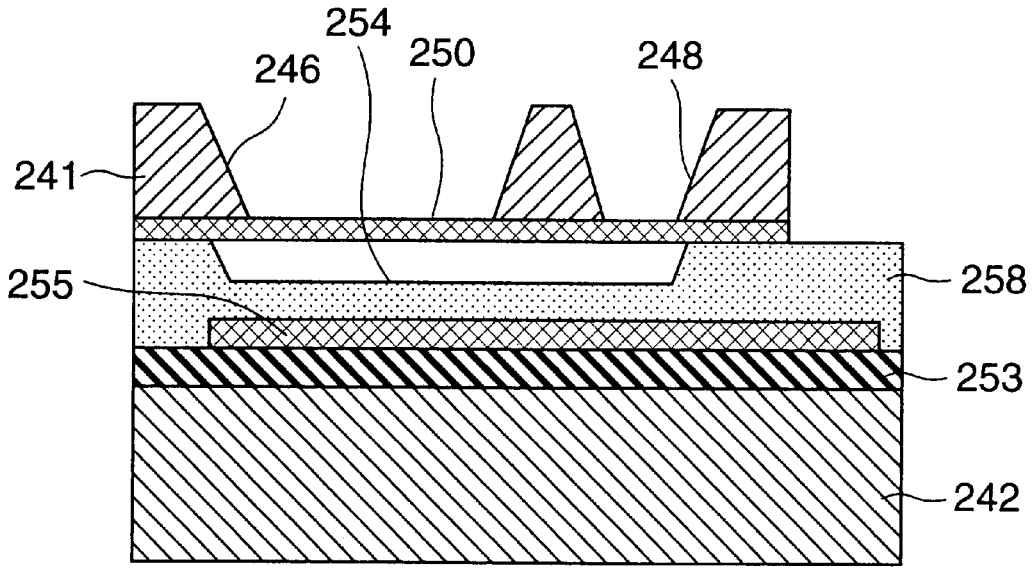

As shown in FIG. 27A and FIG. 29A, the silicon substrate 241 (the ink-passage substrate) is bonded to the silicon substrate 242 (the electrode substrate) via the silicon oxide layer 258 containing phosphorus and/or boron (the BPSG film). As shown in FIG. 27B and FIG. 29B, through the anisotropic etching, the discharging chamber 246, the oscillation plate 250 and the common ink chamber 248 are formed in the ink-passage substrate 241. Further, the nozzle plate 243 is bonded to the ink-passage substrate 241 via the silicon oxide layer 259 containing phosphorus and/or boron (the BPSG film). These processes of the production method of the ink-jet head of the present embodiment are the same as those corresponding processes of the previous embodiment in FIG. 13.

Figure 30:
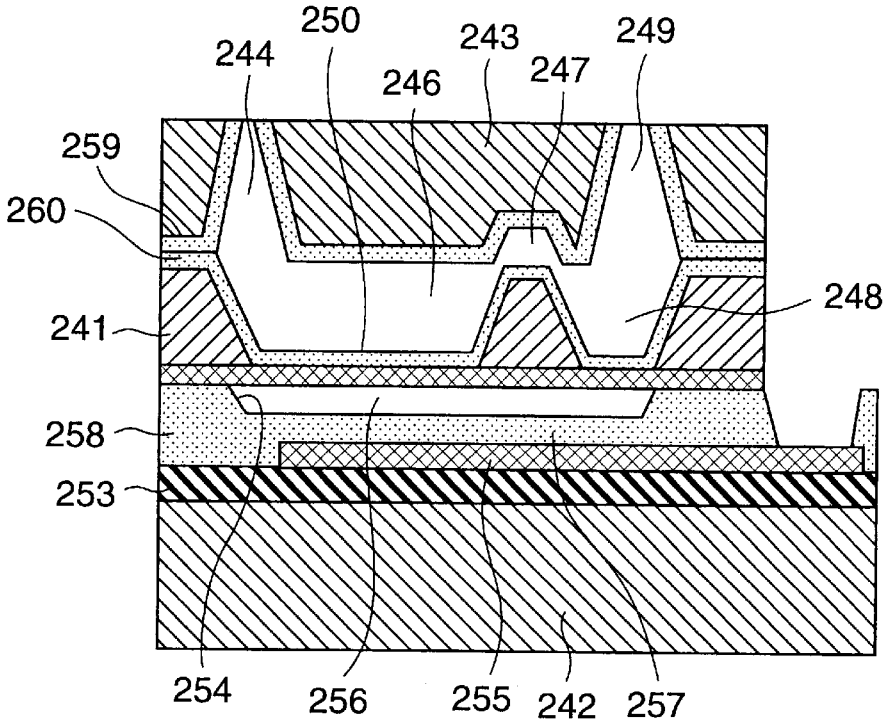
FIG. 30 is a longitudinal cross-sectional view of another preferred embodiment of the ink-jet head of the invention along a longitudinal line of an oscillation plate thereof.
Figure 31:
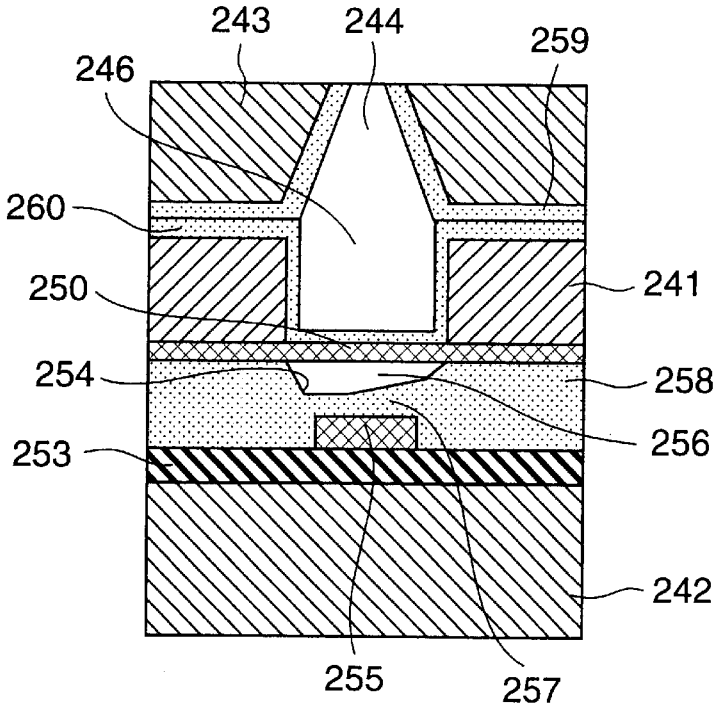
FIG. 31 is a transverse cross-sectional view of the ink-jet head of the present embodiment along a transverse line of the oscillation plate.

Next, FIG. 30 is a longitudinal cross-sectional view of another preferred embodiment of the ink-jet head of the invention along a longitudinal line of an oscillation plate thereof. FIG. 31 is a transverse cross-sectional view of the ink-jet head of the present embodiment along a transverse line of the oscillation plate.

The ink-jet head of this embodiment is essentially the same as the ink-jet head shown in FIG. 24, except for the ink-passage substrate 241. In FIG. 30 and FIG. 31, the other elements that are the same as corresponding elements in FIG. 24 are designated by the same reference numerals, and a description thereof will be omitted.

As shown in FIG. 30 and FIG. 31, the ink-passage substrate 241 of this embodiment includes the silicon oxide layer 260, which contains phosphorus and/or boron (the BPSG film), on the entire surface of the silicon substrate 241. The configuration and production method of silicon oxide layer 260 are similar to those of the silicon oxide layer 258 that is described earlier with respect to the previous embodiment of FIG. 24. In the present embodiment, the nozzle plate 243 is bonded to the ink-passage substrate 241 via the silicon oxide layers 259 and 260.

Alternatively, the silicon oxide layer 260 may have a two-layer structure including the BPSG film and one of the BSG film, the PSG film and the NSG film, instead of the BPSG film 260 of the above embodiment. Alternatively, the silicon oxide layer 260 may have a three-layer structure including the NSG film, the BPSG film and the BSG film, or a three-layer structure including the NSG film, the BPSG film and the PSG film.

Figure 32:
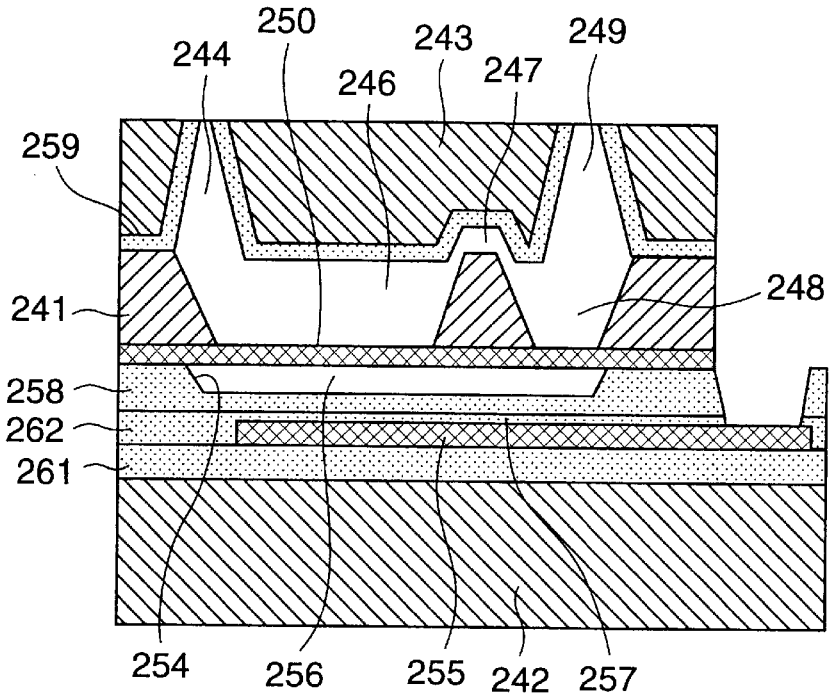
FIG. 32 is a longitudinal cross-sectional view of another preferred embodiment of the ink-jet head of the invention along a longitudinal line of an oscillation plate thereof.
Figure 33:
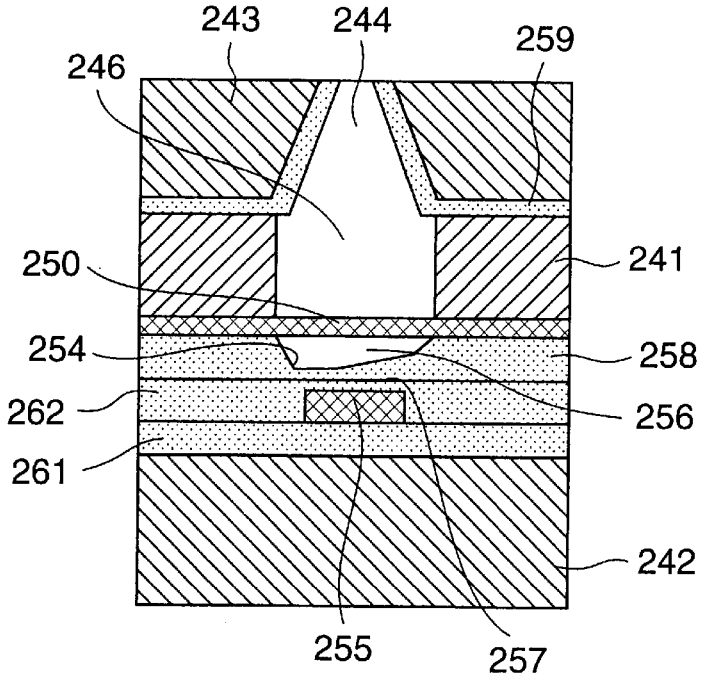
FIG. 33 is a transverse cross-sectional view of the ink-jet head of the present embodiment along a transverse line of the oscillation plate.

Next, FIG. 32 is a longitudinal cross-sectional view of another preferred embodiment of the ink-jet head of the invention along a longitudinal line of an oscillation plate thereof. FIG. 33 is a transverse cross-sectional view of the ink-jet head of the present embodiment along a transverse line of the oscillation plate.

The ink-jet head of this embodiment is essentially the same as the ink-jet head shown in FIG. 24, except for the electrode substrate 242. In FIG. 32 and FIG. 33, the other elements that are the same as corresponding elements in FIG. 24 are designated by the same reference numerals, and a description thereof will be omitted.

As shown in FIG. 32 and FIG. 33, the electrode substrate 242 of this embodiment includes the silicon oxide layer 261, which contains neither phosphorus nor boron (the NSG film), on the entire surface of the silicon substrate 242. The electrode 255, which faces the oscillation plate 250 via the gap 256, is formed on the silicon oxide layer 261. In addition, the silicon oxide layer 262, which contains neither phosphorus nor boron (the NSG film), is formed on the entire surface of the silicon oxide layer 261 and the electrode 255. Further, the silicon oxide layer 258 containing phosphorus and/or boron (the BPSG film) is deposited on the silicon oxide layer 262. In the silicon oxide layer 258, the recessed portion 254 for providing the gap 256 between the oscillation plate 250 and the electrode 255 is formed. In the present embodiment, the nozzle plate 243 is bonded to the ink-passage substrate 241 via the silicon oxide layers 259 and 260. The gap 256 of this embodiment is formed into the non-parallel type gap.

Next, a description will be given of a production method of the ink-et head of the embodiment shown in FIG. 32 with reference to FIG. 34A through FIG. 35E.

Figure 34A:
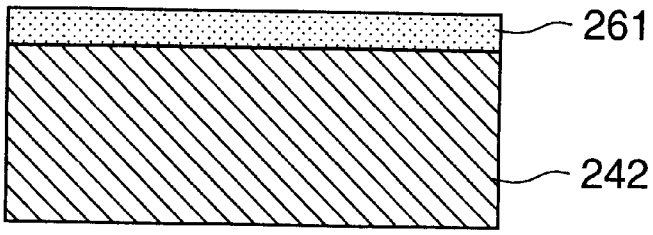
FIG. 34A, FIG. 34B and FIG. 34C are diagrams for explaining another embodiment of the production method of the ink-jet head according to the invention.
Figure 34B:
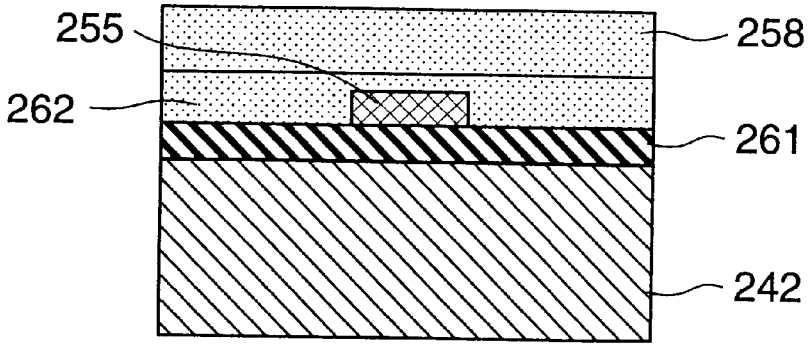
Figure 34C:
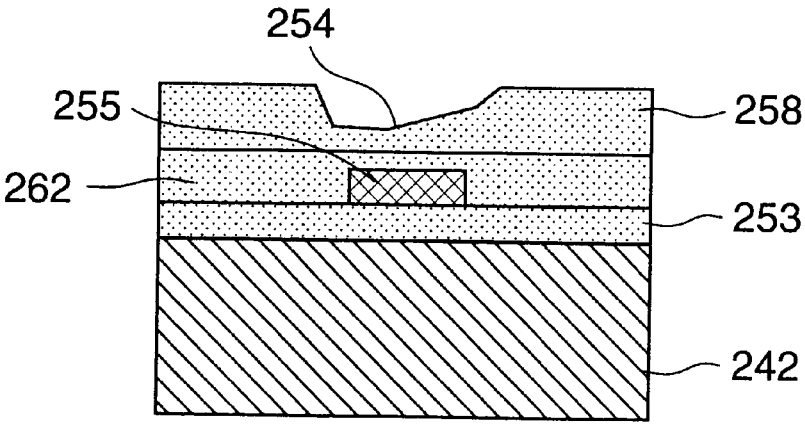
Figure 35A:
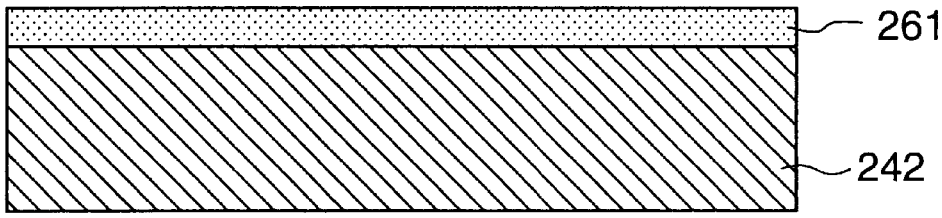
FIG. 35A, FIG. 35B and FIG. 35C are diagrams for explaining subsequent steps of the production method of the present embodiment.
Figure 35B:
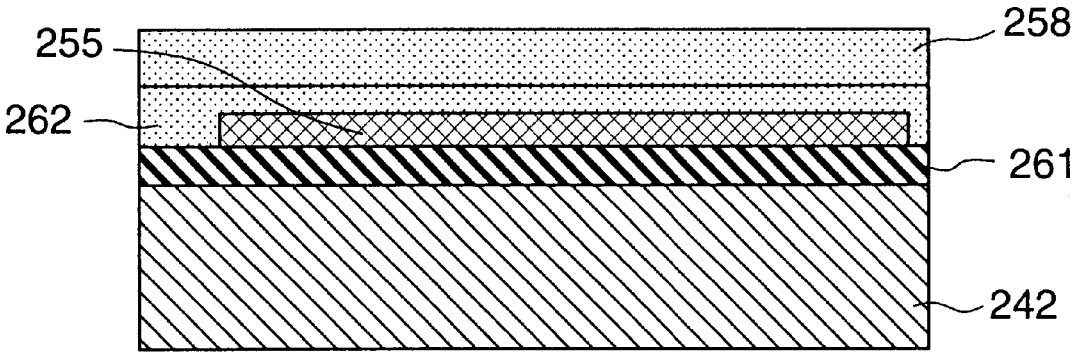
Figure 35C:
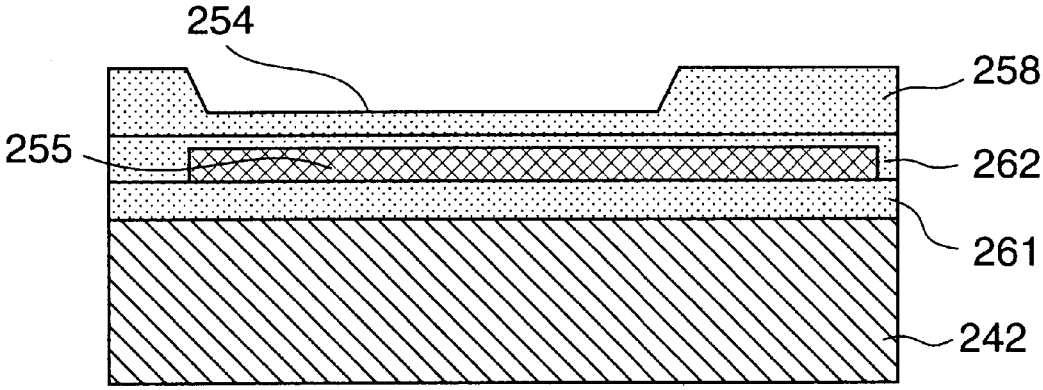

FIG. 34A, FIG. 34B and FIG. 34C are transverse cross-sectional views of the ink-jet head of FIG. 32 and FIG. 33 for explaining the production method of the present embodiment. FIG. 35A, FIG. 35B and FIG. 35C are longitudinal cross-sectional views of the ink-jet head for explaining the production method of the present embodiment.

As shown in FIG. 34A and FIG. 35A, the non-doped silicate glass (NSG) film 261 is formed on the surface of the source electrode substrate 242 that is a p-type single-crystal silicon substrate (the second substrate) and being in the crystal orientation <110> or <100>. The CVD process is performed to form the NSG film 261 on the silicon substrate 242. Alternatively, an n-type single-crystal silicon substrate may be used as the second substrate 242, instead of the p-type single-crystal silicon substrate. In addition, the SOG (spin on glass) film may be formed on the silicon substrate 242 by using a spin coater. In such a case, after the silicon oxide film is formed, the silicon substrate may be thermally treated.

As shown in FIG. 34B and FIG. 35B, the electrode 255 is formed on the silicon oxide layer 261 (the NSG film). In the present embodiment, the film of titanium nitride is deposited on the entire surface of the silicon oxide layer 261 by the sputtering process, and the silicon oxide film as the mask is deposited thereon by the CVD process. A pattern of the electrode is produced by using the photo-etching process, and, by using the photo-resist film as the mask, the silicon oxide film is etched by a hydrofluoric acid. Further, by using the photo-resist film and the silicon oxide film as the mask, the titanium nitride film is etched by a mixed solution of ammonia, hydrogen peroxide and pure water, so that the desired shape of the electrode 255 is formed.

After the electrode 255 is formed, the silicon oxide layer 262 containing neither phosphorus nor boron (the NSG film) is formed on the entire surface of the silicon oxide layer 261 and the electrode 255. The thickness of the silicon oxide layer 262 must be adequately large to cover the height of the electrode 255. Further, the silicon oxide layer 258 containing phosphorus and boron (the BPSG film) is formed on the entire surface of the silicon oxide layer 262. The thickness of the silicon oxide layer 258 is about 150 nm. In the present embodiment, the silicon oxide layer 258 (the BPSG film) contains 4.5% phosphorus and 4.0% boron. However, the composition of the silicon oxide layer 258 is not limited to this embodiment. The silicon oxide layer 258 may have a two-layer structure including the BPSG film and one of the BSG film, the PSG film and the NSG film, instead of the BPSG film 258 of the above embodiment.

As shown in FIG. 34C and FIG. 35C, the surface of the BPSG 258 is flattened, and, thereafter, the recessed portion 254 for providing the gap 256 between the electrode and the oscillation plate is formed in the BPSG film 258 in a similar manner to the previous embodiment of FIG. 26D.

Figure 36:
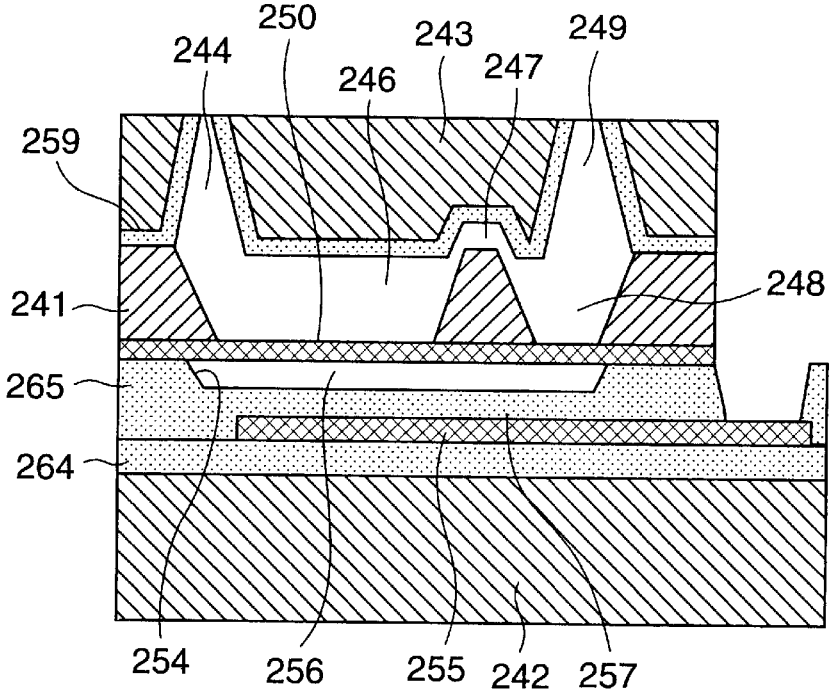
FIG. 36 is a longitudinal cross-sectional view of another preferred embodiment of the ink-jet head of the invention along a longitudinal line of an oscillation plate thereof.
Figure 37:
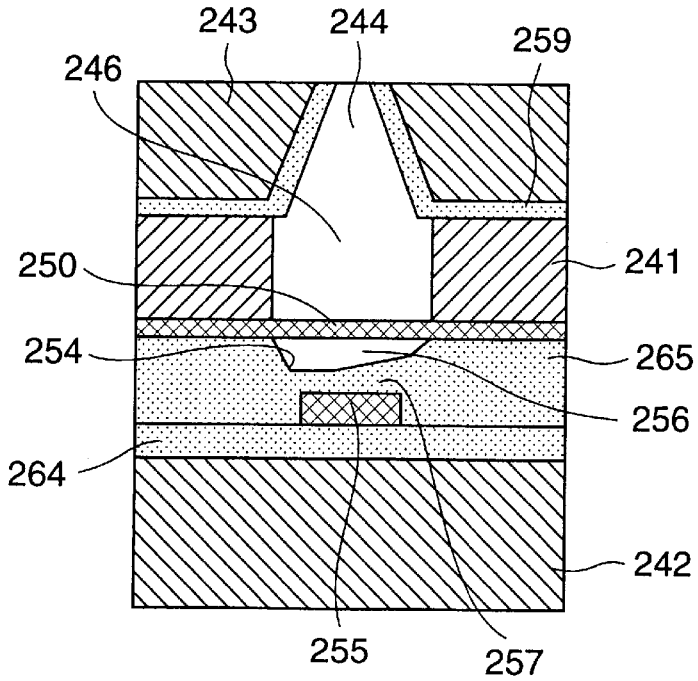
FIG. 37 is a transverse cross-sectional view of the ink-jet head of the present embodiment along a transverse line of the oscillation plate.

Next, FIG. 36 is a longitudinal cross-sectional view of another preferred embodiment of the ink-jet head of the invention along a longitudinal line of an oscillation plate thereof. FIG. 37 is a transverse cross-sectional view of the ink-jet head of the present embodiment along a transverse line of the oscillation plate.

The ink-jet head of this embodiment is essentially the same as the ink-jet head shown in FIG. 24, except for the electrode substrate 242. In FIG. 36 and FIG. 37, the other elements that are the same as corresponding elements in FIG. 24 are designated by the same reference numerals, and a description thereof will be omitted.

As shown in FIG. 36 and FIG. 37, the electrode substrate 242 of this embodiment includes the silicon oxide layer 264 (the SOG film) provided on the entire surface of the silicon substrate 242. The electrode 255, which faces the oscillation plate 250 via the gap 256, is formed on the silicon oxide layer 264. In addition, the silicon oxide layer 265 (the SOG film) is formed on the entire surface of the silicon oxide layer 264 and the electrode 255. Further, the silicon oxide layer 258 containing phosphorus and/or boron (the BPSG film) is deposited on the silicon oxide layer 265. In the silicon oxide layer 258, the recessed portion 254 for providing the gap 256 between the oscillation plate 250 and the electrode 255 is formed. In the present embodiment, the bottom surface of the recessed portion 254 is inclined along the transverse line of the oscillation plate 250, and the gap 256 of this embodiment is formed into the non-parallel type gap.

Figure 38:
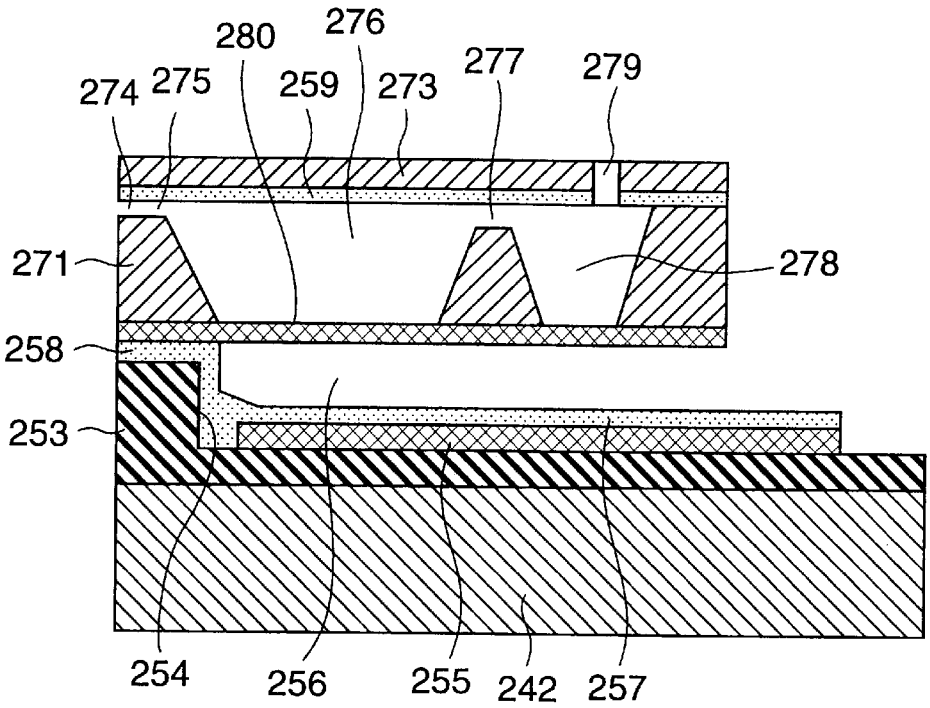
FIG. 38 is a longitudinal cross-sectional view of another preferred embodiment of the ink-jet head of the invention along a longitudinal line of an oscillation plate thereof.
Figure 39:
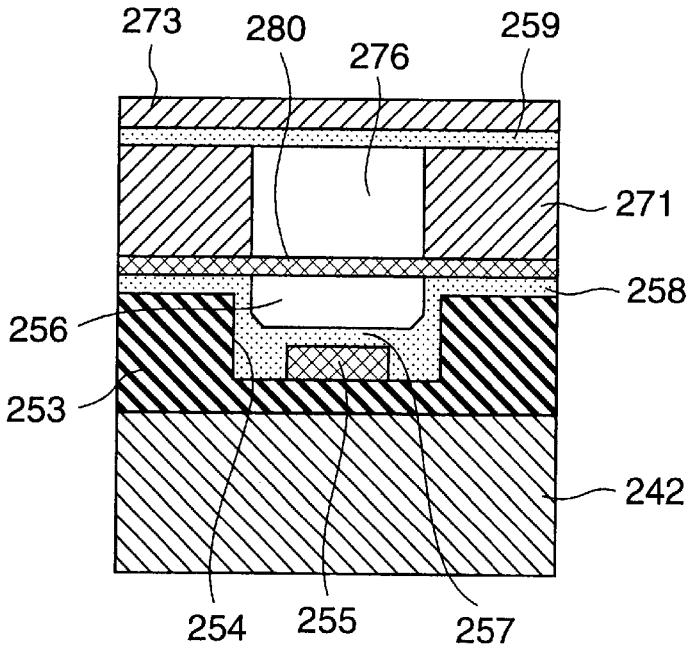
FIG. 39 is a transverse cross-sectional view of the ink-jet head of the present embodiment along a transverse line of the oscillation plate.

Next, FIG. 38 is a longitudinal cross-sectional view of another preferred embodiment of the ink-jet head of the invention along a longitudinal line of an oscillation plate thereof. FIG. 39 is a transverse cross-sectional view of the ink-jet head of the present embodiment along a transverse line of the oscillation plate.

The ink-jet head of this embodiment is essentially the same as the ink-jet head shown in FIG. 13, except for the ink-passage substrate 271. In FIG. 38 and FIG. 39, the other elements that are the same as corresponding elements in FIG. 13 are designated by the same reference numerals, and a description thereof will be omitted.

As shown in FIG. 38 and FIG. 39, the lid member 273 (the fourth substrate) is bonded to the ink-passage substrate 271 of this embodiment. In the ink-passage substrate 271, the nozzle 274, the discharging chamber 276 communicating with the nozzle 274 via the nozzle passage 275, the fluid resistance portion 277, and the common ink chamber 278 are formed.

In the present embodiment, the lid member 273 is made of a plate material. In the ink-passage substrate 271, the grooved portion for providing the nozzle 274 and the nozzle passage 275, the recessed portion for providing discharging chamber 276 and the oscillation plate 280, the grooved portion for providing the fluid resistance portion 277, and the recessed portion for providing the common ink chamber 278 are formed. The lid member 273 is bonded to the ink-passage substrate 271 via the BPSG film 259. The ink supply opening 279 is formed in the lid member 273.

The ink-jet head of this embodiment is the edge-shooter type ink-jet head. Alternatively, the lid member 273 in which the nozzle 274, the nozzle passage 275 and the fluid resistance portion 277 are provided may be used in the ink-jet head of the present embodiment. In such alternative embodiment, the lid member 273 serves as the nozzle plate.

Next, a description will be given of an ink-jet printing system including one embodiment of the ink-jet head of the present invention with reference to FIG. 40 and FIG. 41.

Figure 40:
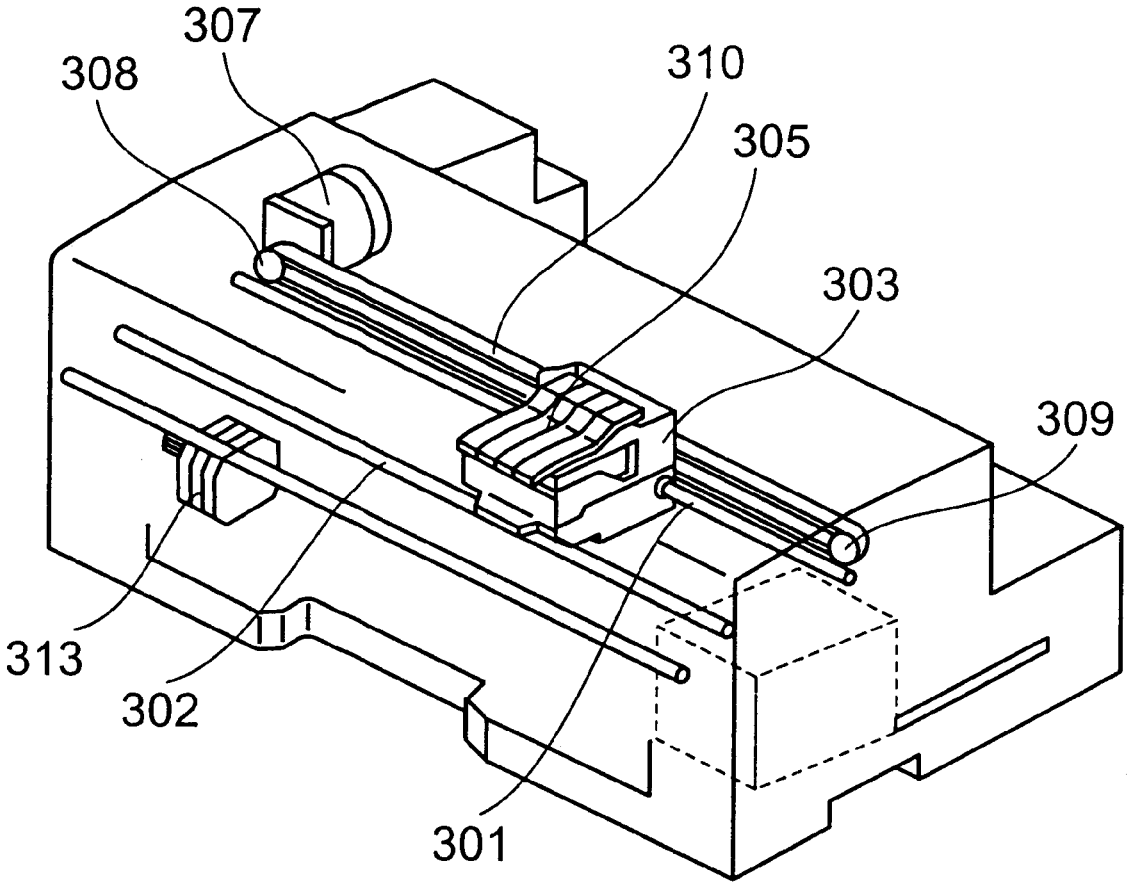
FIG. 40 is a perspective view of an ink-jet printing system which includes one embodiment of the ink-jet head of the invention.

FIG. 40 is a perspective view of the ink-jet printing system which includes one embodiment of the ink-jet head of the invention. FIG. 41 is a diagram for explaining a printing mechanism of the ink-jet printing system of the present embodiment.

As shown, the ink-jet printing system includes a main guide rod 301 and a follower guide rod 302 which are horizontally spaced from each other. A head carriage 303 is movably supported on the main and follower guide rods 301 and 302, and the head carriage 303 is movable in a main scanning direction. An ink-jet head 304, which includes a yellow (Y) ink-jet head, a magenta (M) ink-jet head, a cyan (C) ink-jet head and a black (Bk) ink-jet head, each being one embodiment of the ink-jet head of the present invention, is provided on a bottom surface of the carriage 303. The ink discharging surface of the ink-jet head 304 is faced downward. On a top surface of the carriage 303, an ink cartridge 305 containing Y, M, C and Bk inks is attached to the carriage 303. The ink cartridge 105 is changeable with a new one.

In the present embodiment, the ink-jet head 304 may be a multiple-head module including a plurality of ink-jet heads each discharging one of the four inks (Y, M, C and Bk), or a multiple-nozzle head including a plurality of nozzles each discharging one of the four inks (Y, M, C and Bk).

In the ink-jet printing system of the present embodiment, the head carriage 303 is connected to a timing belt 310, and this timing belt 310 is wound between a driving pulley 308 and a follower pulley 309. A main scanning motor 307 rotates the driving pulley 308 around a rotation axis of the motor 307, and the follower pulley 309 is rotated by the rotating force of the motor 307 via the driving pulley 308. The rotation of the main scanning motor 307 is controlled so that the head carriage 303 carrying the ink-jet head 304 is moved in the main scanning direction.

Figure 41:
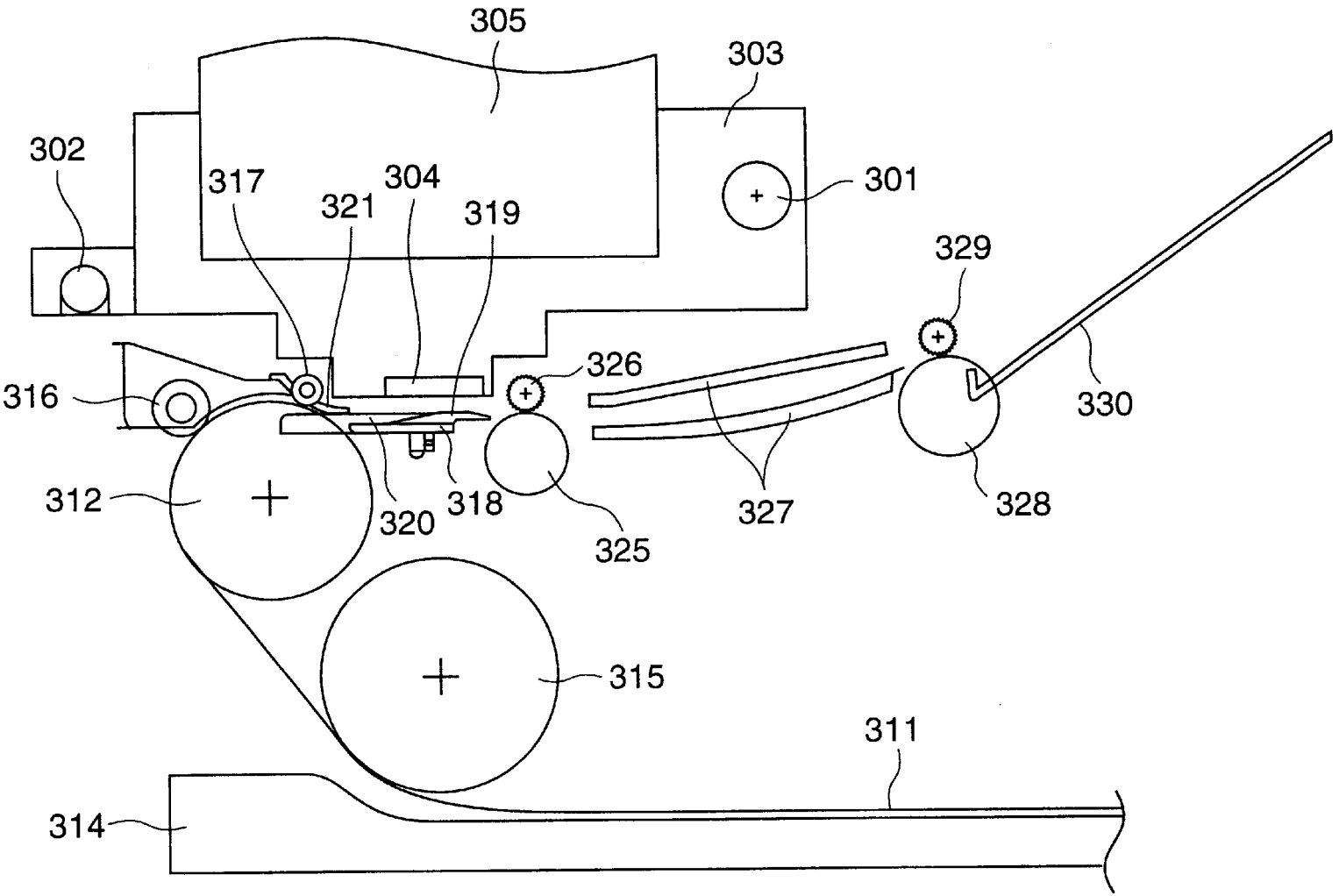
FIG. 41 is a diagram for explaining a printing mechanism of the ink-jet printing system of the present embodiment.

As shown in FIG. 41, a transport roller 312 is rotatably retained so that a recording sheet 311 is forwarded in a sub-scanning direction (which is perpendicular to the main scanning direction) by the transport roller 312. A sub-scanning motor 313 (shown in FIG. 40) rotates the transport roller 312, and the rotating force of the motor 313 is transmitted to the transport roller 312 through a gear train (not shown). The recording sheet 313, which is placed in a paper cassette 314, is transported from a paper feeding roller 315 to the transport roller 312, and the recording sheet 313 that is reverted by the transport roller 312, is transported to a printing position beneath the ink-jet head 304.

On the periphery of the transport roller 312, a pressure roller 316 and a retaining roller 317 are provided to reverse the recording sheet 311. The pressure roller 316 and the retaining roller 317 are rotatably supported so that the recording sheet 311 in the reversed position is transported. At a downstream position of the sheet transport passage, a sheet guide member 318 is provided, and the recording sheet 311 sent by the transport roller 312 is supported at the printing position beneath the ink-jet head 304 by the sheet guide member 318.

The sheet guide member 318 has a longitudinal length that corresponds to an effective range of the movement of the head carriage 303 in the main scanning direction. A number of ribs 319 and a number of ribs 320 are arranged along the main scanning line of the sheet guide member 318 at intervals of a given distance. The recording sheet 311 is transported through the printing position while it is in contact with the top surfaces of the ribs 319 and 320, so that the distance between the ink-jet head 304 and the recording sheet 311 is maintained at a given constant distance.

At an upstream portion of the sheet guide member 318 in the sheet transport direction, a sheet retaining member 321, including a torsional coil spring, is provided adjacent to the ribs 320. The sheet retaining member 321 is rotatably supported by a supporting shaft of the roller 317, and the actuating force of the coil spring is exerted on the sheet retaining member 321 so as to push the sheet retaining member 321 toward the ribs 320.

At a downstream portion of the sheet guide member 318 in the sheet transport direction, a first ejection roller 325 and a follower roller 326 are provided to send the recording sheet 311 in the sheet ejection direction. A sheet transport passage member 327, a second ejection roller 328 and a follower roller 329 are provided at a subsequent downstream portion of the sheet transport passage following the rollers 325 and 326. The first and second ejection rollers 325 and 328 are rotated to send the recording sheet 311 in the sheet ejection direction. Further, a paper ejection tray 330 is provided in a slanted condition so that the recording sheet 311 after the image printing is stacked on the paper ejection tray 330.

In the ink-jet printing system of the above-described embodiment, the recording sheet 311 from the paper cassette 314 is sent to the transport roller 312 by the paper feeding roller 312, and the recording sheet 311 is reversed on the periphery of the transport roller 312 at the roller 312, and it is sent to the printing position by the transport roller 312. The recording sheet 311 is transported through the printing position while it is in contact with the top surfaces of the ribs 319 and 320, so that the distance between the ink-jet head 304 and the recording sheet 311 is maintained at a given constant distance. During the sheet transport, the ink-jet head 304 discharges an ink drop to the recording sheet 311 so that an image is printed on the recording sheet 311. After the image printing is performed, the recording sheet 311 is ejected to the paper ejection tray 330.

As for the ink-jet printing system of the above embodiment, the side-shooter type ink-jet head to which the present invention is applied has been described. However, the present invention is not limited to the above embodiment. For example, the present invention is applicable to the edge-shooter type ink-jet head in which the ink discharging direction is perpendicular to the direction of actuation of the oscillation plate.

Figure 42:
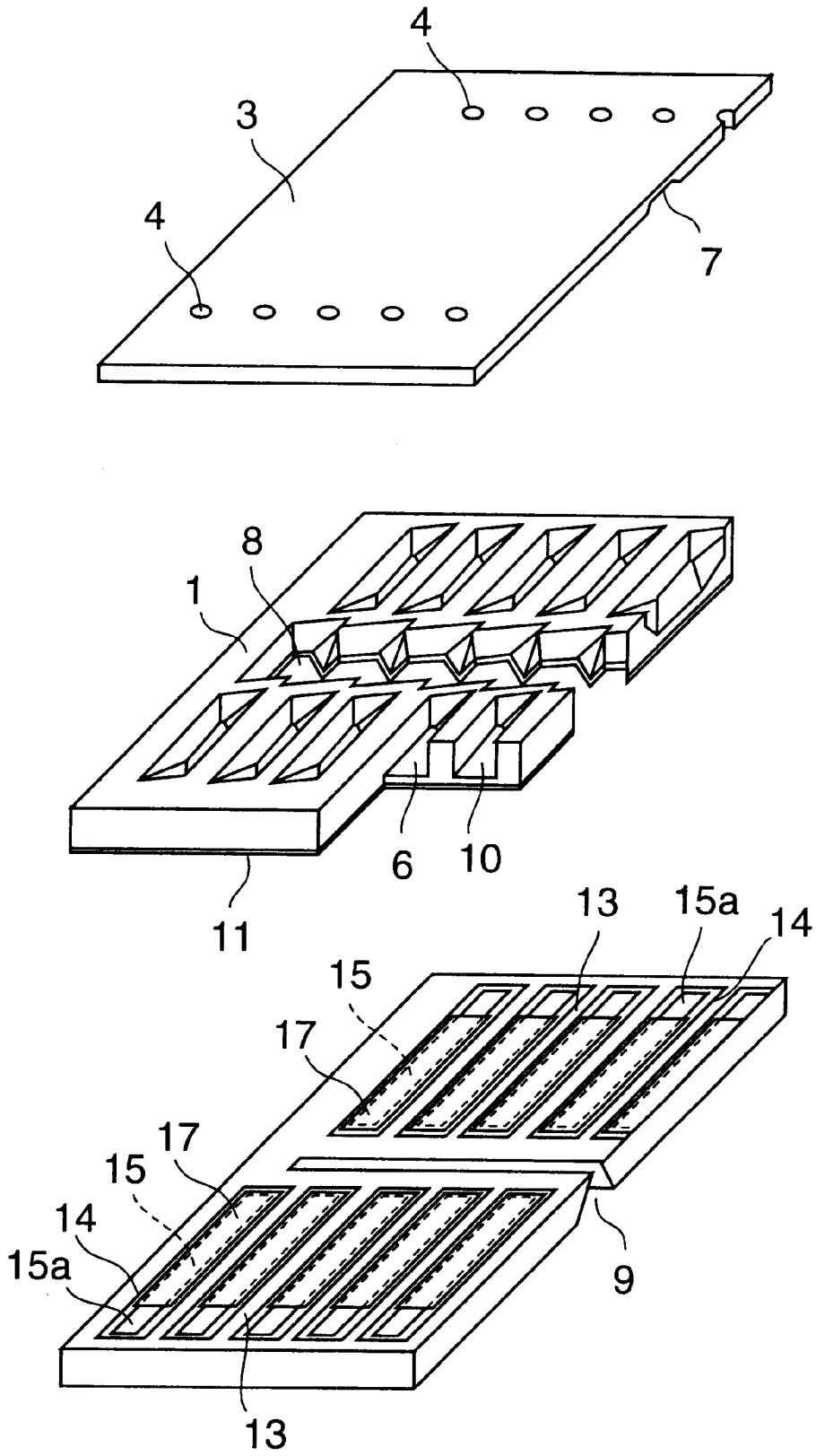
FIG. 42 is an exploded view of another preferred embodiment of the ink-jet head of the invention.
Figure 43:
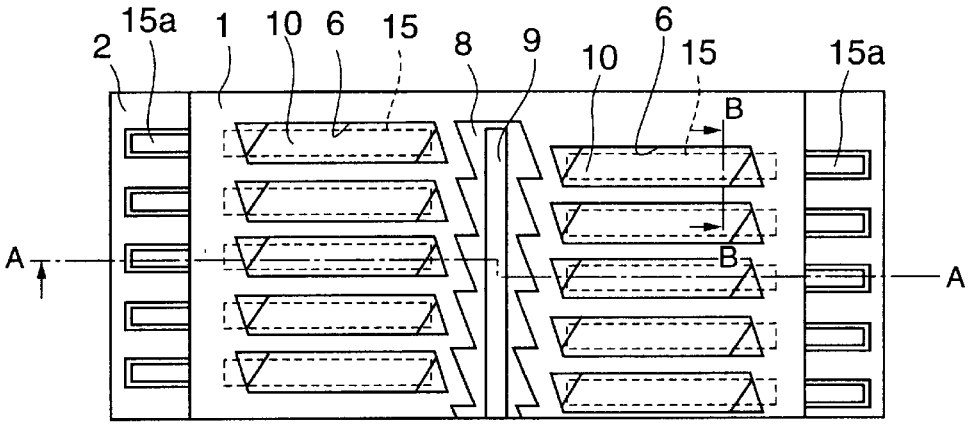
FIG. 43 is a top view of the ink-jet head of the present embodiment in which a nozzle plate is removed.
Figure 44:
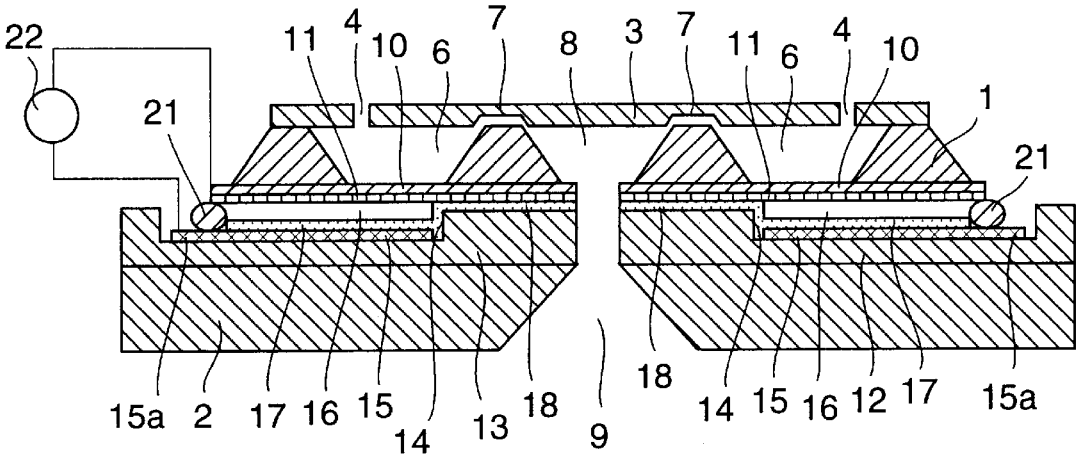
FIG. 44 is a longitudinal cross-sectional view of the ink-jet head of the present embodiment along a line A—A indicated in FIG. 43.
Figure 45:
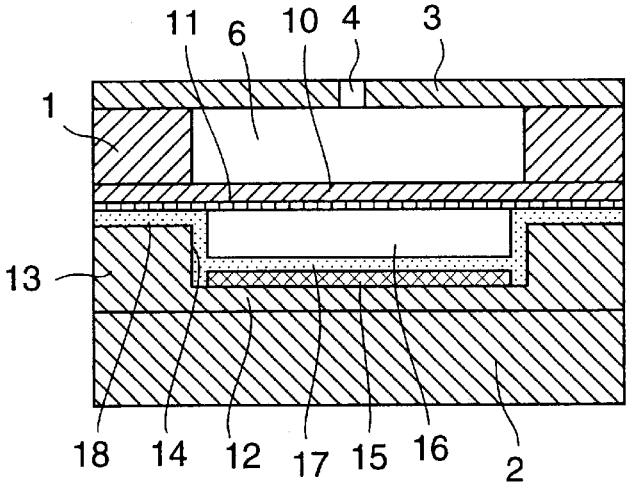
FIG. 45 is a transverse cross-sectional view of the ink-jet head of the present embodiment along a line B—B indicated in FIG. 43.

Next, FIG. 42 is an exploded view of another preferred embodiment of the ink-jet head of the invention. FIG. 43 is a top view of the ink-jet head of the present embodiment in which a nozzle plate is removed. FIG. 44 is a longitudinal cross-sectional view of the ink-jet head of the present embodiment along a line A—A indicated in FIG. 43. FIG. 45 is a transverse cross-sectional view of the ink-jet head of the present embodiment along a line B—B indicated in FIG. 43.

As shown, the ink-jet head of the present embodiment generally includes an ink-passage substrate 1 of silicon (which is also called a first substrate), an electrode substrate 2 of silicon (which is also called a second substrate) provided on bottom of the ink-passage substrate 1, and a nozzle plate 3 provided on top of the ink-passage substrate 1. The ink-passage substrate 1, the electrode substrate 2 and the nozzle plate 3 are bonded together to provide a laminated structure of the ink-jet head. These components of the ink-jet head form a plurality of nozzles 4, a corresponding number of discharging chambers 6, and a common ink chamber 8. Each discharging chamber 6 communicates with one of the plurality of nozzles 4 and contains ink therein. The common ink chamber 8 communicates with each of the respective discharging chambers 6 via a corresponding one of fluid resistance portions 7.

In the ink-passage substrate 1, the discharging chambers 6, oscillation plates 10 each defining the bottom surface of a corresponding one of the discharging chambers 6, recessed portions each defining partition walls forming a corresponding one of the discharging chambers 6 therebetween, and a recessed portion defining the common ink chamber 8 are provided by using the silicon substrate.

For the sake of simplicity of description, it is assumed, in the following description, that the ink-jet head of the present embodiment comprises the nozzle 4, the discharging chamber 6, the oscillation plate 10 and the electrode 15. However, it should be noted that the actual ink-jet head includes, as shown in FIG. 1, the plural nozzles 4, the plural discharging chambers 6, the plural oscillation plates 10 and the plural electrodes 15.

In the ink-jet head of the present embodiment, the ink-passage substrate 1 includes a boron diffusion layer containing boron as a high concentration of p-type dopants in the silicon substrate. The boron as the high-concentration p-type dopants is diffused onto the silicon substrate 1 through ion implantation or the like. After anisotropic etching is performed on the silicon substrate, the boron diffusion layer is left on the silicon substrate, and the recessed portion defining the discharging chamber 6 is formed in the silicon substrate, and the oscillation plate 10 having the desired thickness is provided.

The source materials of the p-type dopants that may be used in the present embodiment include, in addition to boron, gallium and aluminum. A silicon oxide film or a silicon nitride film may be used as the anisotropic etching stop layer, and a single-crystal silicon or a polysilicon may be used as the source material of the oscillation plate 10.

In the electrode substrate 2, the thermal oxidation film 411 (the silicon dioxide film) having a thickness 1 $\mu$m is formed on the silicon substrate (the second substrate) by a thermal oxidation process. The thermal oxidation film 411 includes the recessed portion 414 having a depth 0.3 $\mu$m in which the electrode 15 is formed on the bottom of the recessed portion 414. The electrode 15 confronts the oscillation plate 10 via the gap 416 between the oscillation plate 10 and the electrode 15. The electrode 15 actuates the oscillation plate 10 by an electrostatic force generated when a driving voltage is applied to the electrode 15, so that the oscillation plate 10 pressurizes the ink in the discharging chamber 6 so as to discharge an ink drop from the nozzle 4.

In the present embodiment, the electrode 15 is formed through sputtering using a pattern of titanium nitride having a thickness 0.1 $\mu$m. After the ink-jet head is assembled by bonding the ink-passage substrate 1 and the electrode substrate 2 together, the gap 416 (or the distance between the oscillation plate 10 and the electrode 15) is set to 0.2 $\mu$m. The source material of the electrode 15 may include a doped polysilicon, a metal material having a high melting point, such as titanium, tungsten, or titanium nitride, and a metal material such as aluminum, chromium, nickel or gold.

The surface of the electrode 15 is covered with an insulating layer 17. For example, the insulating layer 17 is formed by chemical vapor deposition (CVD) into a silicon dioxide film having a thickness 0.1 $\mu$m. The insulating layer 17 serves to avoid the occurrence of dielectric breakdown or short circuit of the ink-jet head when it is driven. In addition, the insulting layer 17 serves to prevent the oxidation of titanium nitride components contained in the electrode 15 during the production of the ink-jet head. As shown in FIG. 42, the electrode 15 includes a pad 15*a* which is provided to electrically connect the electrode 15 to an external driving circuit 22 (driver IC). The electrical connection between the electrode 15 and the driving circuit 22 is made by using an FPC cable or the like, which is wire bonded to the ink-jet head.

In the ink-jet head of the present embodiment, the ink-passage substrate 1 (silicon) is bonded directly to the electrode substrate 2 (silicon) via the thermal oxidation film 11 (the silicon dioxide film). The thermal oxidation film 11 includes bonding areas where the first substrate 1 and the second substrate 2 are bonded, and the bonding areas are provided to have a lowered melting point such that the direct bonding of the substrates 1 and 2 is allowed at a temperature lower than 1000 deg. C. To facilitate the direct bonding, the bonding surface of the ink-passage substrate 1 is polished to have a small surface roughness.

The bonding areas of the thermal oxidation film 11 (the silicon oxide film) contain boron or $B_2O_3$ that is introduced by ion implantation. The bonding areas of the thermal oxidation film 11, where the electrode substrate 2 is bonded to the ink-passage substrate 1, are provided to have a lowered melting point such that the direct bonding of the first silicon substrate 1 and the second silicon substrate 2 is allowed at a temperature lower than 1000 deg. C.

In the above-described embodiment, the thermal oxidation film 11 on the electrode substrate 2, which includes the recessed portion 14 in which the electrode 15 is formed, is provided with the bonding areas having the lowered melting point. Alternatively, the bonding areas of the oscillation plate 10 of the ink-passage substrate 1 may be solely or additionally provided to have the lowered melting point.

The nozzle plate 3 is made of a stainless steel (SUS) material having a thickness 50 $\mu$m, and the nozzles 4 and the fluid resistance portions 7 are formed in the nozzle plate 3.

In the ink-jet head of the above-described embodiment, upon application of a pulsed driving voltage in the range of 0 to 35 V to the electrode 15 by a driving circuit (not shown), the surface of the electrode 15 is positively charged. The opposing surface of the oscillation plate 10 to the electrode 15 is negatively charged. The electrode 15 at this time actuates the oscillation plate 10 by a downward electrostatic force, and the oscillation plate 10 is deflected downward. On the other hand, when the driving voltage applied to the electrode 15 is turned off, the deflected oscillation plate 10 is recovered to the original position. By this movement of the oscillation plate 10, the ink in the discharging chamber 6 is pressurized so that an ink drop is discharged from the nozzle 4 onto a recording medium. After this, when the oscillation plate 10 is deflected downward again, the discharging chamber 6 is replenished with ink that is supplied from the common ink chamber 8 through the fluid resistance portion 7.

In the ink-jet head of the present embodiment, a spacer 13 is provided on the electrode substrate 2 such that the spacer 13 forms the gap 16 between the oscillation plate 10 and the electrode 15. The spacer 13 has a silicon oxide layer 18 on a surface thereof where the ink-passage substrate 1 is bonded to the electrode substrate 2. The silicon oxide layer 18 is provided to have a lowered melting point that allows the bonding of the first substrate 1 and the second substrate 2 at a temperature lower than 1000 deg. C. In the present embodiment, the silicon oxide layer 18 is made of a BSG (boro-silicate glass) film containing boron but containing no phosphorus. The silicon oxide layer 18 includes the insulating layer 17 which is integrally formed with the silicon oxide layer 18 and provided on the surface of the electrode 15.

Alternatively, the silicon oxide layer 18 of the present embodiment may be made of a PSG (phospho-silicate glass) film containing phosphorus but containing no boron, or a BPSG (borophospho-silicate glass) film containing phosphorus and boron. In the above embodiment, the silicon oxide layer 18 is provided on the second substrate 2. Alternatively, the silicon oxide layer 18 may be provided on the surface of the oscillation plate 10 of the ink-passage substrate 1, which faces the surface of the insulating layer 17.

In the present embodiment, it is necessary that the silicon oxide layer 18 of the spacer 13 contains doping elements having a covalent bond, and an electronegativity of an oxide of the doping elements is less than 2.0. Such doping elements include boron, sulfur, phosphorus, arsenic, antimony, germanium, tin, titanium, zirconium, beryllium, and aluminum. The electronegativity of the oxide of the doping elements is a measure of the strength of the covalent bond, and it is expressed by a difference between an electronegativity of oxygen atom and an electronegativity of the dopant. It is required that the difference for the present embodiment is less than 2.0. When the above conditions are met, it is possible to avoid melting or solution of the doping elements into the ink and to provide good adhesion of the bonding of the first and second substrates 1 and 2.

In the present embodiment, the surface of the oscillation plate 10 confronting the electrode 15, which is brought into contact with the insulating layer 17, is polished so that the polished surface has an adequately small surface roughness. When the oscillation plate 10 is actuated by the electrode 15 by the contact driving method such that the oscillation plate 10 contacts the insulating layer 17, it is possible to ensure that the damages of the insulating layer 17 by the oscillation plate 10 are reduced so as to provide adequate reliability against dielectric breakdown.

Further, in the ink-jet head of the present embodiment, gap sealing agent 21 that containing an epoxy-based adhesive agent is applied to the end portions of the gap 16 where the pad 15*a* of the electrode 15 is provided. The sealing of the gap 16 is maintained by the gap sealing agent 21, and it is possible to prevent the inclusion of moisture or foreign matter into the gap 16 and the entry of air into the gap 16.

Figure 46:
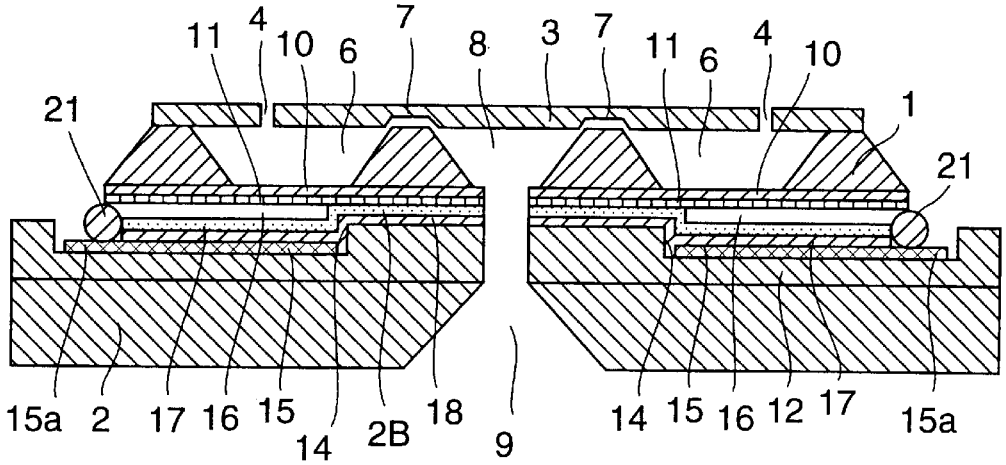
FIG. 46 is a longitudinal cross-sectional view of another preferred embodiment of the ink-jet head of the invention along a longitudinal line of an oscillation plate thereof.
Figure 47:
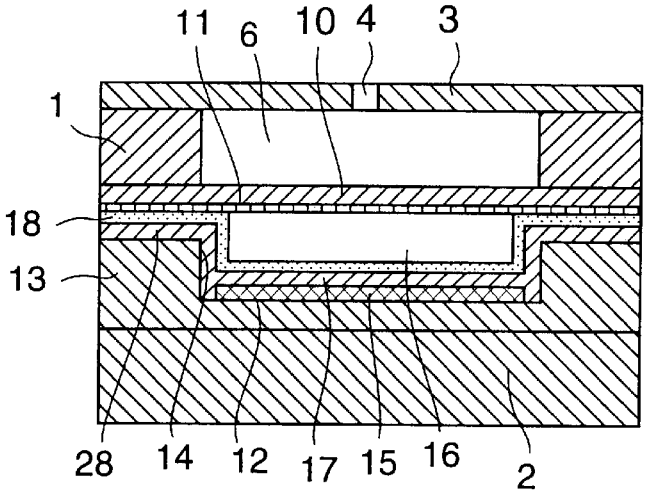
FIG. 47 is a transverse cross-sectional view of the ink-jet head of the present embodiment along a transverse line of the oscillation plate.

Next, FIG. 46 is a longitudinal cross-sectional view of another preferred embodiment of the ink-jet head of the invention along a longitudinal line of an oscillation plate thereof. FIG. 47 is a transverse cross-sectional view of the ink-jet head of the present embodiment along a transverse line of the oscillation plate.

As shown, in the ink-jet head of the present embodiment, the silicon oxide layer 28 containing no dopant (the NSG film) is provided on the thermal oxidation layer 12 of the spacer 13, and the silicon oxide layer 18 containing phosphorus and/or boron (the BPSG film), which is provided to have a lowered melting point that allows the bonding of the first and second substrates 1 and 2 at a temperature lower than 1000 deg. C., is provided on the silicon oxide layer 28. Namely, the silicon oxide layer of the spacer 13 in this embodiment has a two-layer structure including the silicon oxide layers 28 and 18. In the present embodiment, the silicon oxide layer 28 containing no dopant serves as the base layer of the silicon oxide layer 18 that prevents the diffusion of boron or phosphorus in the silicon oxide layer 18 into the electrode substrate 2 or the electrode 15. It is possible to prevent the degradation of quality of the ink-jet head.

Figure 48:
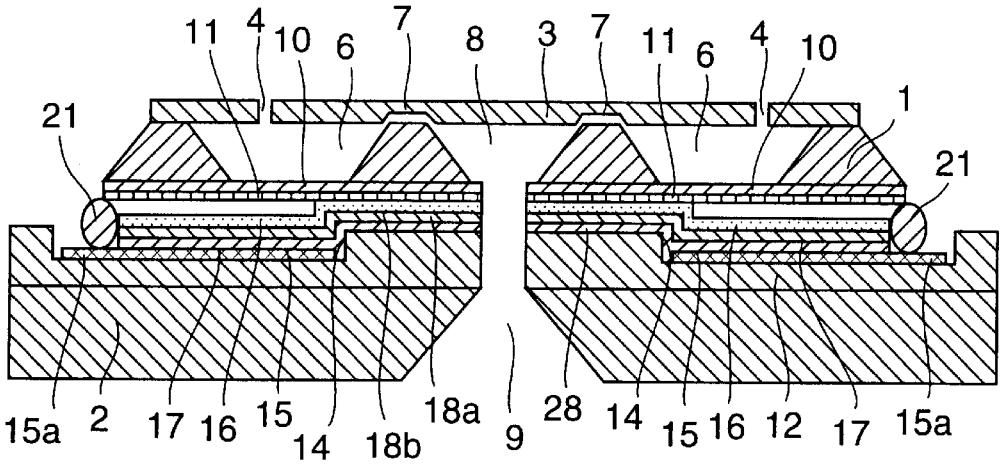
FIG. 48 is a longitudinal cross-sectional view of another preferred embodiment of the ink-jet head of the invention along a longitudinal line of an oscillation plate thereof.
Figure 49:
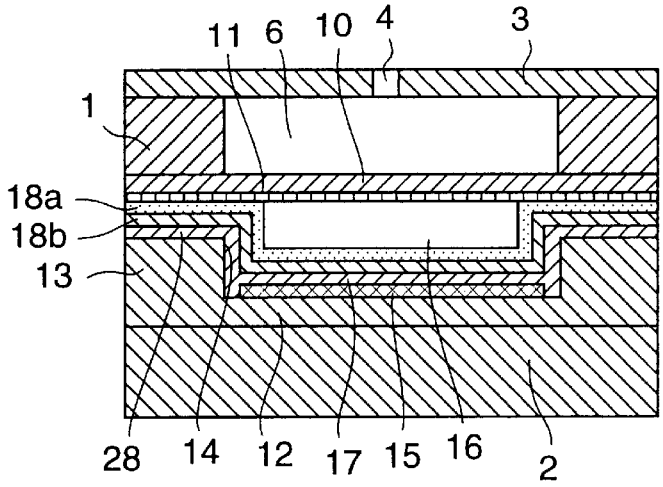
FIG. 49 is a transverse cross-sectional view of the ink-jet head of the present embodiment along a transverse line of the oscillation plate.

Next, FIG. 48 is a longitudinal cross-sectional view of another preferred embodiment of the ink-jet head of the invention along a longitudinal line of an oscillation plate thereof. FIG. 49 is a transverse cross-sectional view of the ink-jet head of the present embodiment along a transverse line of the oscillation plate.

As shown, in the ink-jet head of the present embodiment, the silicon oxide layer 28 containing no dopant (the thermally oxide film, the NSG film or the SOG film) is provided on the thermal oxidation layer 12 of the spacer 13, and the silicon oxide layer 18*b* containing phosphorus and boron (the BPSG film) is provided on the silicon oxide layer 28, and further the silicon oxide layer 18*a* containing phosphorus (the PSG film) is provided on the silicon oxide layer 18*b*. Namely, the silicon oxide layer of the spacer 13 in this embodiment has a three-layer structure including the silicon oxide layers 28, 18*a* and 18*b*. Alternatively, the BPSG film 18*b* in the above embodiment may be replaced by the PSG film containing phosphorus.

In the present embodiment, the silicon oxide layer 28 containing no dopant serves as the base layer of the silicon oxide layer 18 that prevents the diffusion of boron or phosphorus in the silicon oxide layer 18 into the electrode substrate 2 or the electrode 15. It is possible to prevent the degradation of quality of the ink-jet head.

Figure 50:
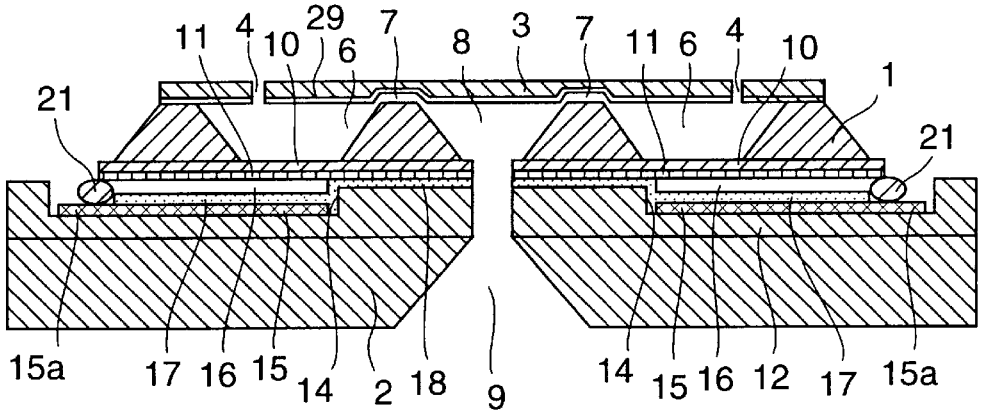
FIG. 50 is a longitudinal cross-sectional view of another preferred embodiment of the ink-jet head of the invention along a longitudinal line of an oscillation plate thereof.
Figure 51:
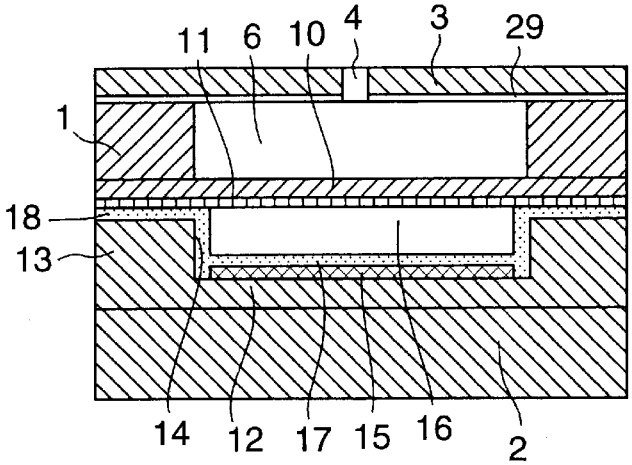
FIG. 51 is a transverse cross-sectional view of the ink-jet head of the present embodiment along a transverse line of the oscillation plate.

Next, FIG. 50 is a longitudinal cross-sectional view of another preferred embodiment of the ink-jet head of the invention along a longitudinal line of an oscillation plate thereof. FIG. 51 is a transverse cross-sectional view of the ink-jet head of the present embodiment along a transverse line of the oscillation plate.

As shown, in the ink-jet head of this embodiment, the nozzle plate 3 is made of a silicon substrate, the silicon oxide layer 29 containing phosphorus and/or boron is provided on the surface of the nozzle plate 3 where the nozzle plate 3 is bonded to the ink-passage substrate 1 via the silicon oxide layer 29. The silicon oxide layer 29 may be made of the BSG film and produced by the CVD process. Alternatively, as described earlier, the silicon oxide layer 29 may have a two-layer structure including the BSG film and one of the BPSG film, the PSG film and the NSG film, a two-layer structure including the NSG film and the BPSG film, or a three-layer structure including the NSG film, the BPSG film and the PSG film.

Figure 52:
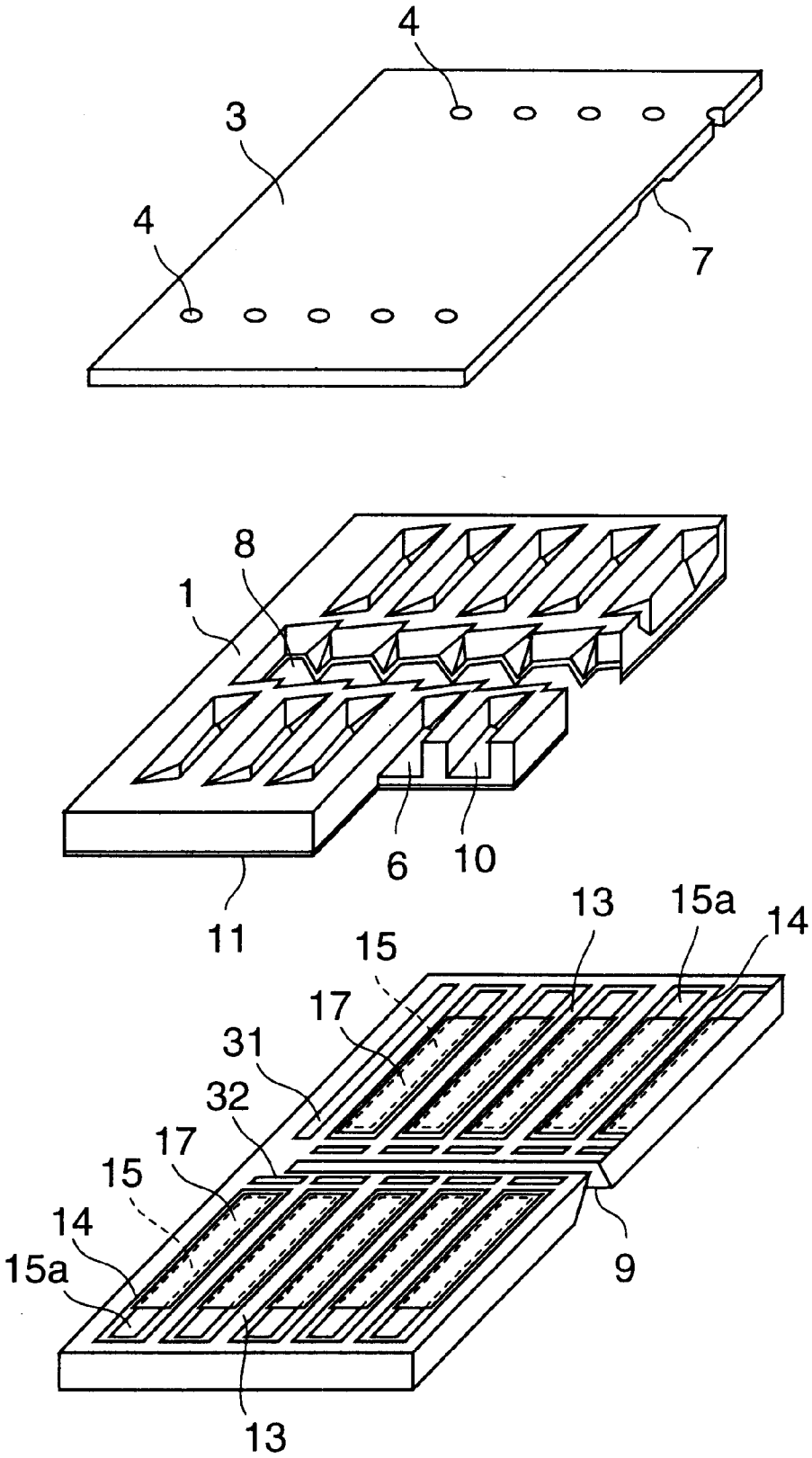
FIG. 52 is an exploded view of another preferred embodiment of the ink-jet head of the invention.
Figure 53:
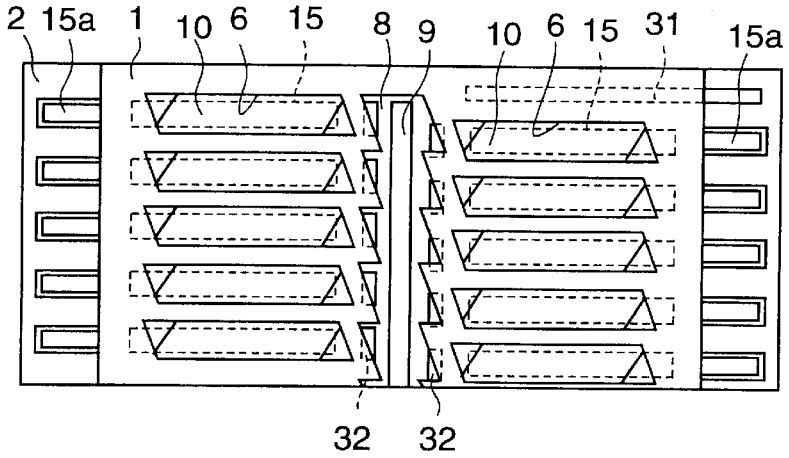
FIG. 53 is a top view of the ink-jet head of the present embodiment in which a nozzle plate is removed.
Figure 54:
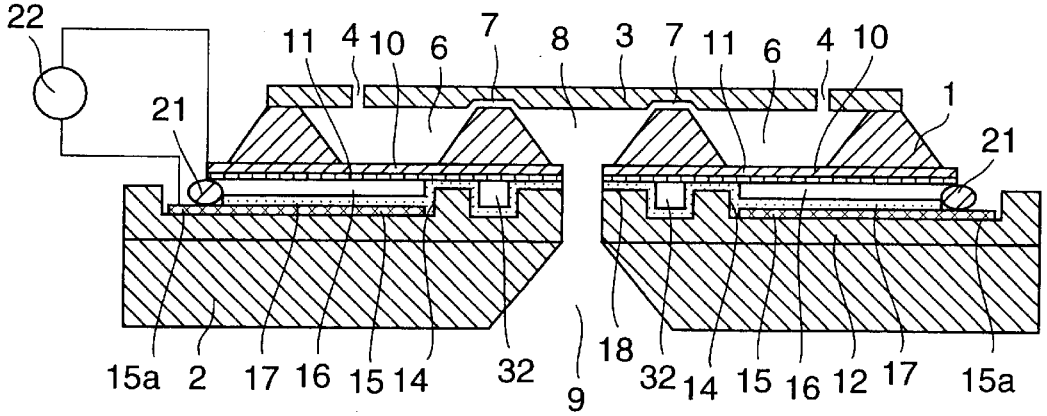
FIG. 54 is a longitudinal cross-sectional view of another preferred embodiment of the ink-jet head of the invention along a longitudinal line of an oscillation plate thereof.
Figure 55:
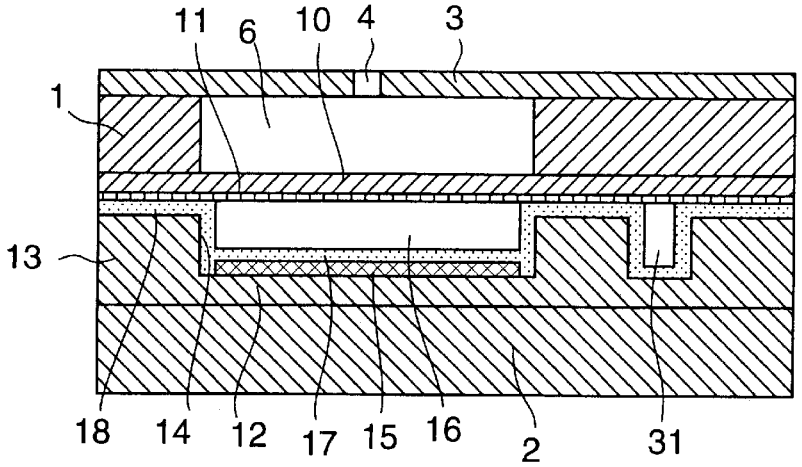
FIG. 55 is a transverse cross-sectional view of the ink-jet head of the present embodiment along a transverse line of the oscillation plate.

Next, FIG. 52 is an exploded view of another preferred embodiment of the ink-jet head of the invention. FIG. 53 is a top view of the ink-jet head of the present embodiment in which a nozzle plate is removed. FIG. 54 is a longitudinal cross-sectional view of another preferred embodiment of the ink-jet head of the invention along a longitudinal line of an oscillation plate thereof. FIG. 55 is a transverse cross-sectional view of the ink-jet head of the present embodiment along a transverse line of the oscillation plate.

As shown, in the ink-jet head of this embodiment, the spacer 13, which is provided on the electrode substrate 2 such that the spacer 13 forms the gap 16 between the oscillation plate 10 and the electrode 15, has the silicon oxide layer 18 on the surface thereof where the ink-passage substrate 1 is bonded to the electrode substrate 2. The silicon oxide layer 18 is provided to have a lowered melting point that allows the bonding of the first substrate 1 and the second substrate 2 at a temperature lower than 1000 deg. C. Further, the dummy grooves 31 and 32 are provided on the oxidation layer 12 which is the base layer of the silicon oxide layer 18, and the dummy grooves 31 and 32 are located where the bonding area of the spacer 13 is relatively large. It is possible for the present embodiment to reduce the variations of the thickness of the silicon oxide layer 18 containing phosphorus and/or boron by the use of the dummy grooves 31 and 32.

Figure 56:
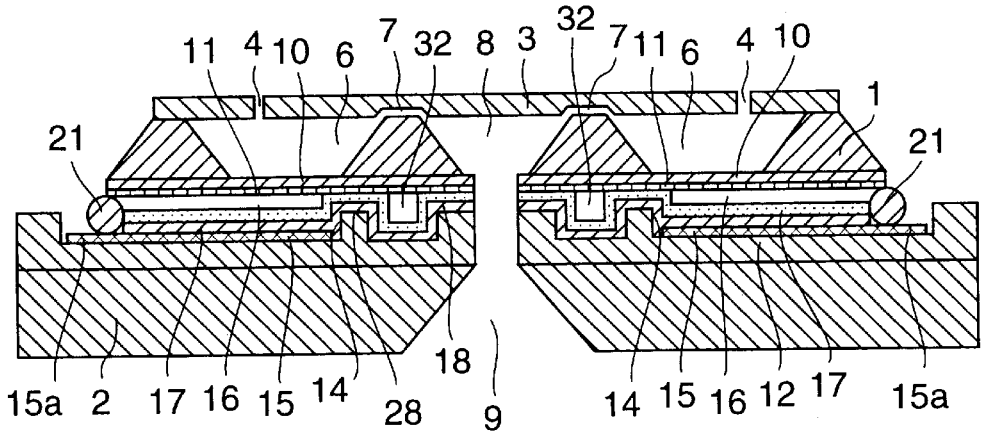
FIG. 56 is a longitudinal cross-sectional view of another preferred embodiment of the ink-jet head of the invention along a longitudinal line of an oscillation plate thereof.

Next, FIG. 56 is a longitudinal cross-sectional view of another preferred embodiment of the ink-jet head of the invention along a longitudinal line of an oscillation plate thereof.

As shown, the ink-jet head of the present embodiment is configured by a combination of the FIG. 46 embodiment and the FIG. 54 embodiment. It is possible for the present embodiment to reduce the variations of the thickness of the silicon oxide layer 18 containing phosphorus and/or boron by the use of the dummy grooves 31 and 32.

Figure 57:
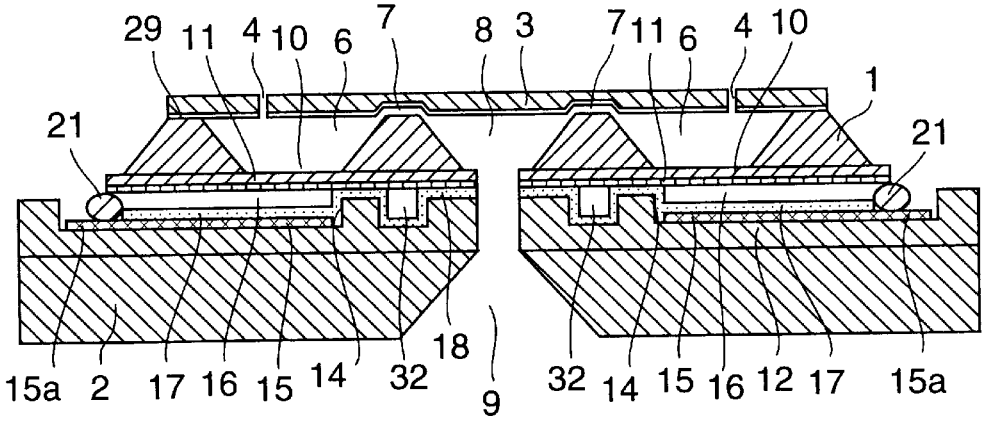
FIG. 57 is a longitudinal cross-sectional view of another preferred embodiment of the ink-jet head of the invention along a longitudinal line of an oscillation plate thereof.

Next, FIG. 57 is a longitudinal cross-sectional view of another preferred embodiment of the ink-jet head of the invention along a longitudinal line of an oscillation plate thereof.

As shown, the ink-jet head of the present embodiment is configured by a combination of the FIG. 48 embodiment and the FIG. 54 embodiment. It is possible for the present embodiment to reduce the variations of the thickness of the silicon oxide layer 18 containing phosphorus and/or boron by the use of the dummy grooves 31 and 32. It is possible to increase the reliability of the bonding of the first and second substrates 1 and 2 in the ink-jet head.

Figure 58:
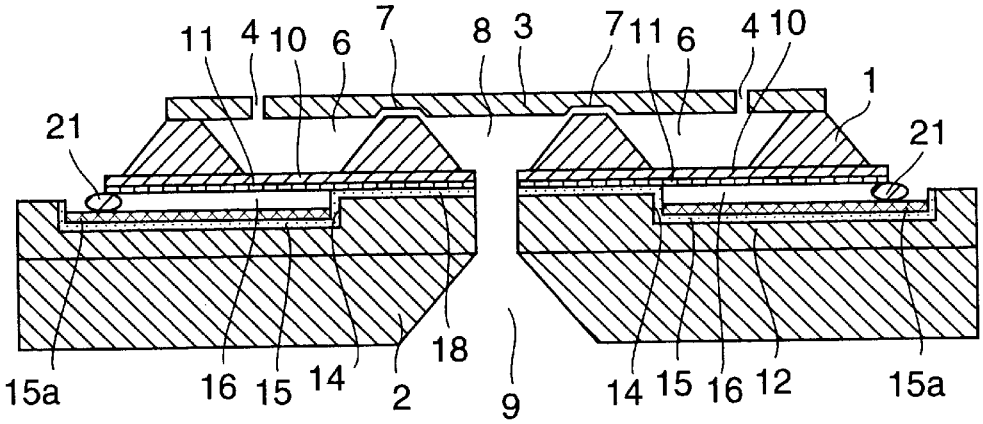
FIG. 58 is a longitudinal cross-sectional view of another preferred embodiment of the ink-jet head of the invention along a longitudinal line of an oscillation plate thereof.

Next, FIG. 58 is a longitudinal cross-sectional view of another preferred embodiment of the ink-jet head of the invention along a longitudinal line of an oscillation plate thereof.

As shown, in the ink-jet head of this embodiment, the silicon oxide layer 18 containing phosphorus and/or boron is provided only on the surface of the spacer 13. The silicon oxide layer 18 is not provided on the surface of the electrode 15 and the insulating layer 11 is provided on the oscillation plate 10 that confronts the electrode 15 via the gap 16, and it is possible to increase the reliability of electrical connection of the ink-jet head.

Figure 59:
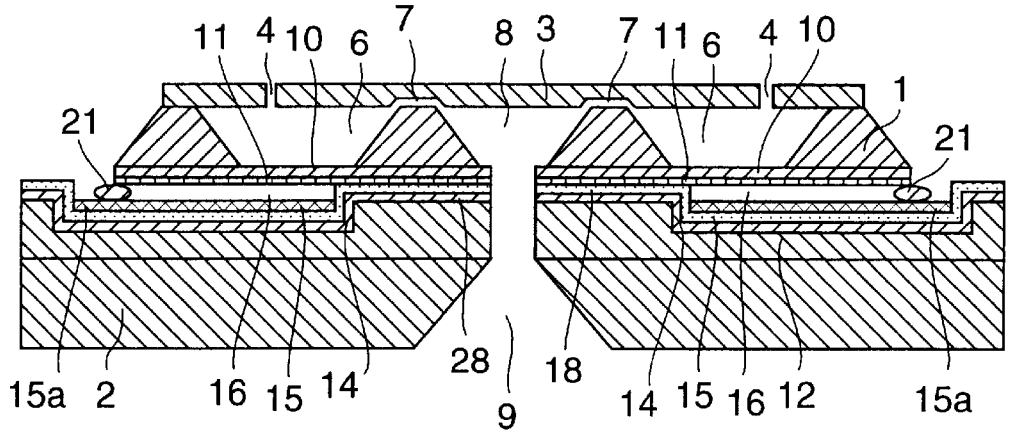
FIG. 59 is a longitudinal cross-sectional view of another preferred embodiment of the ink-jet head of the invention along a longitudinal line of an oscillation plate thereof.

Next, FIG. 59 is a longitudinal cross-sectional view of another preferred embodiment of the ink-jet head of the invention along a longitudinal line of an oscillation plate thereof.

As shown, in the ink-jet head of this embodiment, the laminated layer including the silicon oxide layer 18 containing phosphorus and/or boron and the silicon oxide layer 28 containing no dopant is provided only on the surface of the spacer 13. The silicon oxide layer 18 is not provided on the surface of the electrode 15 and the insulating layer 11 is provided on the oscillation plate 10 that confronts the electrode 15 via the gap 16, and it is possible to increase the reliability of electrical connection of the ink-jet head.

Figure 60:
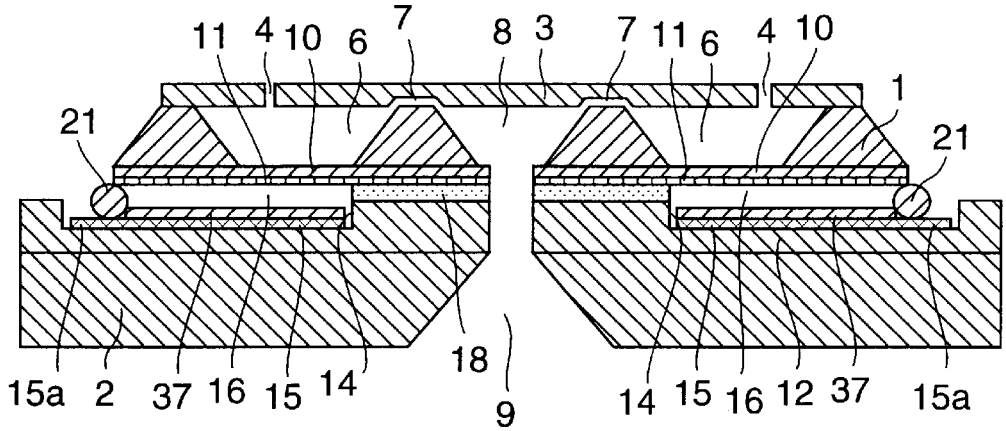
FIG. 60 is a longitudinal cross-sectional view of another preferred embodiment of the ink-jet head of the invention along a longitudinal line of an oscillation plate thereof.

Next, FIG. 60 is a longitudinal cross-sectional view of another preferred embodiment of the ink-jet head of the invention along a longitudinal line of an oscillation plate thereof.

As shown, in the ink-jet head of this embodiment, the silicon oxide layer 18 containing phosphorus and/or boron is provided only on the surface of the spacer 13, and the electrode 15 is provided directly on the thermal oxidation layer 12, and the protection layer 37 is provided on the surface of the electrode 15. The recessed portion 14 is formed after the silicon oxide layer 18 is formed on the thermal oxidation layer 12, and the silicon oxide layer 18 is configured to have a width that is substantially equal to a width of the partition wall provided adjacent to the electrode 15. It is possible for the present embodiment to reduce the variations of the thickness of the silicon oxide layer 18 containing phosphorus and/or boron. Further, it is possible to increase the reliability of electrical connection of the ink-jet head.

Figure 61:
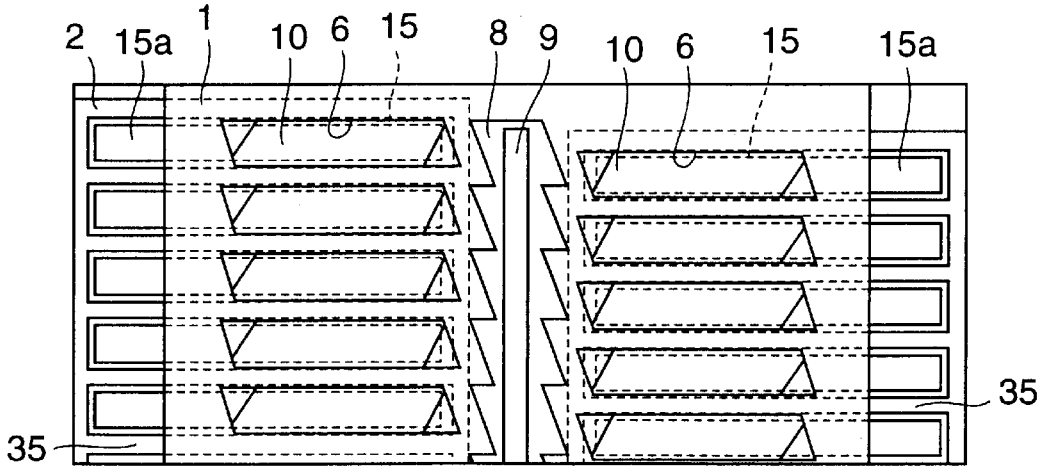
FIG. 61 is a top view of another preferred embodiment of the ink-jet head of the invention in which a nozzle plate is removed.
Figure 62:
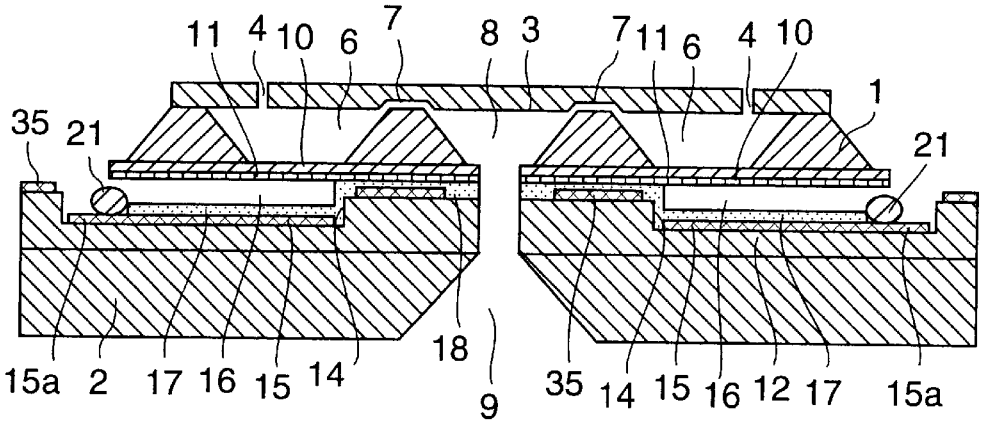
FIG. 62 is a longitudinal cross-sectional view of the ink-jet head of the present embodiment along a longitudinal line of an oscillation plate thereof.
Figure 63:
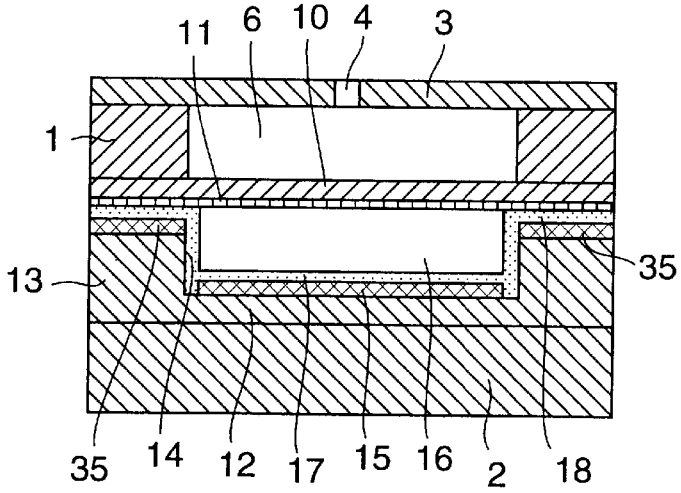
FIG. 63 is a transverse cross-sectional view of the ink-jet head of the present embodiment along a transverse line of the oscillation plate.

Next, FIG. 61 is a top view of another preferred embodiment of the ink-jet head of the invention in which a nozzle plate is removed. FIG. 62 is a longitudinal cross-sectional view of the ink-jet head of the present embodiment along a longitudinal line of an oscillation plate thereof. FIG. 63 is a transverse cross-sectional view of the ink-jet head of the present embodiment along a transverse line of the oscillation plate.

As shown, in the ink-jet head of this embodiment, the spacer 13, which is provided on the electrode substrate 2 such that the spacer 13 forms the gap 16 between the oscillation plate 10 and the electrode 15, has the silicon oxide layer 18 on the surface thereof where the ink-passage substrate 1 is bonded to the electrode substrate 2. The silicon oxide layer 18 is provided to have a lowered melting point that allows the bonding of the first substrate 1 and the second substrate 2 at a temperature lower than 1000 deg. C. Further, the dummy electrodes 35 are provided on the oxidation layer 12 which is the base layer of the silicon oxide layer 18, and the dummy electrodes 35 are located where the bonding area of the spacer 13 is relatively large. It is possible for the present embodiment to reduce the variations of the thickness of the silicon oxide layer 18 containing phosphorus and/or boron by the use of the dummy electrodes 35.

In the present embodiment, the dummy electrodes 35 are configured to have a uniform width, and they are electrically isolated from the electrode 15.

Figure 64:
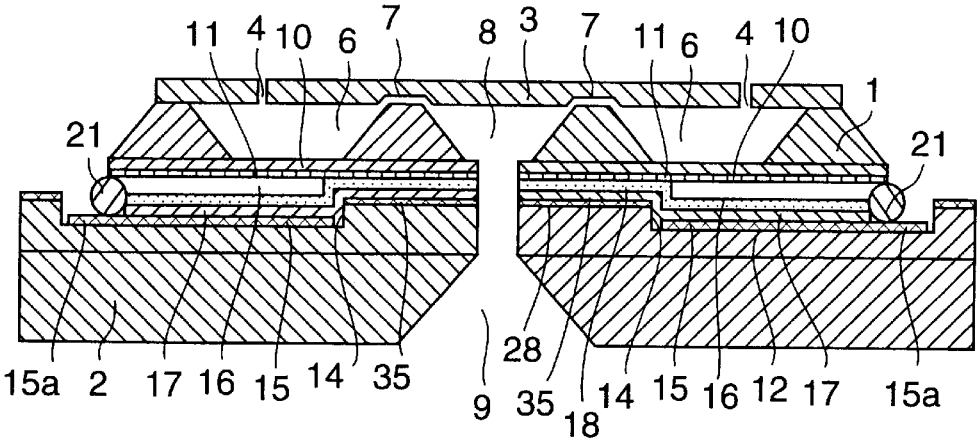
FIG. 64 is a longitudinal cross-sectional view of another preferred embodiment of the ink-jet head of the invention along a longitudinal line of an oscillation plate thereof.
Figure 65:
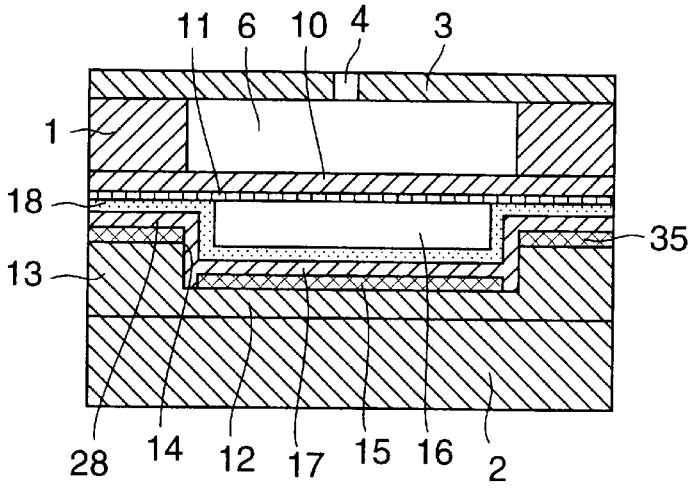
FIG. 65 is a transverse cross-sectional view of the ink-jet head of the present embodiment

Next, FIG. 64 is a longitudinal cross-sectional view of another preferred embodiment of the ink-jet head of the invention along a longitudinal line of an oscillation plate thereof. FIG. 65 is a transverse cross-sectional view of the ink-jet head of the present embodiment.

As shown, the ink-jet head of the present embodiment is configured by a combination of the FIG. 46 embodiment and the FIG. 62 embodiment. It is possible for the present embodiment to reduce the variations of the thickness of the silicon oxide layer 18 containing phosphorus and/or boron by the use of the dummy electrodes 35. In the present embodiment, the dummy electrodes 35 are configured to have a uniform width, and they are electrically isolated from the electrode 15.

Figure 66:
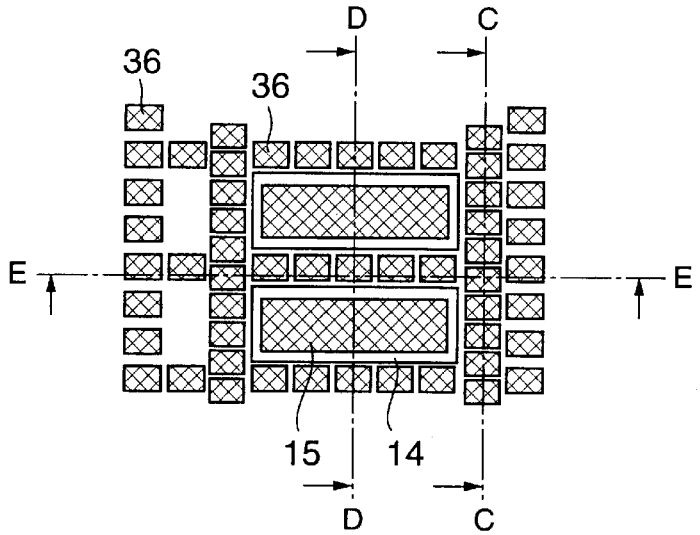
FIG. 66 is a top view of a pattern of dummy electrodes in another preferred embodiment of the ink-jet head of the invention.
Figure 67:
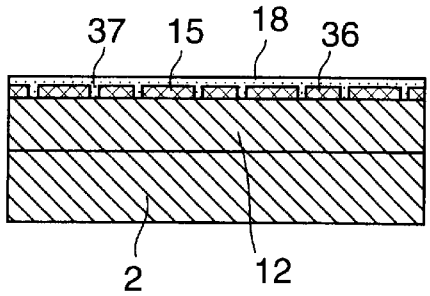
FIG. 67 is a cross-sectional view of the ink-jet head of the present embodiment along a line C—C indicated in FIG. 66.
Figure 68:
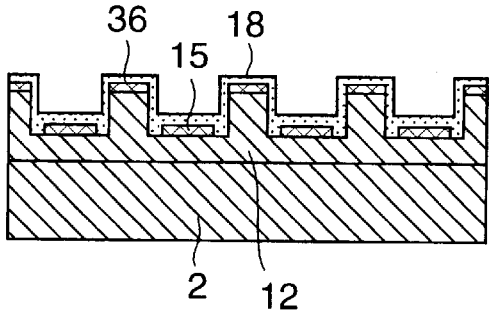
FIG. 68 is a cross-sectional view of the ink-jet head of the present embodiment along a line D—D indicated in FIG. 66.
Figure 69:
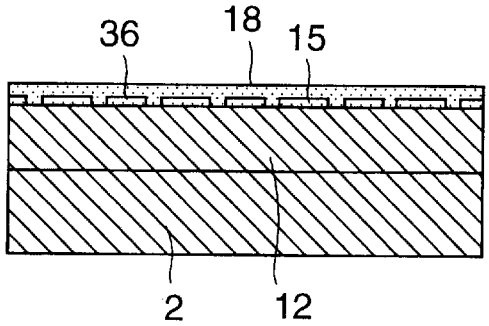
FIG. 69 is a cross-sectional view of the ink-jet head of the present embodiment along a line E—E indicated in FIG. 66.

Next, FIG. 66 is a top view of a pattern of dummy electrodes in another preferred embodiment of the ink-jet head of the invention. FIG. 67 is a cross-sectional view of the ink-jet head of the present embodiment along a line C—C indicated in FIG. 66. FIG. 68 is a cross-sectional view of the ink-jet head of the present embodiment along a line D—D indicated in FIG. 66. FIG. 69 is a cross-sectional view of the ink-jet head of the present embodiment along a line E—E indicated in FIG. 66.

As shown, the dummy electrode pattern includes a plurality of dummy electrodes 36 arranged in a lattice formation. By arranging the dummy electrodes 36 in this manner, it is possible to prevent the short circuiting of the connection of the electrode 15 and the driving circuit via the dummy electrodes. The clearance 37 between the dummy electrodes 36 must be set to be 0.5 $\mu$m or less. When the silicon oxide layer 18 containing phosphorus and/or boron is formed on the dummy electrodes 36, it is possible to provide a high level of flatness of the silicon oxide layer 18 by the setting of the clearance 37.

Figure 70:
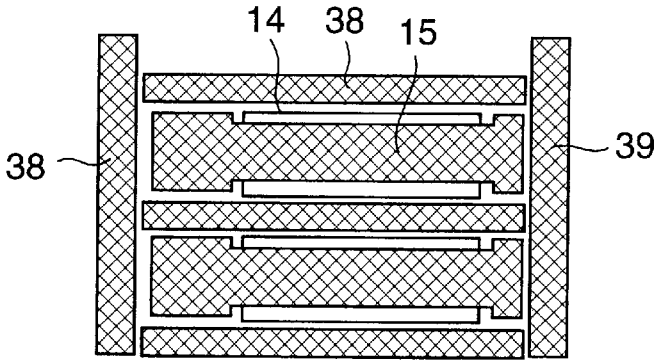
FIG. 70 is a top view of a pattern of dummy electrodes in another preferred embodiment of the ink-jet head of the invention.
Figure 71:
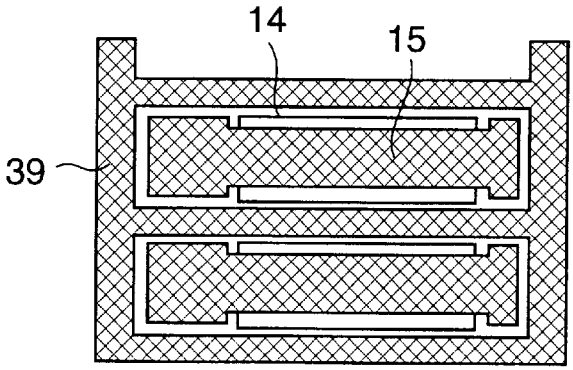
FIG. 71 is a top view of a pattern of dummy electrodes in another preferred embodiment of the ink-jet head of the invention.

Next, FIG. 70 is a top view of a pattern of dummy electrodes in another preferred embodiment of the ink-jet head of the invention. FIG. 71 is a top view of a pattern of dummy electrodes in another preferred embodiment of the ink-jet head of the invention.

In the embodiment of FIG. 70, the dummy electrode pattern includes a plurality of straight-line dummy electrodes 38 arranged in rows on the ink-jet head. In the embodiment of FIG. 71, the dummy electrode pattern includes a frame-like dummy electrode 39 in which the portions of the dummy electrode 39 are arranged in rows and columns. It is possible for the present embodiment to reduce the variations of the thickness of the silicon oxide layer 18 containing phosphorus and/or boron by the use of the dummy electrodes.

Figure 72:
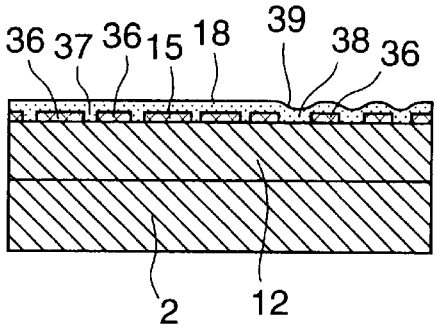
FIG. 72 is a longitudinal cross-sectional view of another preferred embodiment of the ink-jet head of the invention along a longitudinal line of an oscillation plate thereof.

Next, FIG. 72 is a longitudinal cross-sectional view of another preferred embodiment of the ink-jet head of the invention along a longitudinal line of an oscillation plate thereof.

As shown, in the ink-jet head of this embodiment, the dummy electrodes 36 are arranged at intervals of one of a first distance and a second distance. Namely, the clearance 37 between some electrodes 36 is smaller than the clearance 38 between other electrodes 36. After the silicon oxide layer 18 containing phosphorus and/or boron is formed thereon, the recess 39 is provided in the silicon oxide layer 18, as shown in FIG. 72, and the recess 39, after the first substrate 1 and the second substrate 2 are bonded together, forms an opening communicating with the gap 16 between the oscillation plate 10 and the electrode 15.

Figure 73:
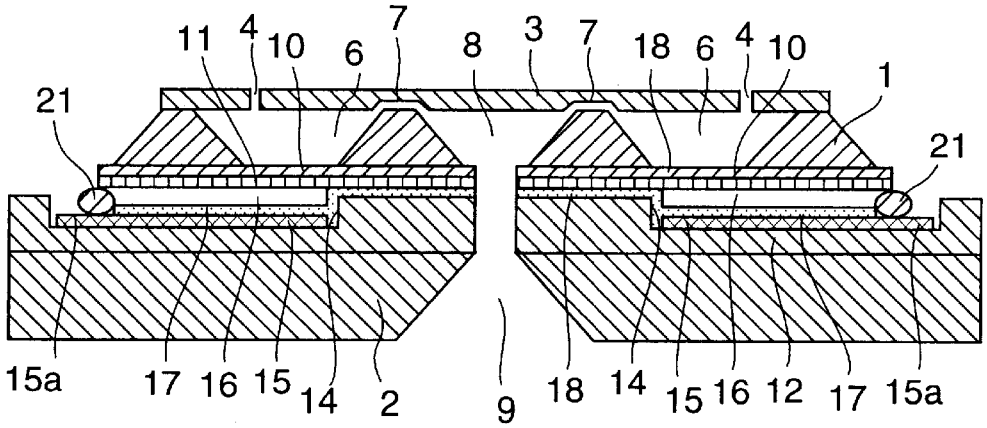
FIG. 73 is a longitudinal cross-sectional view of another preferred embodiment of the ink-jet head of the invention along a longitudinal line of an oscillation plate thereof.
Figure 74:
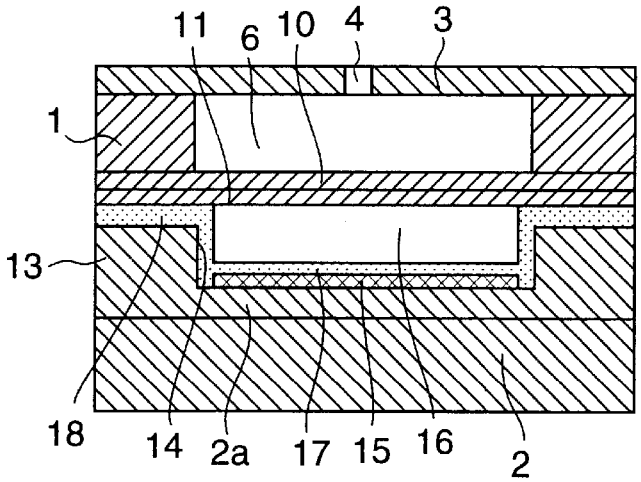
FIG. 74 is a transverse cross-sectional view of the ink-jet head of the present embodiment along a transverse line of the oscillation plate.

Next, FIG. 73 is a longitudinal cross-sectional view of another preferred embodiment of the ink-jet head of the invention along a longitudinal line of an oscillation plate thereof. FIG. 74 is a transverse cross-sectional view of the ink-jet head of the present embodiment along a transverse line of the oscillation plate.

As shown, in the ink-jet head of this embodiment, the silicon oxide layer 18 containing phosphorus and/or boron (the BSG film) is formed on the entire top surface of the electrode substrate 2 including the top surface of the electrode 15. Furthermore, the silicon oxide layer 18 containing phosphorus and/or boron (the BSG film) is formed on the bottom surface of the oscillation plate 10 of the ink-passage substrate 1. Hence, the protective layer (part of the silicon oxide layer 18) for protecting the oscillation plate 10 on the first substrate 1 and the protective layer (part of the silicon oxide layer 18) for protecting the electrode 15 on the second substrate 2 have the structure that is the same as the structure (in this case, the BSG film) of the silicon oxide layer 18. It is possible for the ink-jet head of the present embodiment to reliably prevent the short-circuiting of the electrode 15 and the oscillation plate 10.

Figure 75:
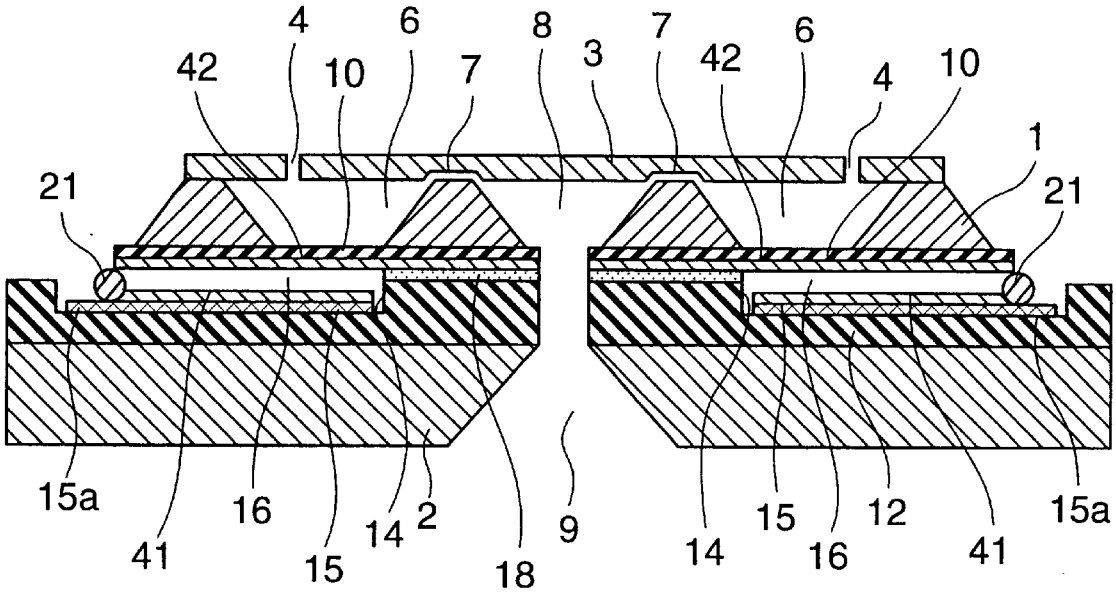
FIG. 75 is a longitudinal cross-sectional view of another preferred embodiment of the ink-jet head of the invention along a longitudinal line of an oscillation plate thereof.
Figure 76:
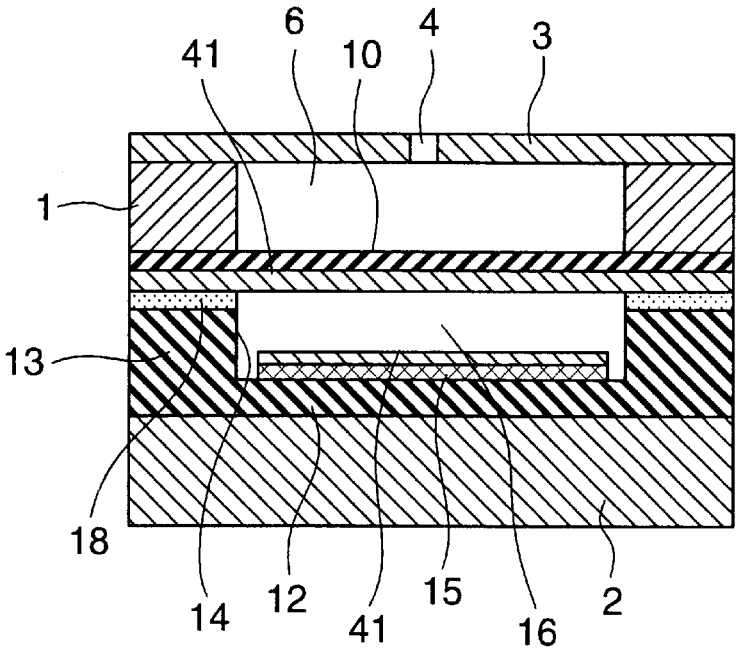
FIG. 76 is a transverse cross-sectional view of the ink-jet head of the present embodiment along a transverse line of the oscillation plate.

Next, FIG. 75 is a longitudinal cross-sectional view of another preferred embodiment of the ink-jet head of the invention along a longitudinal line of an oscillation plate thereof. FIG. 76 is a transverse cross-sectional view of the ink-jet head of the present embodiment along a transverse line of the oscillation plate.

As shown, in the ink-jet head of this embodiment, the silicon oxide layer 18 containing phosphorus and/or boron (the BSG film) is formed only on the spacer 13 on the electrode substrate 2. The source material of the electrode 15 in the present embodiment is silicon, and the silicon oxide layer 41 is formed on the surface of the electrode 15 by thermal oxidation of the silicon used in the electrode 15. Furthermore, the silicon oxide layer 42 is formed on the surface of the oscillation plate 10, facing the electrode 15 via the gap 16, by thermal oxidation of the silicon used in the ink-passage substrate 1. In the present embodiment, the silicon oxide layer 18 containing phosphorus and/or boron (the BSG film) is not formed on the electrode 15, and it is possible to increase the reliability of electrical connection of the ink-jet head, and to reliably prevent the short-circuiting of the electrode 15 and the oscillation plate 10 by the use of the silicon oxide layers 41 and 42.

Figure 77:
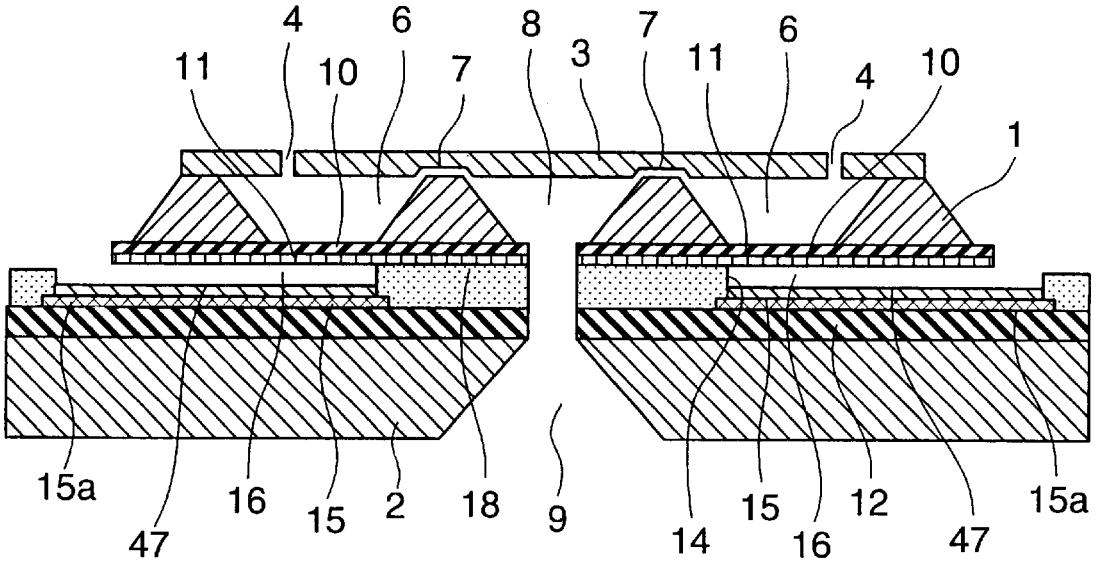
FIG. 77 is a longitudinal cross-sectional view of another preferred embodiment of the ink-jet head of the invention along a longitudinal line of an oscillation plate thereof.
Figure 78:
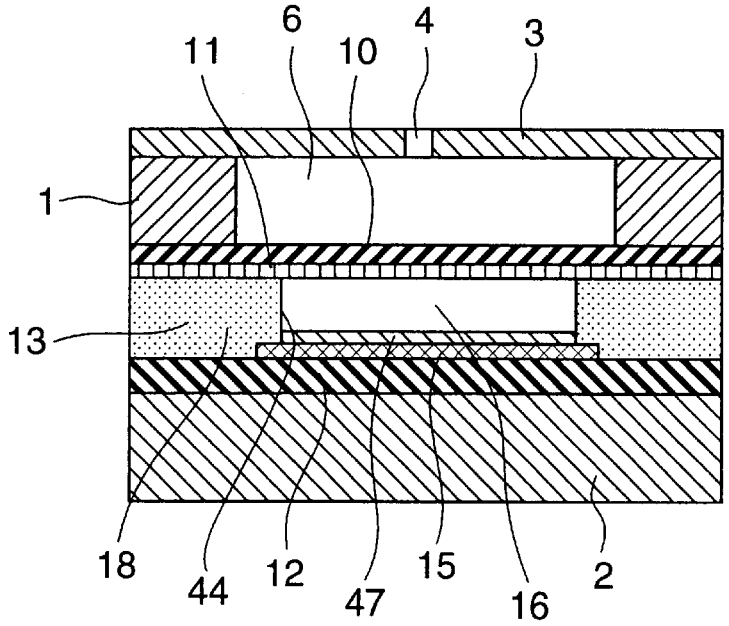
FIG. 78 is a transverse cross-sectional view of the ink-jet head of the present embodiment along a transverse line of the oscillation plate.

Next, FIG. 77 is a longitudinal cross-sectional view of another preferred embodiment of the ink-jet head of the invention along a longitudinal line of an oscillation plate thereof. FIG. 78 is a transverse cross-sectional view of the ink-jet head of the present embodiment along a transverse line of the oscillation plate.

As shown, in the ink-jet head of this embodiment, the surface of the silicon oxide film 12 on the electrode substrate 2 is flattened, and the electrode 15 is formed on the flat surface of the silicon oxide film 12. Furthermore, the silicon oxide layer 18 containing phosphorus and/or boron (in this case, the BPSG film) is formed as shown in FIG. 78, and the opening 44 is formed in the silicon oxide layer 18 so that the gap 16 and the spacer 13 can be provided. The electrode protecting film 47, such as a film of titanium nitride, is provided on the surface of the electrode 15. In the present embodiment, the entire spacer 13 is formed by the silicon oxide layer 18 containing phosphorus and/or boron (the BSG film), and it is possible to provide accurate dimensions of the gap 16 between the oscillation plate 10 on the first substrate 1 and the electrode 15 on the second substrate 2. When the titanium nitride film is used as the electrode protecting film 47, it is possible to provide a lowered driving voltage with which the electrode 15 can actuate the oscillation plate 10 in the ink-jet head.

Figure 79:
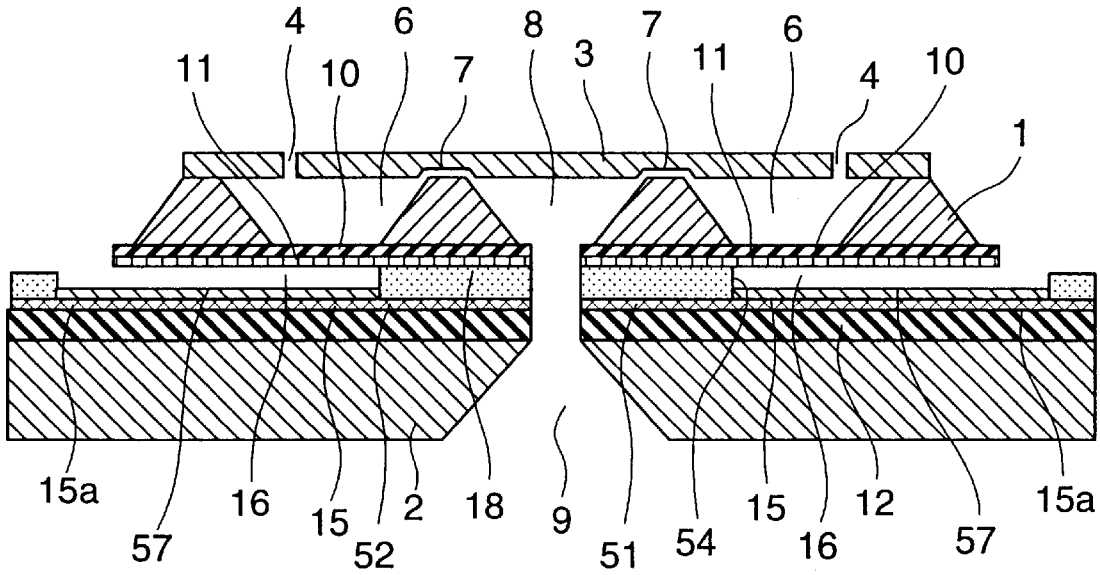
FIG. 79 is a longitudinal cross-sectional view of another preferred embodiment of the ink-jet head of the invention along a longitudinal line of an oscillation plate thereof.
Figure 80:
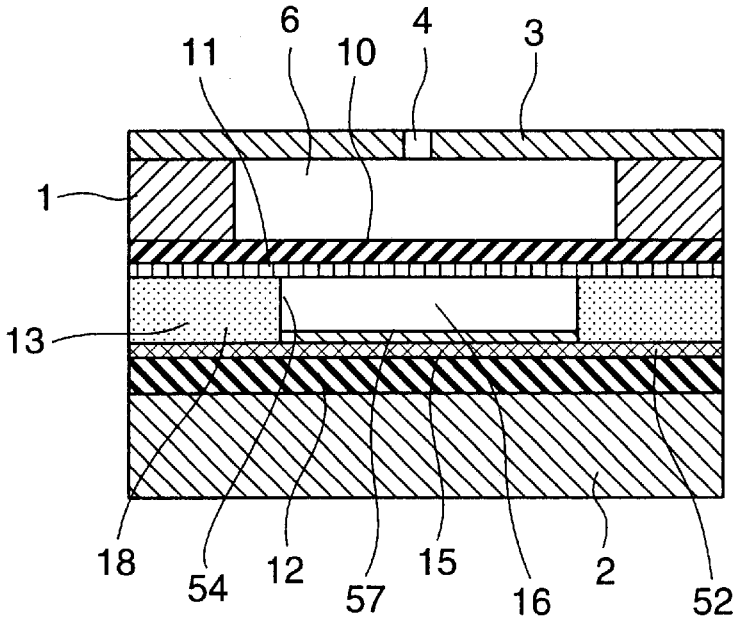
FIG. 80 is a transverse cross-sectional view of the ink-jet head of the present embodiment along a transverse line of the oscillation plate.

Next, FIG. 79 is a longitudinal cross-sectional view of another preferred embodiment of the ink-jet head of the invention along a longitudinal line of an oscillation plate thereof. FIG. 80 is a transverse cross-sectional view of the ink-jet head of the present embodiment along a transverse line of the oscillation plate.

As shown, in the ink-jet head of this embodiment, the surface of the silicon oxide film 12 on the electrode substrate 2 is flattened, and the electrode 15 and the dummy electrode 51 are formed on the flat surface of the silicon oxide film 12. The silicon oxide layer 52 containing no dopant (in this case, the SOG film) is provided in the intermediate portion between the electrode 15 and the dummy electrode 51. Furthermore, the silicon oxide layer 18 containing phosphorus and/or boron (in this case, the BPSG film) is formed as shown in FIG. 80, and the opening 54 is formed in the silicon oxide layer 18 so that the gap 16 and the spacer 13 can be provided. The electrode protecting film 57, such as a film of titanium nitride, is provided on the surface of the electrode 15. In the present embodiment, the entire spacer 13 is formed by the silicon oxide layer 18 containing phosphorus and/or boron (the BSG film), and it is possible to provide accurate dimensions of the gap 16 between the oscillation plate 10 on the first substrate 1 and the electrode 15 on the second substrate 2. When the titanium nitride film is used as the electrode protecting film 57, it is possible to provide a lowered driving voltage with which the electrode 15 can actuate the oscillation plate 10 in the ink-jet head.

Figure 81:
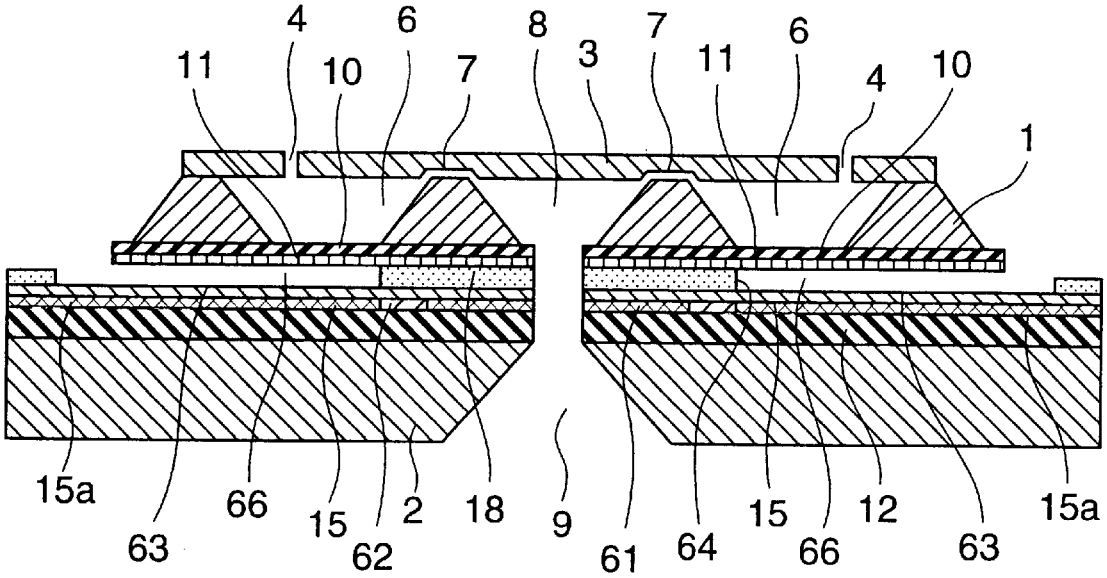
FIG. 81 is a longitudinal cross-sectional view of another preferred embodiment of the ink-jet head of the invention along a longitudinal line of an oscillation plate thereof.
Figure 82:
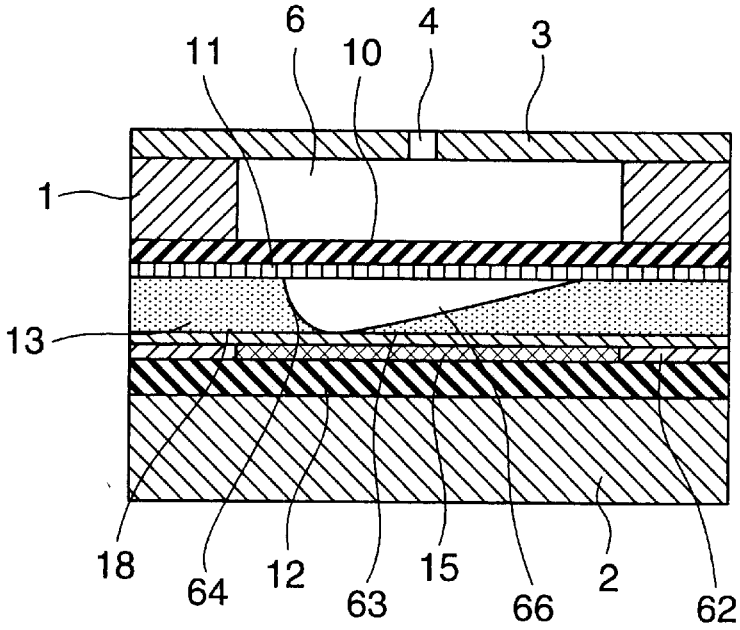
FIG. 82 is a transverse cross-sectional view of the ink-jet head of the present embodiment along a transverse line of the oscillation plate.

Next, FIG. 81 is a longitudinal cross-sectional view of another preferred embodiment of the ink-jet head of the invention along a longitudinal line of an oscillation plate thereof. FIG. 82 is a transverse cross-sectional view of the ink-jet head of the present embodiment along a transverse line of the oscillation plate.

As shown, in the ink-jet head of this embodiment, the surface of the silicon oxide film 12 on the electrode substrate 2 is flattened, and the electrode 15 and the dummy electrode 61, which are made of a polysilicon film, are formed on the flat surface of the silicon oxide film 12. The silicon oxide layer 62 containing no dopant (in this case, the SOG film) is provided in the intermediate portion between the electrode 15 and the dummy electrode 61, and the silicon oxide layer 63 containing no dopant (in this case, the NSG film) is provided on the silicon oxide layer 62. Furthermore, the silicon oxide layer 18 containing phosphorus and/or boron (in this case, the BPSG film) is formed on the silicon oxide layer 63, and the recessed portion 64 is formed in the silicon oxide layer 18 so that the non-parallel type gap 66 (in which the oscillation plate 10 and the electrode 15 are not parallel in the transverse direction of the oscillation plate) and the spacer 13 can be provided. In the present embodiment, the electrode 15 is made of a polysilicon film. The dummy electrode 61 is provided, and it is possible to obtain the desired level of accuracy of the flatness of the silicon oxide layer 12 on the electrode substrate 2.

Next, a description will be given of a production method of the ink-jet head according to the present invention.

Figure 83A:
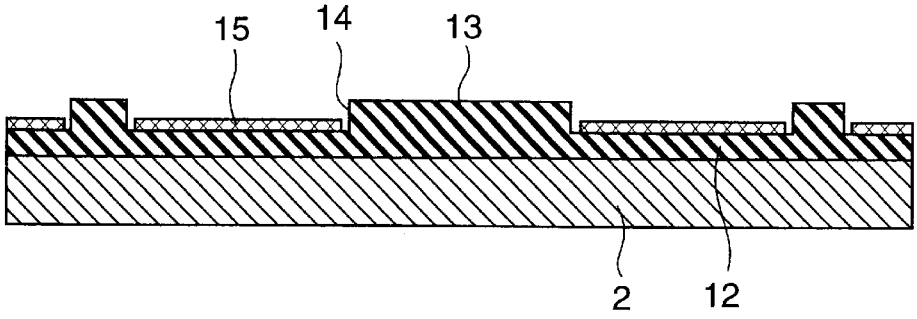
FIG. 83A, FIG. 83B, FIG. 83C and FIG. 83D are diagrams for explaining another embodiment of the production method of the ink-jet head according to the invention.
Figure 84A:
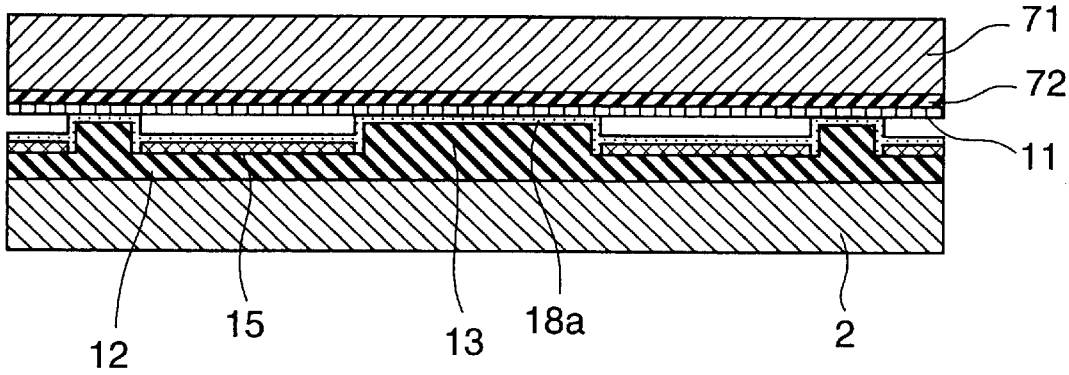
FIG. 84A, FIG. 84B and FIG. 84C are diagrams for explaining subsequent steps following the production step shown in FIG. 83D.
Figure 84B:
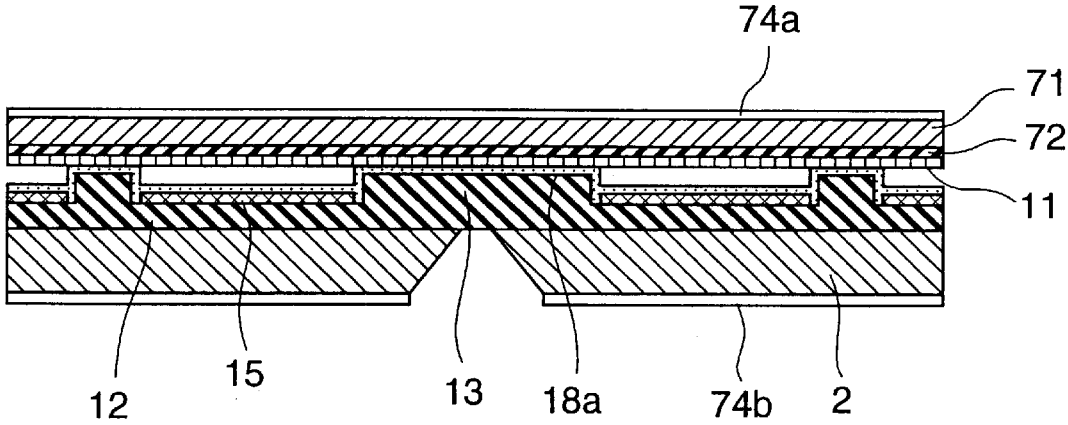
Figure 84C:
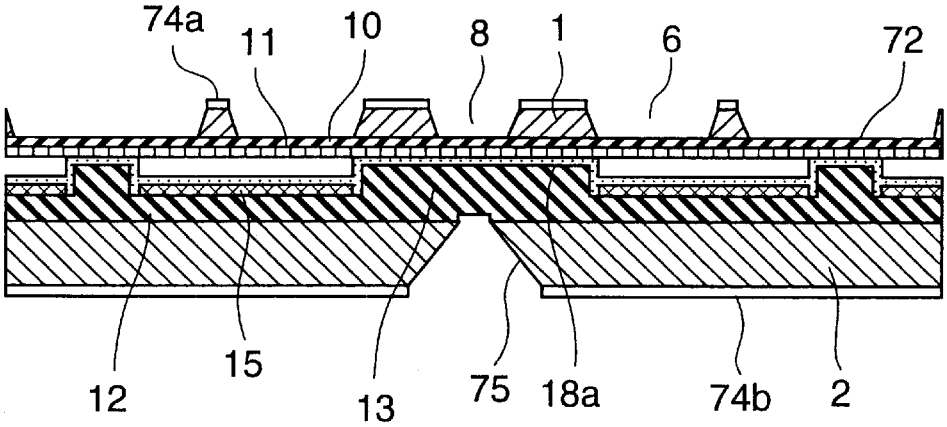
Figure 85A:
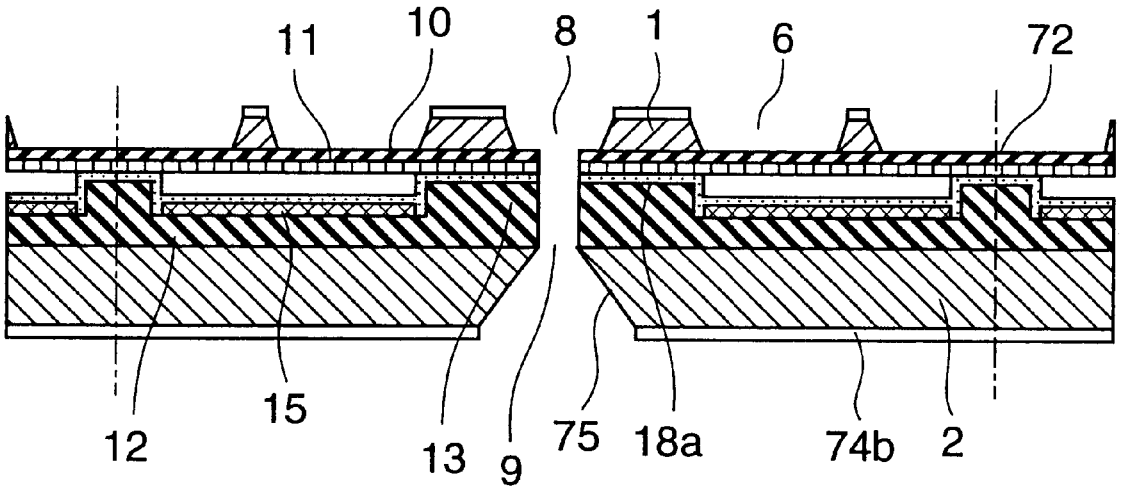
FIG. 85A and FIG. 85B are diagrams for explaining subsequent steps following the production step shown in FIG. 84C.
Figure 85B:
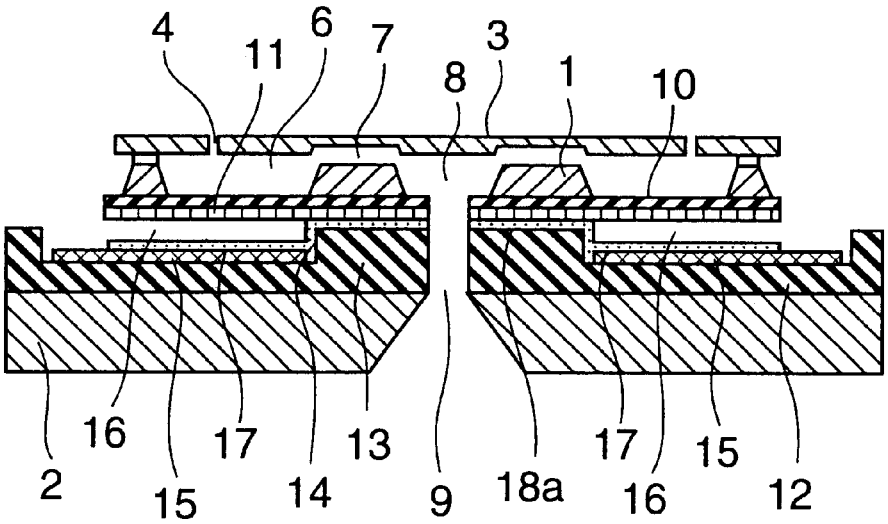

FIG. 83A, FIG. 83B, FIG. 83C and FIG. 83D are diagrams for explaining another embodiment of the production method of the ink-jet head according to the invention. FIG. 84A, FIG. 84B and FIG. 84C are diagrams for explaining subsequent steps following the production step shown in FIG. 83D. FIG. 85A and FIG. 85B are diagrams for explaining subsequent steps following the production step shown in FIG. 84C.

First, a description will be provided of the production method of the electrode substrate 2. As shown in FIG. 83A, by performing a dry or wet thermal oxidation method, the thermal oxidation film 12 having a thickness about 2 $\mu$m is formed on a surface of the source electrode substrate 2 that is a silicon substrate (the second substrate) having a thickness 625 $\mu$m and being in the crystal orientation <100>.

The photo-resist is applied to the electrode substrate 2 after the oxidation layer 12 is formed thereon. The patterning is performed to form the recessed portion 14, and the recessed portion 14 is formed in order to provide the electrode 15 and the spacer 13. The photo-resist pattern is used as the mask, and the oxidation layer 12 is etched by using a solution of hydrofluoric acid including ammonium fluoride as the buffer component (e.g., BHF-63U from Daikin Kogyo Co., Ltd.). Hence, the recessed portion 14 is formed.

The depth of the etching in the present embodiment that includes the thickness of the electrode and the internal space needed to form the gap between the oscillation plate and the electrode is very small (about 1 $\mu$m), and variations of the depth of the etching will be negligible.

Further, a pattern of titanium nitride having a thickness about 300 nm is formed on the bottom of the recessed portion 14 of the thermal oxidation film 12 in the electrode substrate 2 through reactive sputtering. The patterning of the electrodes 15 is performed through photolithography and dry etching, and the electrodes 15 are formed. A silicon oxide film is produced by chemical vapor deposition (CVD), and photolithography and dry etching is conducted so that a pattern of the insulating layer 17 is formed so as to cover the electrodes 15 with the silicon oxide film.

Figure 83B:
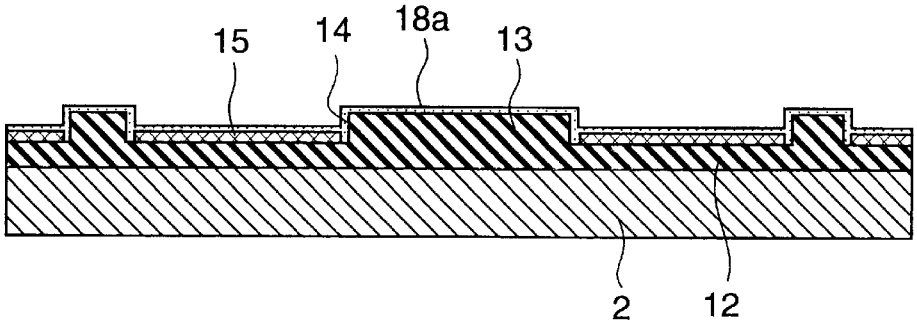

As shown in FIG. 83B, the silicon oxide layer 18*a* containing boron (the BSG film), which has a thickness about 100 nm, is formed on the entire surface of the electrode substrate 2 including the surface of the electrode 15 by performing the CVD process. The BSG film 18*a* serves to protect the electrode 15 and to prevent the oxidation of the electrode 15. The film forming conditions are set such that the BSG film 18*a* contains 4.0% boron.

Figure 83C:
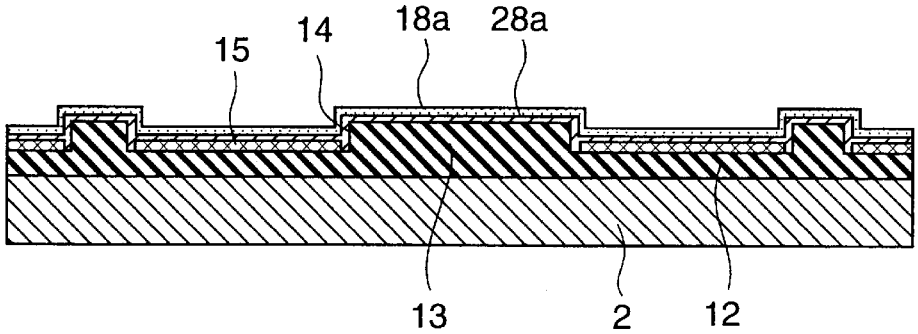

Alternatively, as shown in FIG. 83C, the NSG film 28*a* is deposited on the entire surface of the electrode substrate 2 including the surface of the electrode 15, and the BSG film 18*a* is formed on the surface of the NSG film 28*a*. The silicon oxide layer 18 of this embodiment has a two-layer structure including the NSG film 28*a* and the BSG film 18*a* as described earlier. Alternatively, the silicon oxide layer 18 of this embodiment may have a three-layer structure including the NSG film 28*a,* the BPSG film 18*b* and the BSG film 18*a*.

As described above, it is important that the spacer 13 has the silicon oxide layer 18 that is provided to have a lowered melting point that allows the bonding of the first and second substrates 1 and 2 at a temperature lower than 1000 deg. C.

The above silicon wafer (the electrode substrate 2) is subjected to heat treatment in a nitrogen gas atmosphere. The temperature and time of the heat treatment are 950 deg. C. and 2 hours. This temperature is higher than the temperature at which the re-flow characteristics of the silicon oxide layer occurs. During the heat treatment, the moisture or the hydrogen gas contained in the silicon oxide layer is discharged, and the occurrence of the void will be prevented. The re-flow of the surface of the silicon oxide layer occurs, and the surface roughness of the silicon oxide layer is reduced from the initial Ta value in a range of 1 to 3 nm to the Ra value in a range of 0.1 to 0.2 nm. It is possible to provide good adhesion of the bonding of the first and second substrates 1 and 2 through the silicon oxide layer of this embodiment.

Figure 83D:
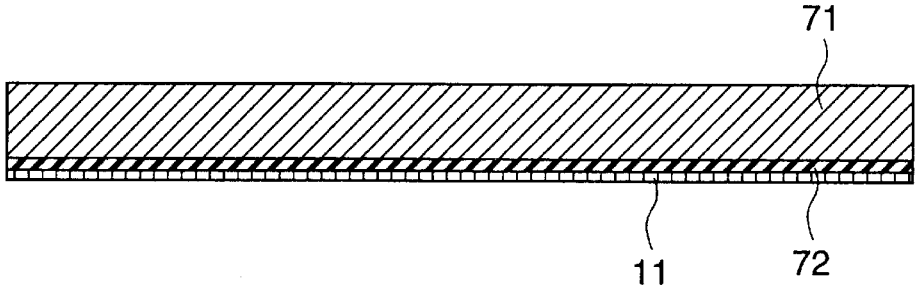

Next, a description will be given of the production method of the ink-passage substrate 1. As shown in FIG. 83D, the source ink-passage substrate 71 that is a p-type single-crystal silicon substrate (the first substrate) having a thickness about 500 $\mu$m and being in the crystal orientation <110> is used. The top and bottom surfaces of the source ink-passage substrate 71 are polished. On the bottom surface of the ink-passage substrate 71 where the first and second substrates 71 and 2 are bonded together, a boron diffusion layer 72 including a high concentration of boron ($5\times10^{19}$ atoms/cm$^3$ or above) is formed to provide the oscillation plate 10. The boron diffusion layer 72 is activated, and boron is diffused to the desired depth needed to form the oscillation plate 10.

In the present embodiment, the silicon substrate containing the boron diffusion layer 72 is used. Alternatively, a SOI (silicon-on-insulator) substrate in which a base silicon substrate and an activation layer substrate are bonded via a silicon dioxide layer, may be used, and the activation layer substrate may be configured into the oscillation plate 72.

As shown in FIG. 84A, the first substrate 71 (which becomes the ink-passage substrate 1) and the second substrate 2 (which becomes the electrode substrate 2) are bonded via the silicon oxide layer 18. In the present embodiment, the first and second substrates 71 and 2 are subjected to RCA cleaning. After the RCA cleaning is performed, the first and second substrates 71 and 2 are immersed in a heated mixture of sulfuric acid and hydrogen peroxide, so that the bonding surfaces of the first and second substrates 71 and 2 are hydrophilic. After the immersion is performed, the alignment of the first and second substrates 71 and 2 is performed and the bonding of the first and second substrates 71 and 2 via the silicon oxide layer 18 is performed. In order to obtain good adhesion of the first and second substrates 71 and 2, they are heated in a nitrogen atmosphere at 900 deg. C. for 2 hours, so that the ink-passage substrate 71 is bonded to the electrode substrate 2 via the silicon oxide layer 18.

As shown in FIG. 84B, after the above process is performed, the silicon substrate 71 is subjected to polishing, chemical-mechanical polishing (CMP) or the like, so that the thickness of the substrate 71 is reduced. During the polishing, the bonding areas of the first and second substrates are not separated or broken. The initial thickness of the source silicon substrate 71 is about 400 $\mu$m, and after the polishing is done, the thickness of the silicon substrate 71 is reduced and the height of the discharging chamber is about 95±5 $\mu$m. In a case in which the initial thickness of the source silicon substrate 71 is used without change, the polishing process is unneeded.

The bonded substrates 71 and 2 are heated in an oxidation atmosphere so that the thickness of the buffer oxidation layer is set to about 50 nm. Further, the silicon nitride layers 74*a* and 74*b* are formed through the CVD process, so that the thickness of the silicon nitride layers is set at about 100 nm.

As shown in FIG. 84C, by using the photo-etching method, the patterning is performed to form the discharging chamber and others. The photo-resist film is used as the mask, and the silicon nitride layers 74*a* and 74*b* and the buffer silicon oxide film are etched. The recessed portion for providing the discharging chamber and the oscillation plate is formed in the silicon substrate 71. Further, the recessed portion for providing the ink supply hole 9 is formed in the electrode substrate 2.

In the present embodiment, the silicon substrate 71 is thermally treated, and the buffer silicon oxide film having a thickness about 50 nm is formed through the CVD process. In addition, the silicon nitride film (which becomes the etching barrier layer in the subsequent process) having a thickness about 100 nm is formed. By performing the photo-etching process, a pattern of the discharging chamber is produced. The photo-resist film is used as the mask, and the silicon nitride film and the silicon oxide film are etched so that the pattern of the discharging chamber is formed on the silicon substrate 71.

The silicon substrates 71 and 2 are immersed in a 10% KOH (potassium hydroxide) solution at a temperature 90 deg. C., and the silicon substrates 71 and 2 are subjected to anisotropic etching, so that the recessed portion for providing the discharging chamber 6 and the common ink chamber 8 is formed in the silicon substrate 71. When the etchant reaches the high-concentration boron diffusion layer 72, the rate of the etching is extremely reduced and the etching is stopped. Further, the grooved portion 75 for providing the ink supply opening 9 is formed in the electrode substrate 2. After the wet etching is performed, the silicon substrates 71 and 2 are rinsed with pure water for ten minutes or more. After the rinsing is performed, the silicon substrates 71 and 2 are subjected to spin drying.

As shown in FIG. 85A, the oxidation layer 12 of the grooved portion 75 is etched by using a hydrofluoric acid or the like, so that the ink supply opening 9 is formed. The silicon nitride layers 74*a* and 74*b* are removed by performing a dry or wet etching process. Alternatively, the removal of the silicon nitride layers 74*a* and 74*b* may be unneeded in some case.

The silicon wafer is cut into chips of the ink-jet head along the dotted lines indicated FIG. 85A by using the dicing device. After this, the boron diffusion layer 72 on the ink-passage substrate 1 corresponding to the ink supply opening 9 is removed from the electrode substrate 2 by performing a dry etching process, and the ink supply opening 9 is formed.

As shown in FIG. 85B, a metal mask is placed to protect the discharging chamber 6 and the common ink chamber 8 from the electrode substrate 2. The boron diffusion layer 72 on the electrode pad 15*a* and the silicon oxide layer 18 on the electrode 15 are removed by performing the dry etching process, so that the insulating layer 17 is formed.

Finally, the nozzle plate 3 in which the nozzle 4 and the fluid resistance portion 7 are formed is bonded to the ink-passage substrate 1 by using an epoxy-based adhesive agent. Hence, the production of the ink-jest head of the present embodiment.

Figure 87A:
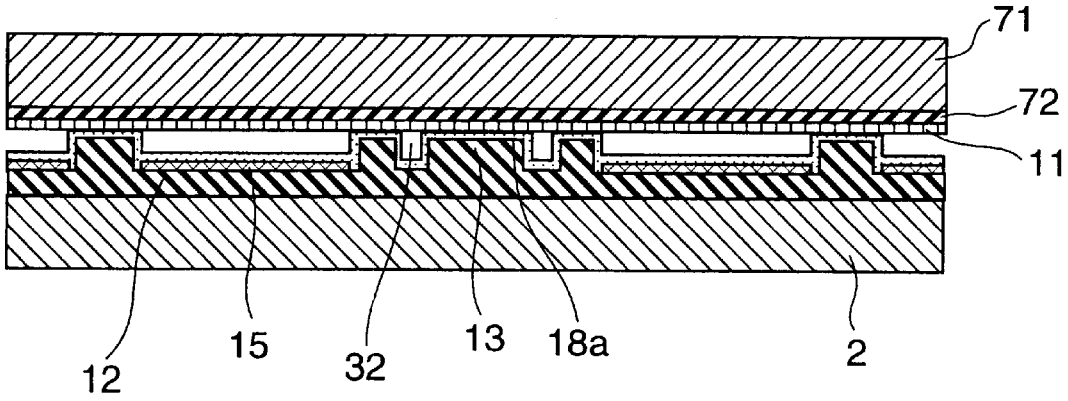
FIG. 87A, FIG. 87B and FIG. 87C are diagrams for explaining subsequent steps following the production step shown in FIG. 86D.
Figure 87B:
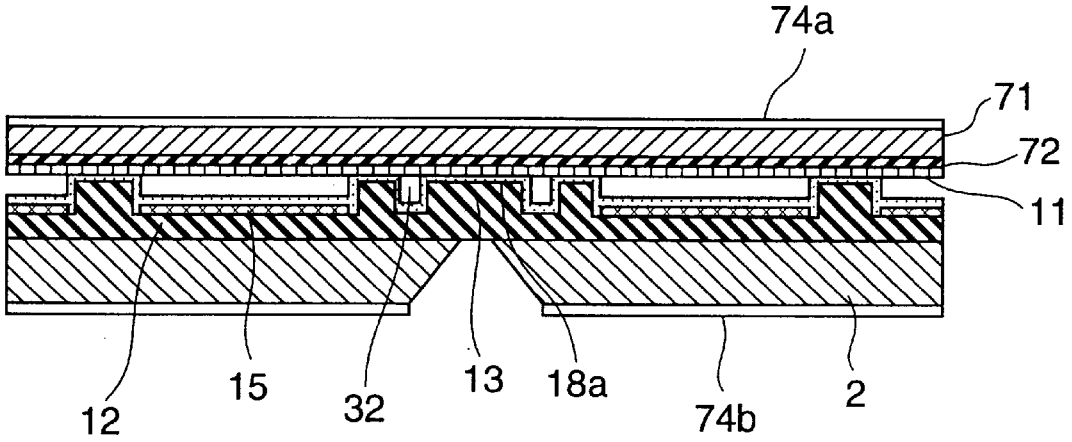
Figure 87C:
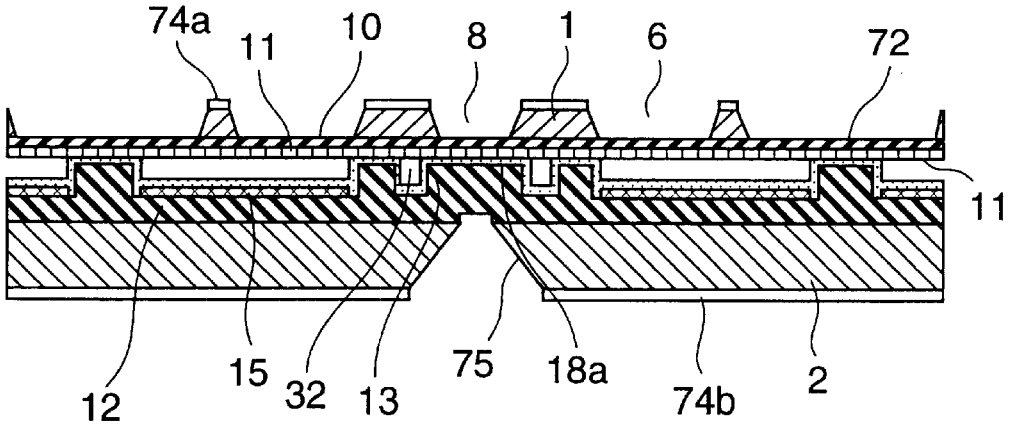
Figure 88A:
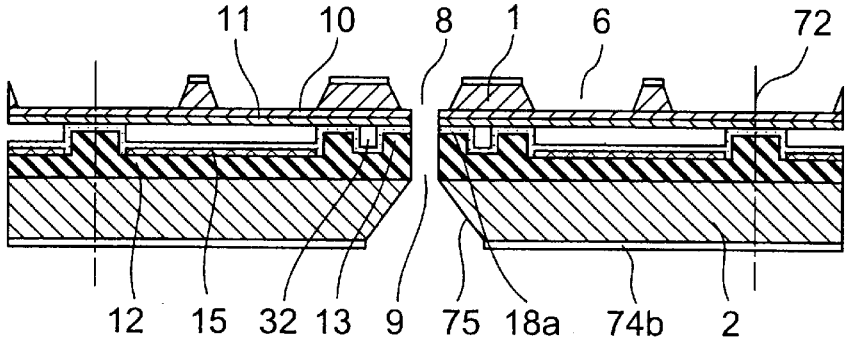
FIG. 88A and FIG. 88B are diagrams for explaining subsequent steps following the production step shown in FIG. 87C.
Figure 88B:
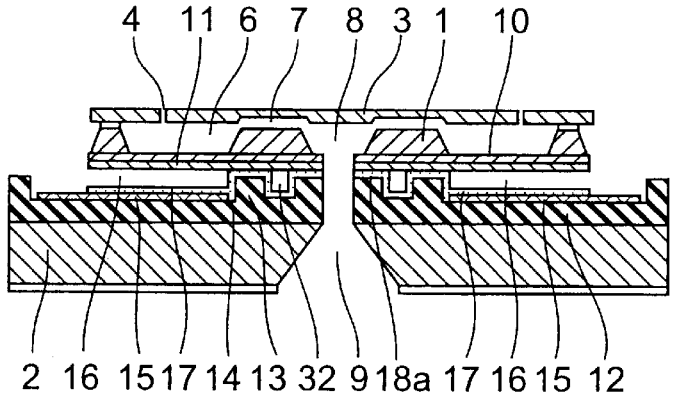

Next, FIG. 86A, FIG. 86B, FIG. 86C and FIG. 86D are diagrams for explaining a production method of the ink-jet head of the FIG. 53 embodiment or the FIG. 56 embodiment. FIG. 87A, FIG. 87B and FIG. 87C are diagrams for explaining subsequent steps following the production step shown in FIG. 86D. FIG. 88A and FIG. 88B are diagrams for explaining subsequent steps following the production step shown in FIG. 87C.

Figure 86A:
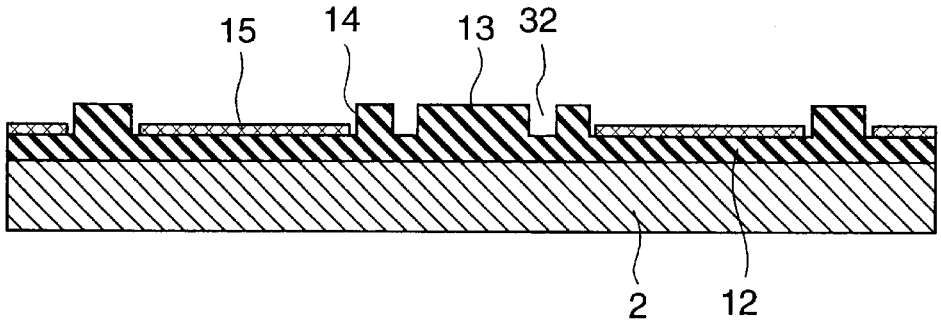
FIG. 86A, FIG. 86B, FIG. 86C and FIG. 86D are diagrams for explaining another embodiment of the production method of the ink-jet head according to the invention.
Figure 86B:
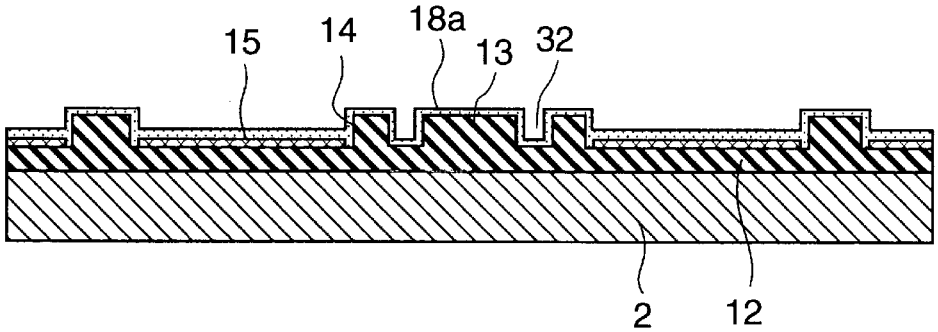
Figure 86C:
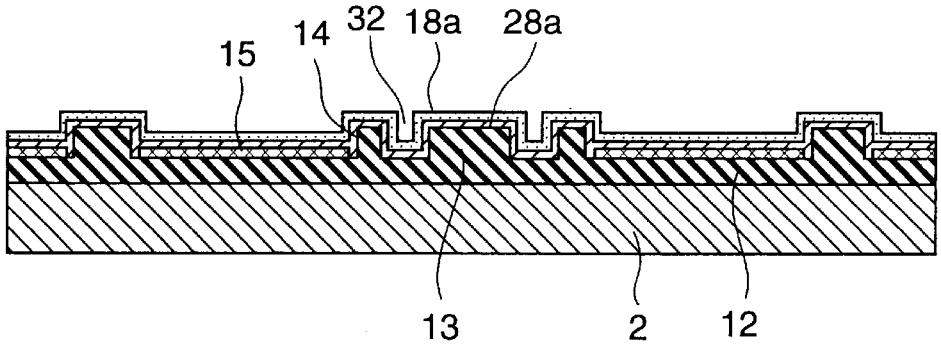
Figure 86D:
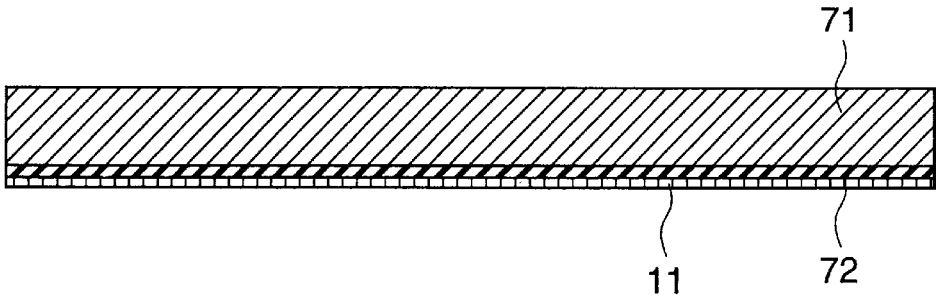

As shown in FIG. 86A, in the production method of the ink-jet head of the present embodiment, by performing a dry or wet thermal oxidation method, the thermal oxidation film 12 having a thickness about 2 μm is formed on a surface of the source electrode substrate 2 that is a silicon substrate (the second substrate) having a thickness 625 μm and being in the crystal orientation <100>.

The photo-resist is applied to the electrode substrate 2 after the oxidation layer 12 is formed thereon. The patterning is performed to form the recessed portion 14, and the recessed portion 14 is formed in order to provide the electrode 15 and the spacer 13. The photo-resist pattern is used as the mask, and the oxidation layer 12 is etched by using a solution of hydrofluoric acid including ammonium fluoride as the buffer component. The recessed portion 14 and the dummy grooves 31 and 32 are formed in the oxidation layer 12. The indication of the dummy groove 31 is omitted in FIG. 86A.

Other steps of the production method of the present embodiment that are shown in FIG. 86B through FIG. 88B are essentially the same as the corresponding steps of the previous embodiment that are shown in FIG. 83B through the FIG. 85B, and a description thereof will be omitted.

Figure 89A:
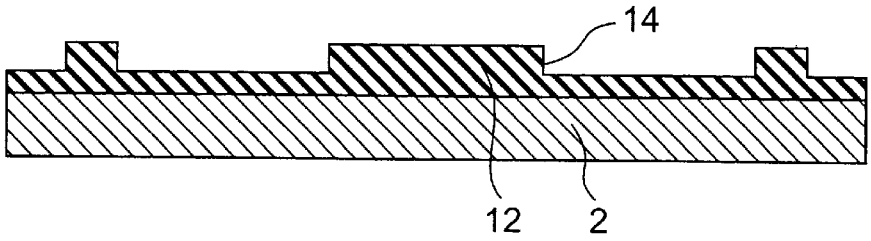
FIG. 89A, FIG. 89B and FIG. 89C are diagrams for explaining another embodiment of the production method of the ink-jet head according to the invention.
Figure 89B:
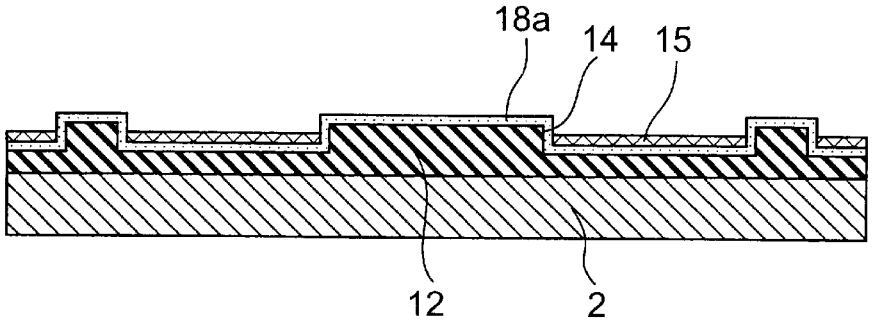
Figure 89C:
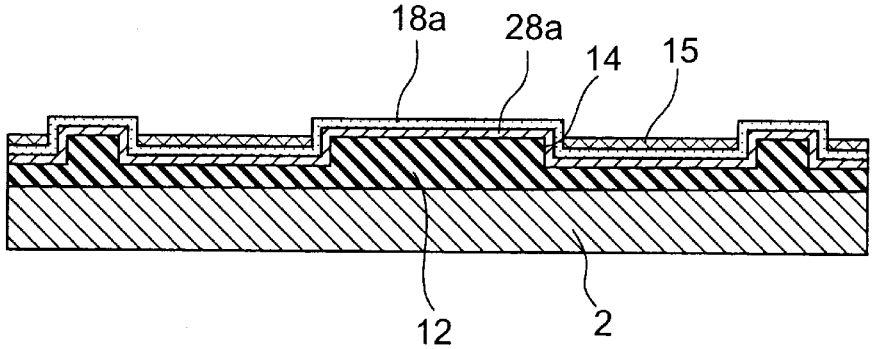

Next, FIG. 89A, FIG. 89B and FIG. 89C are diagrams for explaining another embodiment of the production method of the ink-jet head of the FIG. 58 embodiment or the FIG. 59 embodiment.

As shown in FIG. 89A, in the production method of the ink-jet head of the present embodiment, by performing a dry or wet thermal oxidation method, the thermal oxidation film 12 having a thickness about 2 μm is formed on a surface of the source electrode substrate 2 that is a silicon substrate (the second substrate) having a thickness 625 μm and being in the crystal orientation <100>.

The photo-resist is applied to the electrode substrate 2 after the oxidation layer 12 is formed thereon. The patterning is performed to form the recessed portion 14, and the recessed portion 14 is formed in order to provide the electrode 15 and the spacer 13. The photo-resist pattern is used as the mask, and the oxidation layer 12 is etched by using a solution of hydrofluoric acid including ammonium fluoride as the buffer component. The recessed portion 14 is formed in the oxidation layer 12.

In the ink-jet head of the FIG. 58 embodiment, as shown in FIG. 89B, the BSG film 18*a* is formed on the entire surface of electrode substrate 2, and the electrode 15 is formed on the BSG film 18*a* at the bottom of the recessed portion 14 in the oxidation layer 12.

In the ink-jet head of the FIG. 59 embodiment, as shown in FIG. 89C, the NSG film 28*a* is formed on the entire surface of electrode substrate 2, the BSG film 18*a* is formed on the entire surface of the NSG film 28*a,* and the electrode 15 is formed on the BSG film 18*a* at the bottom of the recessed portion 14 in the oxidation layer 12.

Next, FIG. 90A, FIG. 90B, FIG. 90C and FIG. 90D are diagrams for explaining a production method of the ink-jet head of the FIG. 60 embodiment.

Figure 90A:
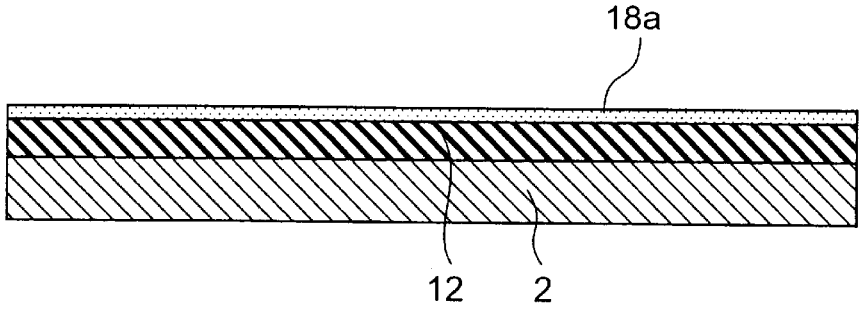
FIG. 90A, FIG. 90B, FIG. 90C and FIG. 90D are diagrams for explaining another embodiment of the production method of the ink-jet head according to the invention.

As shown in FIG. 90A, in the production method of the ink-jet head of the present embodiment, by performing a dry or wet thermal oxidation method, the thermal oxidation film 12 having a thickness about 2 μm is formed on a surface of the source electrode substrate 2 that is a silicon substrate (the second substrate) having a thickness 625 μm and being in the crystal orientation <100>. Further, the BSG film 18*a* is formed on the entire surface of the oxidation layer 12.

Figure 90B:
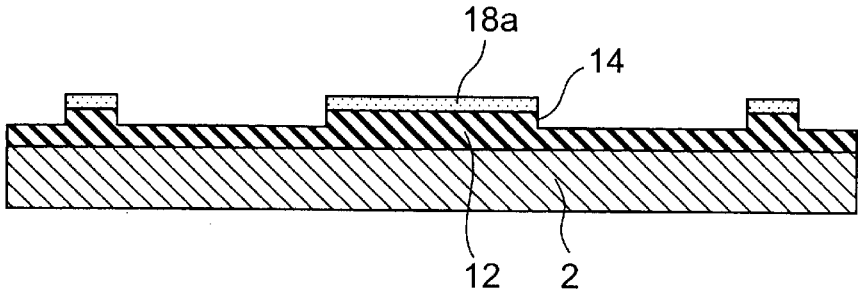

As shown in FIG. 90B, the photo-resist is applied to the BSG film 18*a* on the oxidation layer 12. The patterning is performed to form the recessed portion 14, and the recessed portion 14 is formed in order to provide the electrode 15 and the spacer 13. The photo-resist pattern is used as the mask, and the oxidation layer 12 is etched by using a solution of hydrofluoric acid including ammonium fluoride as the buffer component. The recessed portion 14 is formed in the oxidation layer 12 and the BSG film 18*a*.

Figure 90C:
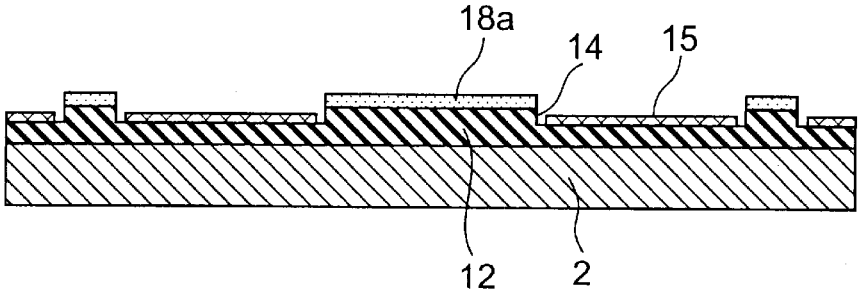
Figure 90D:
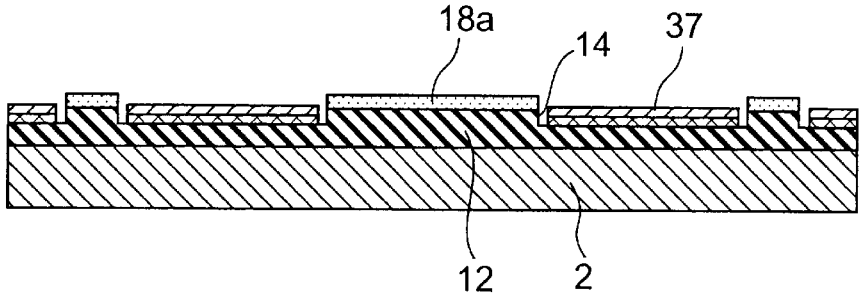

As shown in FIG. 90C, the electrode 15 is formed on the BSG film 18*a* at the bottom of the recessed portion 14 in the oxidation layer 12. As shown in FIG. 90D, the protective layer 37 is formed on the surface of the electrode 15.

Figure 91A:
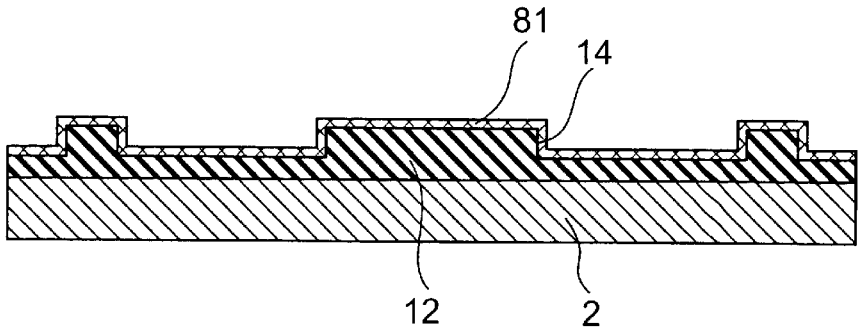
FIG. 91A, FIG. 91B and FIG. 91C are diagrams for explaining another embodiment of the production method of the ink-jet head according to the invention.
Figure 91B:
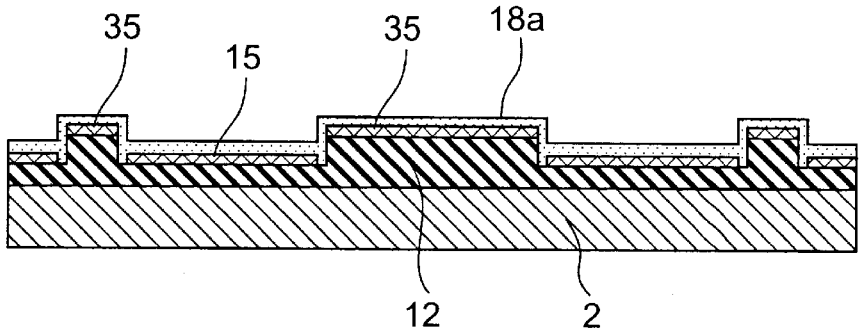
Figure 91C:
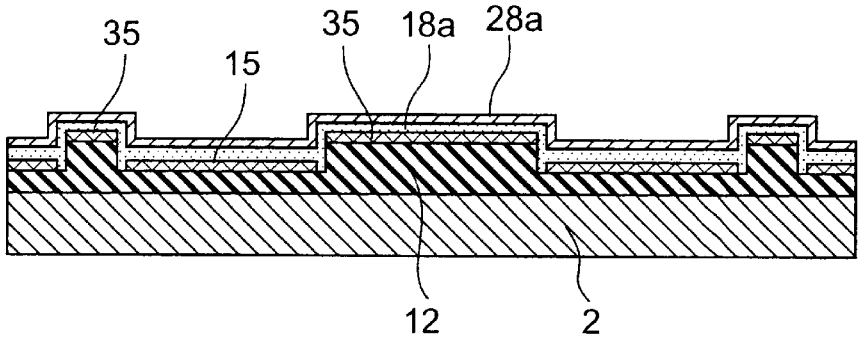

Next, FIG. 91A, FIG. 91B and FIG. 91C are diagrams for explaining a production method of the ink-jet head of the FIG. 62 embodiment or the FIG. 64 embodiment.

As shown in FIG. 91A, in the production method of the ink-jet head of the present embodiment, by performing a dry or wet thermal oxidation method, the thermal oxidation film 12 having a thickness about 2 μm is formed on a surface of the source electrode substrate 2 that is a silicon substrate (the second substrate) having a thickness 625 μm and being in the crystal orientation <100>.

The photo-resist is applied to the electrode substrate 2 after the oxidation layer 12 is formed thereon. The patterning is performed to form the recessed portion 14, and the recessed portion 14 is formed in order to provide the electrode 15 and the spacer 13. The photo-resist pattern is used as the mask, and the oxidation layer 12 is etched by using a solution of hydrofluoric acid including ammonium fluoride as the buffer component. The recessed portion 14 is formed in the oxidation layer 12. Further, the titanium nitride film 81 is formed on the entire surface of the electrode substrate 2, and the titanium nitride film 81 is formed in order to provide the electrode 15 and the dummy electrodes 35.

In the ink-jet head of the FIG. 62 embodiment, as shown in FIG. 91B, the lithography and dry etching process is performed to form the desired shape of the electrode 15 and the dummy electrodes 35. After this, the BSG film 18*a* is formed on the entire surface of electrode substrate 2 including the electrode 15 and the dummy electrodes 35.

In the ink-jet head of the FIG. 64 embodiment, as shown in FIG. 91C, the lithography and dry etching process is performed to form the desired shape of the electrode 15 and the dummy electrodes 35. After this, the NSG film 28*a* is formed on the entire surface of electrode substrate 2, and the BSG film 18*a* is formed on the entire surface of the NSG film 28*a*, and the electrode 15 is formed on the BSG film 18*a* at the bottom of the recessed portion 14 in the oxidation layer 12.

Figure 92:
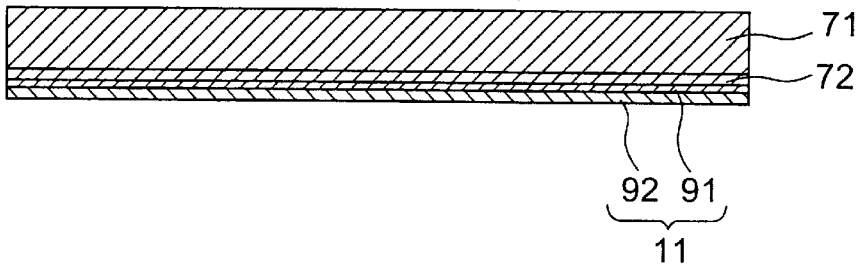
FIG. 92 is a diagram for explaining a production method for the ink-passage substrate.

Next, a description will be given of a production method of the ink-passage substrate in the ink-jet head according to the present invention. FIG. 92 is a diagram for explaining the production method for the ink-passage substrate.

As shown, the source ink-passage substrate 71 that is a p-type single-crystal silicon substrate (the first substrate) having a thickness about 500 μm and being in the crystal orientation <110> is used. The top and bottom surfaces of the source ink-passage substrate 71 are polished. On the bottom surface of the ink-passage substrate 71 where the first and second substrates 71 and 2 are bonded together, a boron diffusion layer 72 including a high concentration of boron is formed through the ion implantation process or the like. The boron diffusion layer 72 is activated, and boron is diffused to the desired depth needed to form the oscillation plate 10. Further, the boron oxide layer 91 is formed on the bottom surface of the boron diffusion layer 72, and the NSG film 92 is formed on the bottom surface of the boron oxide layer 91.

Figure 93A:
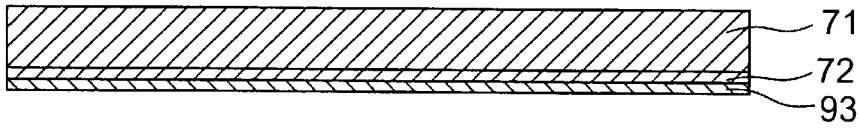
FIG. 93A and FIG. 93B are diagrams for explaining another production method for the ink-passage substrate.
Figure 93B:
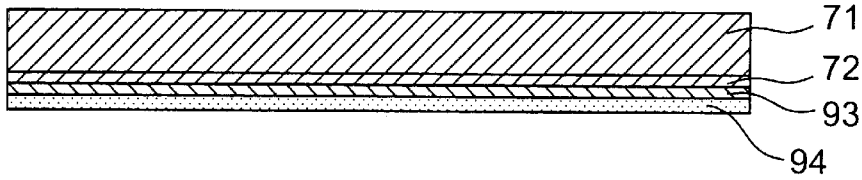

Next, FIG. 93A and FIG. 93B are diagrams for explaining another production method for the ink-passage substrate.

As shown in FIG. 93A, the source ink-passage substrate 71 that is a p-type single-crystal silicon substrate (the first substrate) having a thickness about 500 μm and being in the crystal orientation <110> is used. The top and bottom surfaces of the source ink-passage substrate 71 are polished. On the bottom surface of the ink-passage substrate 71 where the first and second substrates 71 and 2 are bonded together, the boron diffusion layer 72 including a high concentration of boron is formed through the ion implantation process or the like. Further, the NSG film 93 is formed on the bottom surface of the boron diffusion layer 72 which becomes the oscillation plate in the silicon substrate 71.

As shown in FIG. 93B, the BSG film 94 is formed on the bottom surface of the NSG film 93.

Next, a description will be given of a production method of the electrode substrate in the ink-jet head according to the present invention. FIG. 94A through FIG. 94E are diagrams for explaining the production method for the electrode substrate.

Figure 94A:
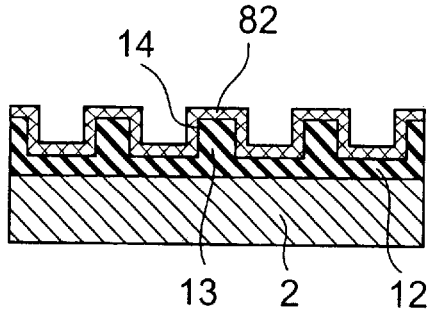
FIG. 94A, FIG. 94B, FIG. 94C, FIG. 94D and FIG. 94E are diagrams for explaining a production method for the electrode substrate.

In the present embodiment, the electrode material used is a doped polysilicon material. As shown in FIG. 94A, the source electrode substrate 2 that is a p-type single-crystal silicon substrate (the second substrate) being in the crystal orientation <100> is used (an n-type silicon substrate may be used). A wet or dry thermal oxidation process is performed to form the thermal oxidation layer 12 having a thickness about 2 μm on the entire surface of the silicon substrate 2. After this, the photo-resist is applied to the oxidation 12, a patterning of the photo-resist to form the recessed portion 14 is performed, and the recessed portion 14 is formed by etching using a solution of hydrofluoric acid including ammonium fluoride as the buffer component. The recessed portion 14 is provided in order to form the electrode 15 and the spacer 13. Further, the polysilicon layer 82 is formed on the entire surface of the electrode substrate 2, and the polysilicon layer 82 is provided in order to form the electrode 15 and/or the dummy electrodes 35.

Figure 94B:
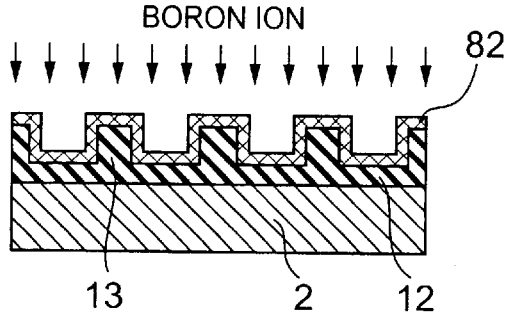
Figure 94C:
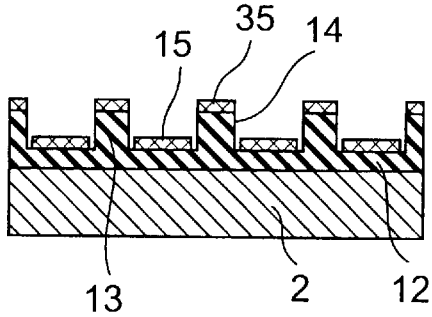

As shown in FIG. 94B, boron ions are introduced into the polysilicon layer 82 as the dopants. As shown in FIG. 94C, a patterning of the polysilicon layer 82 is performed so that the electrode 15 and/or the dummy electrodes 35 are formed.

Figure 94D:
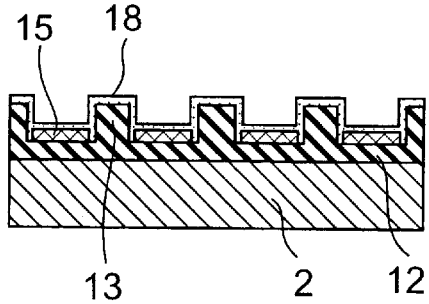

When the dummy electrodes 35 are removed, as shown in FIG. 94D, after the removal of the dummy electrodes 35, the silicon oxide layer 18 containing phosphorus and/or boron is formed on the entire surface of the electrode substrate 2.

Figure 94E:
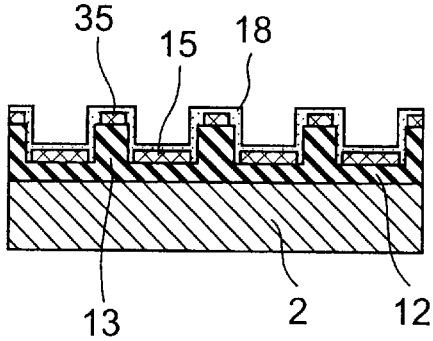

When the dummy electrodes 35 are left, as shown in FIG. 94E, without removing the dummy electrodes, the silicon oxide layer 18 containing phosphorus and/or boron is formed on the entire surface of the electrode substrate 2.

Next, a description will be given of a production method of the electrode substrate in the ink-jet head of the FIG. 77 embodiment. FIG. 95A through FIG. 95E are diagrams for explaining the production method of the electrode substrate.

Figure 95A:
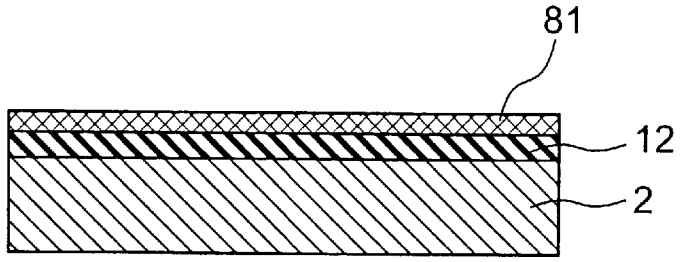
FIG. 95A, FIG. 95B, FIG. 95C, FIG. 95D and FIG. 95E are diagrams for explaining another embodiment of the production method of the ink-jet head according to the invention.
Figure 95B:
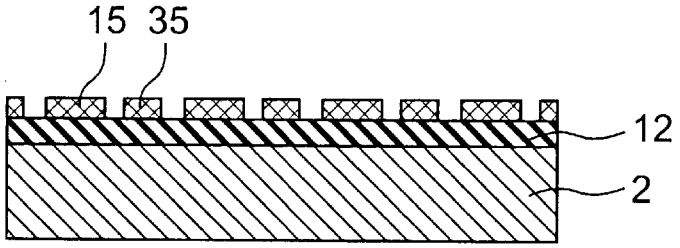

As shown in FIG. 95A, the titanium nitride film 81 having a thickness about 0.3 μm is formed on the thermal oxidation layer 12 of the electrode substrate 2. As shown in FIG. 95B, a patterning of the titanium nitride film 81 is performed, and a dry or wet etching is performed so that the desired shape of the electrode 15 and the dummy electrodes 35 is produced.

Figure 95C:
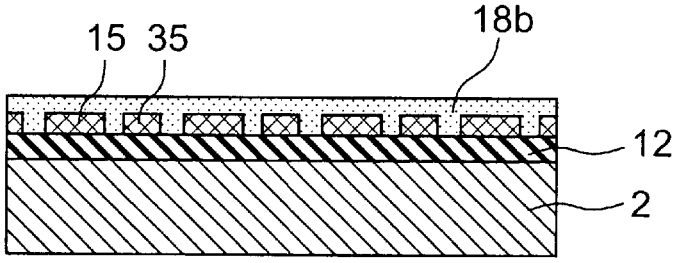
Figure 95D:
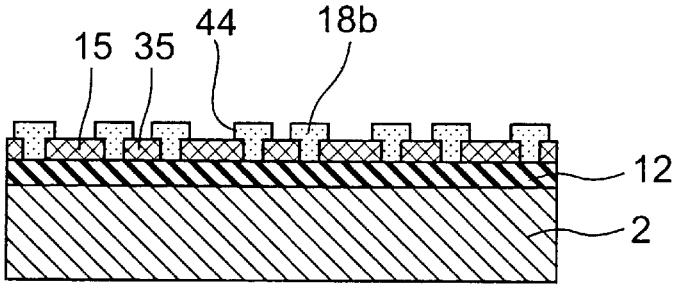
Figure 95E:
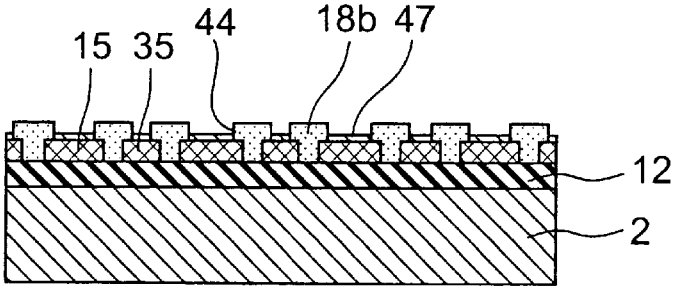

As shown in FIG. 95C, the BPSG film 18*b* having an appropriate thickness is formed on the entire surface of the electrode substrate 2. As shown in FIG. 95D, the lithography and etching process is performed, and the opening 44 that forms the gap 16 is formed in the BPSG film 18*b*. As shown in FIG. 95E, the electrode protecting film 47 is formed on the surface of the electrode 15.

Next, a description will be given of a production method of the electrode substrate in the ink-jet head of the FIG. 81 embodiment. FIG. 96A through FIG. 96E are diagrams for explaining the production method of the electrode substrate. FIG. 97 is a diagram for explaining the production method of the present embodiment.

Figure 96A:
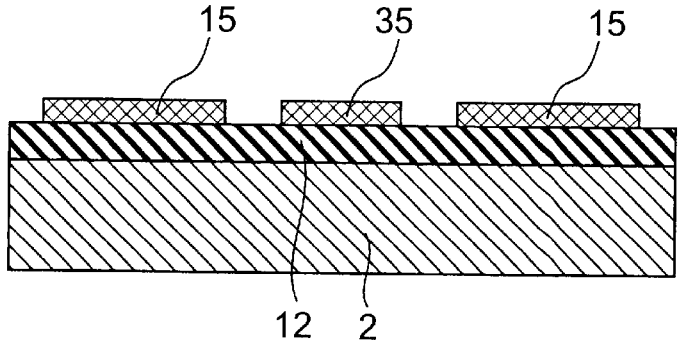
FIG. 96A, FIG. 96B, FIG. 96C, FIG. 96D and FIG. 96E are diagrams for explaining another embodiment of the production method of the ink-jet head according to the invention.
Figure 97:
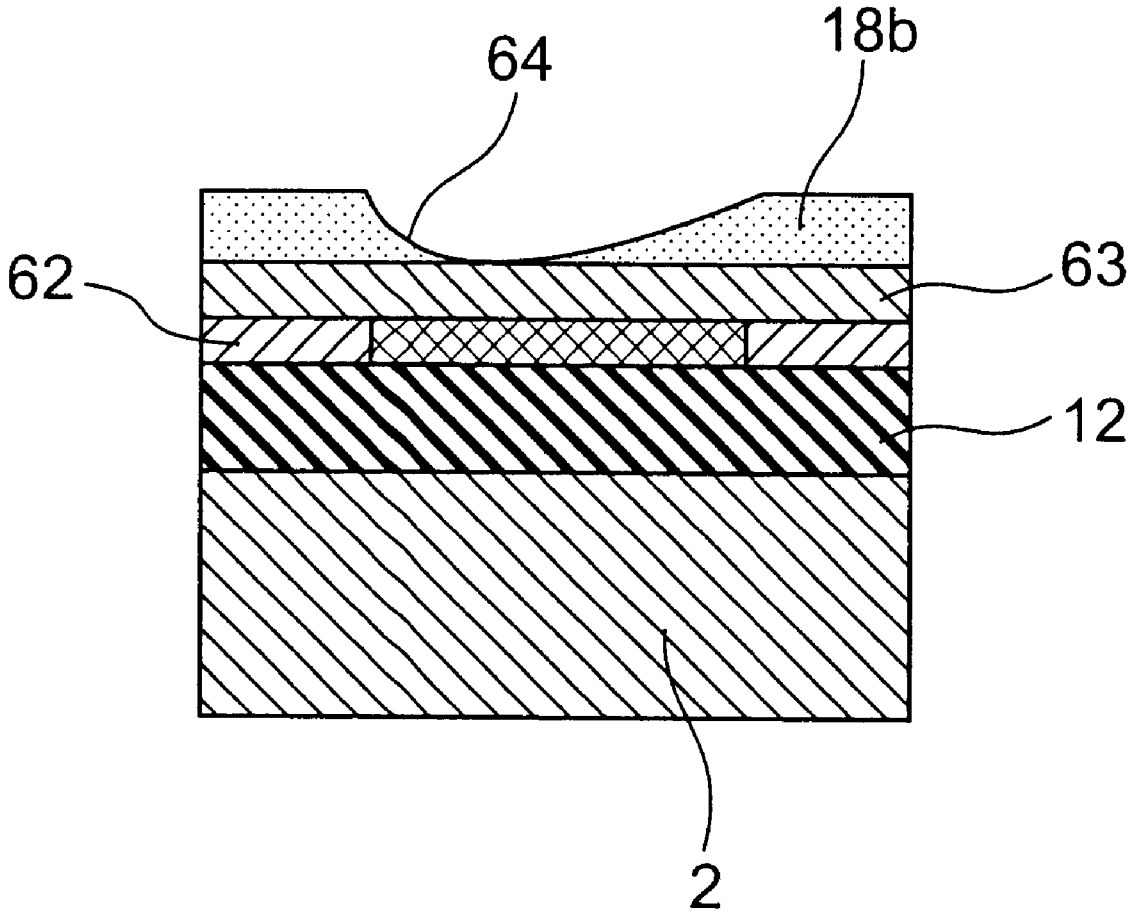
FIG. 97 is a diagram for explaining the production method of the present embodiment.

As shown in FIG. 96A, the source electrode substrate 2 that is a p-type single-crystal silicon substrate (the second substrate) having a thickness about 625 μm and being in the crystal orientation <100> is used (an n-type silicon substrate may be used). A wet or dry thermal oxidation process is performed to form the thermal oxidation layer 12 having a thickness about 2 μm on the entire surface of the silicon substrate 2.

After this, the polysilicon layer (which is formed into the electrodes) having a thickness about 300 nm is deposited on the wafer in which the silicon oxide layer 12 is formed. The photolithography and dry etching is performed for the polysilicon layer so that the electrodes 15 and the dummy electrodes 35 in the desired pattern are formed therein. At this time, the pattern is produced such that the dummy electrodes 35 are disposed in relatively wide bonding areas.

In the present embodiment, the electrode material used is the polysilicon layer. Alternatively, a conductive ceramic material, such as titanium nitride, a doped polysilicon material, or a metal material having a high melting point, such as tungsten, may be used instead.

Figure 96B:
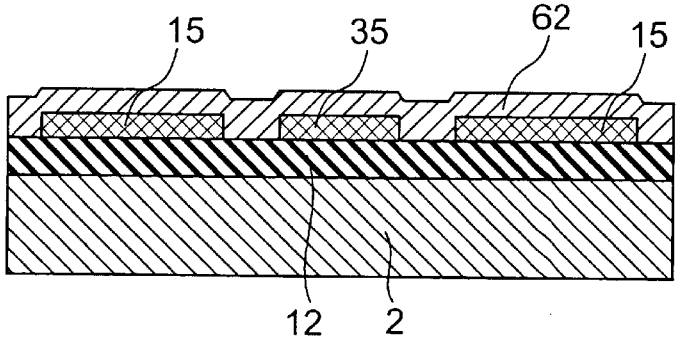

As shown in FIG. 96B, in a next step, the SOG film 62 having a thickness 350 nm is deposited on the entire surface of the electrode substrate 2 by performing the spin coat process, so as to enclose the electrodes 15 and the dummy electrodes 35. The SOG film is suitable for the flattening, and, in the present embodiment, the inorganic SOG film that withstands the subsequent heat treatment is used. The SOG film 62 is heat treated at 900 deg. C. for 60 minutes so that the moisture is removed from the SOG film. To deposit the SOG film 62 having an adequate thickness, the spin coat process and the baking process may be performed repetitively. Further, the re-flow film or the BPSG film may be formed additionally.

Figure 96C:
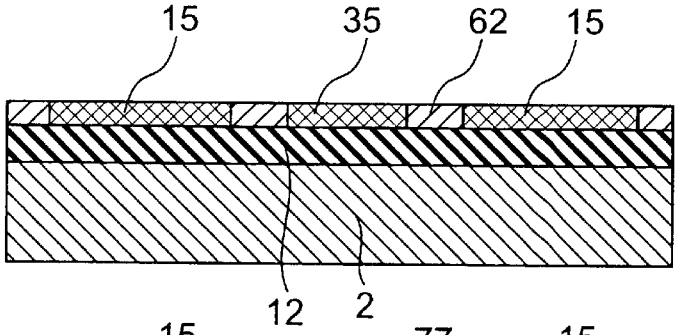

As shown in FIG. 96C, in a next step, the electrode substrate 2 is subjected to the chemical-mechanical polishing (CMP) so that the surface of the SOG film 62 is polished and flattened. The slurry fluid used in the CMP process is a KOH-based slurry containing a fumed silica (the product name: SS25) which is diluted with demineralized water (the slurry: the water=1:1). The polishing conditions are: the table speed=40 rpm, the carrier speed=29 rpm, and the polishing pressure=250 g/cm$^2$.

Figure 96D:
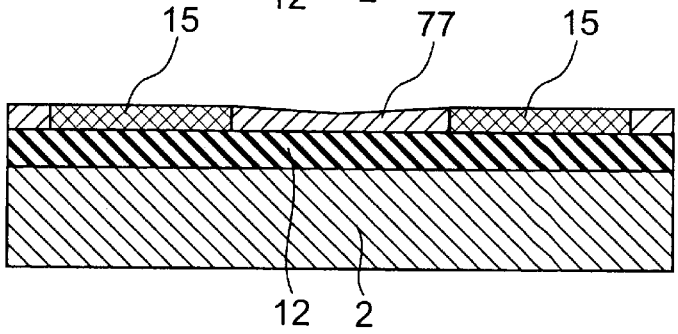

As shown in FIG. 96D, when no dummy electrode 35 is formed on the electrode substrate 2, the SOG film 62 may have a slightly recessed area at the portion 77 between the electrodes 15, which will cause a defective bonding of the electrode substrate and the ink-passage substrate. Hence, the use of the dummy electrode 35 eliminates the problem and provides uniform thickness of the SOG film.

Figure 96E:
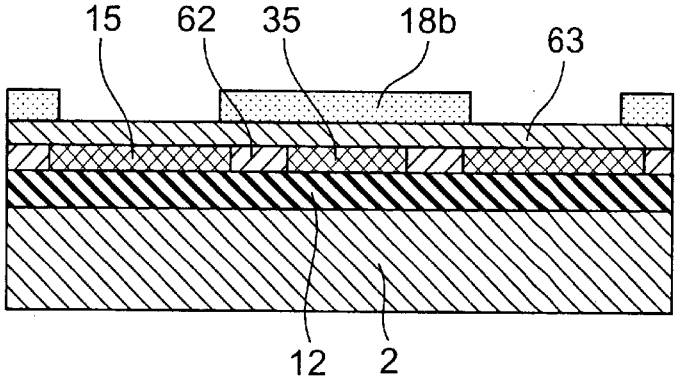

As shown in FIG. 96E, the NSG film 63 having a thickness 150 nm is deposited on the flattened electrode substrate 2 by performing the CVD process. After this, the gas used in the CVD process is changed (4.5% phosphorus and 4.0% boron), and the BPSG film 18*b* having a thickness about 200 nm is deposited as the silicon oxide layer. As shown in FIG. 97, the recessed portion 64 is formed in the BPSG film 18*b* such that the non-parallel type gap is provided.

Next, a description will be given of a production method of the electrode substrate in the ink-jet head of the FIG. 79 embodiment. FIG. 98A through FIG. 98E are diagrams for explaining the production method of the electrode substrate. FIG. 99A and FIG. 99B are diagrams for explaining the production method of the present embodiment.

Figure 98A:
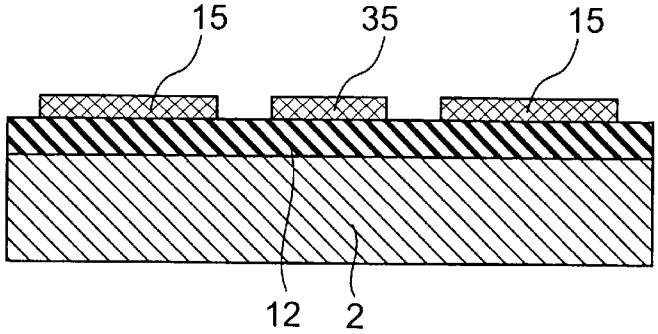
FIG. 98A, FIG. 98B, FIG. 98C, FIG. 98D and FIG. 98E are diagrams for explaining another embodiment of the production method of the ink-jet head according to the invention.
Figure 99A:
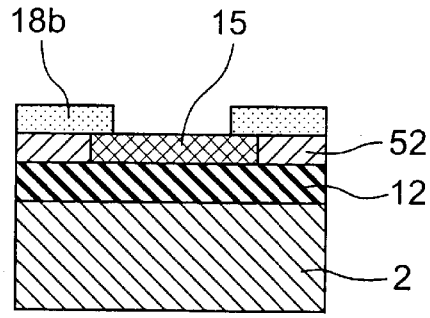
FIG. 99A and FIG. 99B are diagrams for explaining the production method of the present embodiment.
Figure 99B:
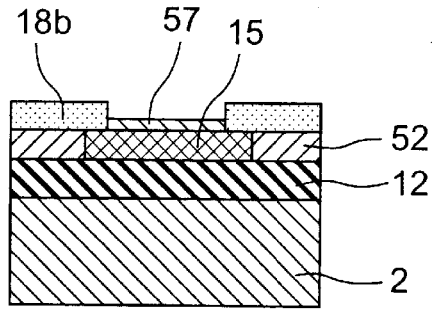

As shown in FIG. 98A, the source electrode substrate 2 that is a p-type single-crystal silicon substrate (the second substrate) having a thickness about 625 $\mu$m and being in the crystal orientation <100> is used. A wet or dry thermal oxidation process is performed to form the thermal oxidation layer 12 having a thickness about 2 $\mu$m on the entire surface of the silicon substrate 2.

After this, the polysilicon layer (which is formed into the electrodes) having a thickness about 300 nm is deposited on the wafer in which the silicon oxide layer 12 is formed. The photolithography and dry etching is performed for the polysilicon layer so that the electrodes 15 and the dummy electrodes 35 in the desired pattern are formed therein. At this time, the pattern is produced such that the dummy electrodes 35 are disposed in relatively wide bonding areas.

Figure 98B:
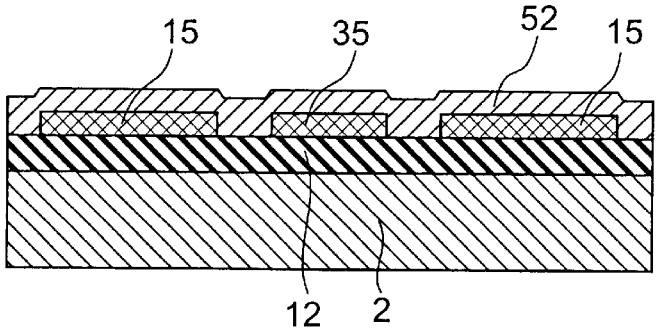

As shown in FIG. 98B, in a next step, the SOG film 52 having a thickness 350 nm is deposited on the entire surface of the electrode substrate 2 by performing the spin coat process, so as to enclose the electrodes 15 and the dummy electrodes 35. The SOG film is suitable for the flattening, and, in the present embodiment, the inorganic SOG film that withstands the subsequent heat treatment is used. The SOG film 52 is heat treated at 900 deg. C. for 60 minutes so that the moisture is removed from the SOG film. To deposit the SOG film 52 having an adequate thickness, the spin coat process and the baking process may be performed repetitively. Further, the re-flow film or the BPSG film may be formed additionally.

Figure 98C:
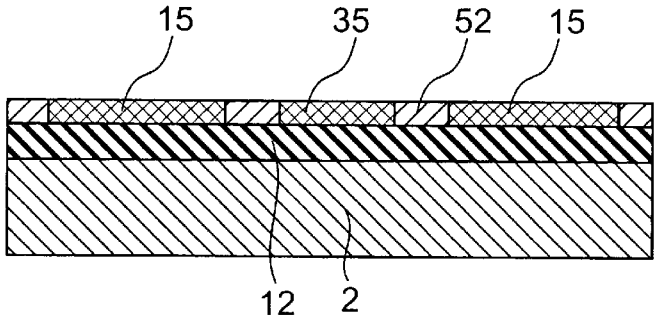

As shown in FIG. 98C, in a next step, the electrode substrate 2 is subjected to the chemical-mechanical polishing (CMP) so that the surface of the SOG film 52 is polished and flattened. As the polishing rate of the titanium nitride film is much smaller than the polishing rate of the SOG film, the titanium nitride film of the electrodes 15 and the dummy electrodes 35 serves as the layer that stops the polishing in the CMP process.

Figure 98D:
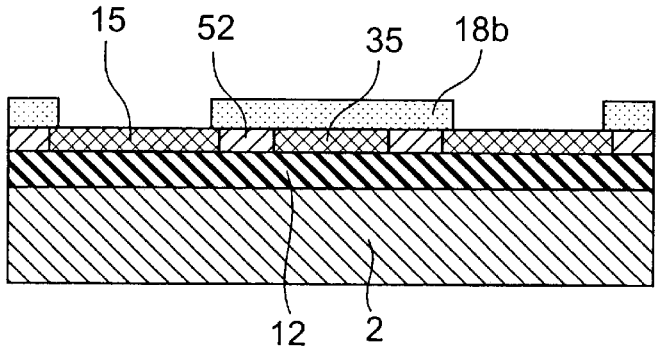

As shown in FIG. 98D, the NSG film 53 having a thickness 150 nm is deposited on the flattened electrode substrate 2 by performing the CVD process. After this, the gas used in the CVD process is changed (4.5% phosphorus and 4.0% boron), and the BPSG film 18*b* having a thickness about 200 nm is deposited as the silicon oxide layer.

Figure 98E:
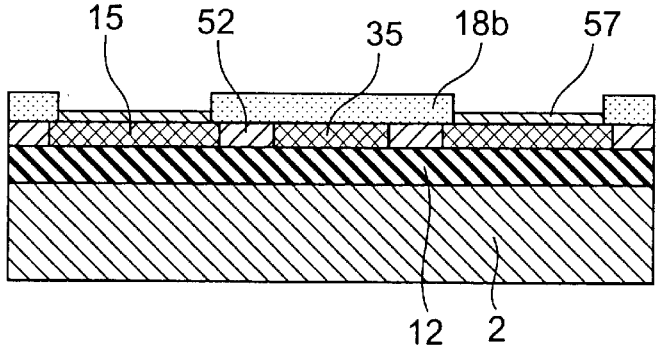

As shown in FIG. 98E, the electrode protecting film 57 is formed on the surface of the electrode 15. As shown in FIG. 99A and FIG. 99B, the thermal oxidation process of the titanium nitride film is performed after the removal of the photo-resist, and the titanium oxide film 57 is formed on the surface of the electrode 15. The titanium oxide film 57 serves as the electrode protecting layer. The thermal oxidation process of the titanium nitride film is performed in an oxygen gas atmosphere at a temperature in a range of 500 to 600 deg. C.

Figure 100:
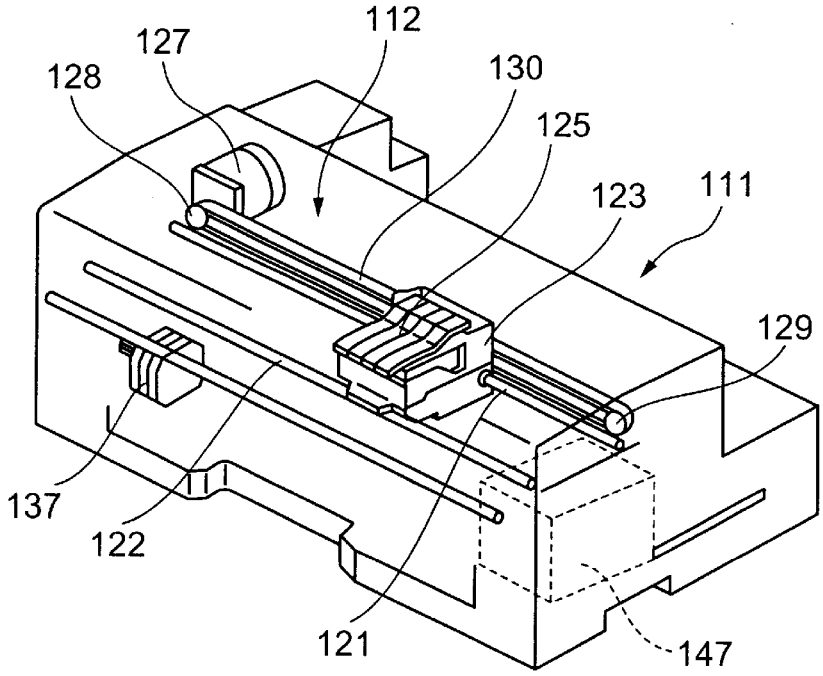
FIG. 100 is a perspective view of an ink-jet printing system which includes one embodiment of the ink-jet head of the invention.
Figure 101:
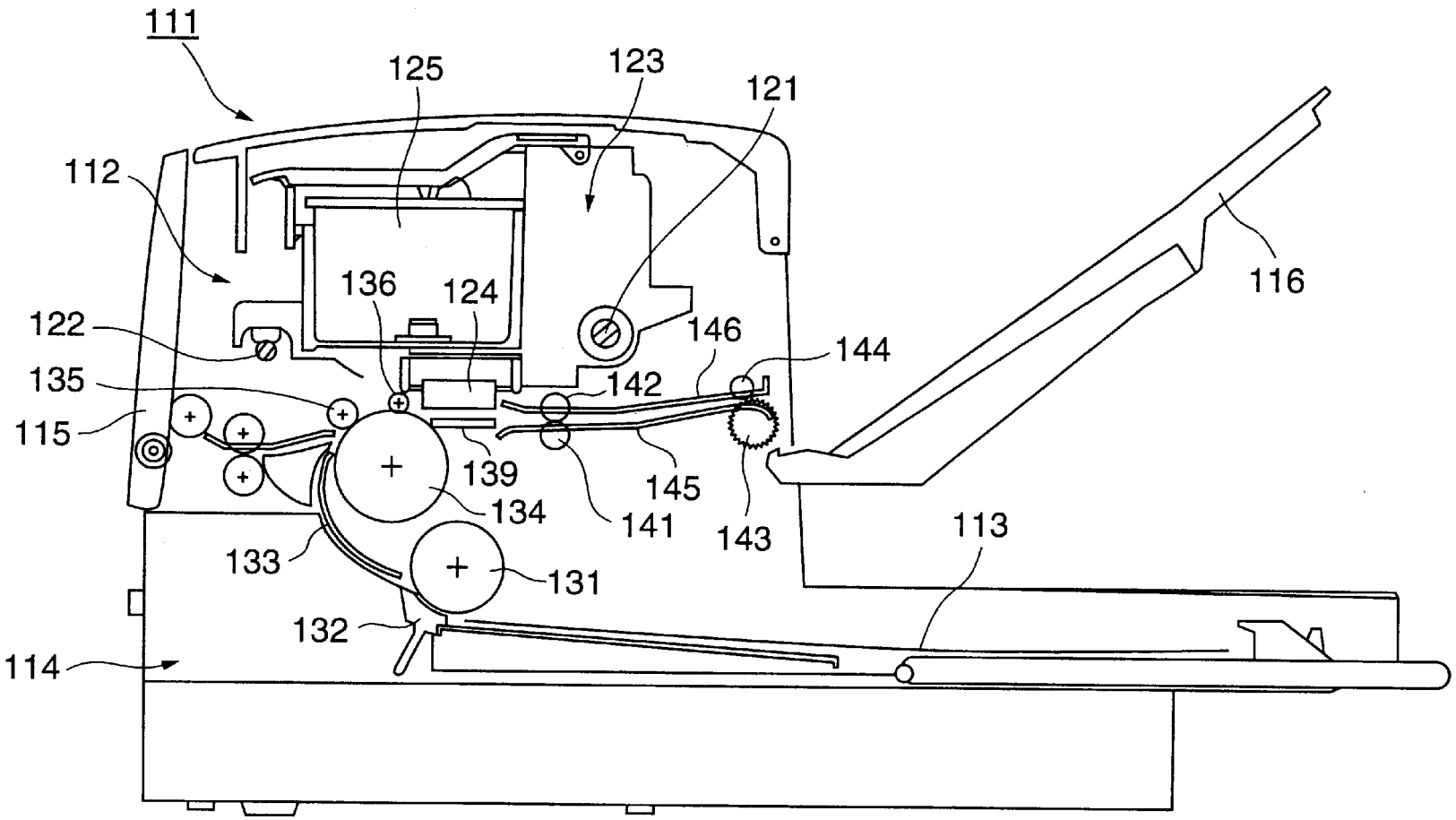
FIG. 101 is a diagram for explaining a printing mechanism of the ink-jet printing system of the present embodiment.

Next, a description will be given of the ink-jet printing system including the ink-jet head according to the present invention. FIG. 100 is a perspective view of the ink-jet printing system which includes one embodiment of the ink-jet head of the invention. FIG. 101 is a diagram for explaining a printing mechanism of the ink-jet printing system of the present embodiment.

As shown, the ink-jet printing system generally includes a main body 111 and a printing mechanism 112. The printing mechanism 112 is incorporated in the main body 111. The printing mechanism 112 includes the head carriage which is movable in the main scanning direction, the ink-jet head of the present invention which is carried by the head carriage, and the ink cartridge which supplies the ink to the ink-jet head. A recording sheet 113, which is sent to the printing position beneath the ink-jet head, is supplied from one of a paper cassette 114 and a manual feed tray 115. The printing mechanism 112 performs the printing of an image on the recording sheet 113. The recording sheet 113 after the printing is performed is transported to an ejection tray 116.

The printing mechanism 112 includes a main guide rod 121 and a follower guide rod 122 which are horizontally spaced from each other. The head carriage 123 is movably supported on the main and follower guide rods 121 and 122, and the head carriage 123 is movable in the main scanning direction. The ink-jet head 123, which includes a yellow (Y) ink-jet head, a magenta (M) ink-jet head, a cyan (C) ink-jet head and a black (Bk) ink-jet head, each being one embodiment of the ink-jet head of the present invention, is provided on the bottom surface of the carriage 123. The ink discharging surface of the ink-jet head 124 is faced downward. On a top surface of the carriage 123, an ink cartridge 125 containing Y, M, C and Bk inks is attached to the carriage 123. The ink cartridge 105 is changeable with a new one.

In the present embodiment, the ink-jet head 124 may be a multiple-head module including a plurality of ink-jet heads each discharging one of the four inks (Y, M, C and Bk), or a multiple-nozzle head including a plurality of nozzles each discharging one of the four inks (Y, M, C and Bk).

In the ink-jet printing system of the present embodiment, the head carriage 123 is connected to a timing belt 130, and this timing belt 130 is wound between a driving pulley 128 and a follower pulley 129. A main scanning motor 127 rotates the driving pulley 128 around a rotation axis of the motor 127, and the follower pulley 129 is rotated by the rotating force of the motor 127 via the driving pulley 128. The rotation of the main scanning motor 127 is controlled so that the head carriage 123 carrying the ink-jet head 124 is moved in the main scanning direction.

As shown in FIG. 101, a transport roller 134 is rotatably retained so that a recording sheet 113 is forwarded in a sub-scanning direction (which is perpendicular to the main scanning direction) by the transport roller 134. A sub-scanning motor 137 (shown in FIG. 100) rotates the transport roller 134, and the rotating force of the motor 137 is transmitted to the transport roller 134 through a gear train (not shown). The recording sheet 113, which is placed in a paper cassette 114 and held at a friction pad 132, is transported from a paper feeding roller 131 to the transport roller 134, and the recording sheet 113 that is reverted by the transport roller 134, is transported to a printing position beneath the ink-jet head 124.

On the periphery of the transport roller 134, a pressure roller 135 and a retaining roller 136 are provided to reverse the recording sheet 113. The pressure roller 135 and the retaining roller 136 are rotatably supported so that the recording sheet 113 in the reversed position is transported. At a downstream position of the sheet transport passage, a sheet guide member 139 is provided, and the recording sheet 113 sent by the transport roller 134 is supported at the printing position beneath the ink-jet head 124 by the sheet guide member 139.

The sheet guide member 139 has a longitudinal length that corresponds to an effective range of the movement of the head carriage 123 in the main scanning direction. The distance between the ink-jet head 124 and the recording sheet 113 is maintained at a given constant distance.

At a downstream portion of the sheet guide member 139 in the sheet transport direction, a first ejection roller 141 and a follower roller 142 are provided to send the recording sheet 113 in the sheet ejection direction. A pair of sheet transport passage members 145 and 146, a second ejection roller 143 and a follower roller 144 are provided at a subsequent downstream portion of the sheet transport passage following the rollers 143 and 144. The first and second ejection rollers 141 and 143 are rotated to send the recording sheet 113 in the sheet ejection direction. Further, a paper ejection tray 116 is provided in a slanted condition so that the recording sheet 113 after the image printing is stacked on the paper ejection tray 116.

In the ink-jet printing system of the above-described embodiment, the recording sheet 113 from the paper cassette 114 or the manual feed tray 115 is sent to the transport roller 134 by the paper feeding roller 131, and the recording sheet 113 is reversed on the periphery of the transport roller 134 at the roller 135, and it is sent to the printing position by the transport roller 134. The recording sheet 113 is transported through the printing position, so that the distance between the ink-jet head 124 and the recording sheet 113 is maintained at a given constant distance. During the sheet transport, the ink-jet head 124 discharges an ink drop to the recording sheet 113 so that an image is printed on the recording sheet 113. After the image printing is performed, the recording sheet 113 is ejected to the paper ejection tray 116.

In the ink-jet printing system of the above-described embodiment, a head recovery device 147 is provided at a lower position as shown in FIG. 100. The head recovery 147 includes a cap means, a suction means and a cleaning means, and is provided for recovery of the ink-jet head 124 when a defect of the head 124 occurs.

When a defective ink discharging of the head 124 occurs, the nozzles of the ink-jet head 124 are sealed by the cap means, and the ink and bubbles are sucked from the nozzles of the ink-jet head 124 via a tube by the suction means. The ink and dust sticking to the nozzles of the ink-jet head 124 are removed by the cleaning means. In this manner, the recovery operation against the defective ink discharging is performed. The sucked ink is ejected to the used ink tank (not shown), and the sucked ink is absorbed by an ink absorbent in the used ink tank.

In the above-described embodiments, the present invention is applied to the ink-jet head. However, the present invention is not limited to these embodiments. For example, the present invention is also applicable to a liquid discharging head which discharges a drop of liquid resist for patterning. The electrostatic actuator described with reference to the above embodiments is also applicable to a micro-actuator portion of a micro-motor, a micro-pump or a micro-relay.

As for the ink-jet printing system of the above embodiment, the side-shooter type ink-jet head to which the present invention is applied has been described. However, the present invention is not limited to the above embodiment. For example, the present invention is applicable to the edge-shooter type ink-jet head in which the ink discharging direction is perpendicular to the direction of actuation of the oscillation plate.

Further, in the above-described embodiments, the silicon oxide layer including phosphorus and/or boron is formed by performing the deposition method. Alternatively, phosphorus and/or boron may be introduced into the silicon oxide layer by performing the ion implantation method, so that the bonding areas of the silicon oxide layer can serve as the re-flow film.

The present invention is not limited to the above-described embodiment, and variations and modifications may be made without departing from the scope of the present invention.

Further, the present invention is based on Japanese priority application No. 2000-260643, filed on Aug. 30, 2000, Japanese priority application No. 2000-297817, filed on Sep. 29, 2000, and Japanese priority application No. 2000-336819, filed on Nov. 6, 2000, the entire contents of which are hereby incorporated by reference.

What is claimed is:

1. An ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated; and an electrode provided on a second substrate of silicon, the electrode facing the oscillation plate via a gap between the oscillation plate and the electrode, the electrode actuating the oscillation plate by electrostatic force upon application of a driving voltage to the electrode;

wherein at least one of a first bonding area of the first substrate and a second bonding area of the second substrate is provided with a silicon oxide film, and the silicon oxide film contains boron on a surface thereof where the first substrate and the second substrate are bonded together.

2. The ink-jet head according to claim 1, wherein the first substrate is bonded directly to the second substrate via the silicon oxide film, the second substrate having a recessed portion in which the electrode is provided, the recessed portion of the second substrate being formed within the silicon oxide film, and the silicon oxide film containing boron on the surface thereof that is bonded to the first bonding area of the first substrate.

3. The ink jet head according to claim 1, wherein the oscillation plate includes a boron doped silicon layer containing boron as high-concentration p-type dopants in the first silicon substrate.

4. The ink-jet head according to claim 1, wherein the first substrate is bonded directly to the second substrate via the silicon oxide film.

5. The ink-jet head according to claim 1, wherein the silicon oxide film contains boron that is introduced by ion implantation.

6. An ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated; and an electrode provided on a second substrate of silicon, the electrode facing the oscillation plate via a gap between the oscillation plate and the electrode, the electrode actuating the oscillation plate by electrostatic force upon application of a driving voltage to the electrode;

wherein the first substrate is bonded to the second substrate via a silicon oxide film, the silicon oxide film being provided to have a lowered melting point that allows the bonding of the first and second substrates at a temperature lower than 1000 deg. C.

7. An ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated; and an electrode provided on a second substrate of silicon, the electrode facing the oscillation plate via a gap between the oscillation plate and the electrode, the electrode actuating the oscillation plate by electrostatic force upon application of a driving voltage to the electrode;

wherein the first substrate is bonded to the second substrate via a silicon oxide layer, the silicon oxide layer containing phosphorus and/or boron on a surface thereof where the first substrate and the second substrate are bonded together.

8. The ink-jet head according to claim 7, wherein the nozzle is provided on a third substrate, and the third substrate is bonded to the first substrate via a second silicon oxide layer, the second silicon oxide layer containing phosphorus and/or boron on a surface thereof where the third substrate and the first substrate are bonded together.

9. The ink-jet head according to claim 7, further comprising a lid member protecting the ink-jet head, wherein the lid member is provided on a fourth substrate, and the fourth substrate is bonded to the first substrate via a third silicon oxide layer, the third silicon oxide layer containing phosphorus and/or boron on a surface thereof where the fourth substrate and the first substrate are bonded together.

10. The ink-jet head according to claim 7, wherein said silicon oxide layer has a two-layer structure including a first silicon oxide film containing neither phosphorus nor boron and a second silicon oxide film containing phosphorus and boron.

11. The ink-jet head according to claim 7, wherein said silicon oxide layer has a three-layer structure including a first silicon oxide film containing neither phosphorus nor boron, a second silicon oxide film containing phosphorus and boron, and a third silicon oxide film containing no phosphorus but containing boron.

12. The ink-jet head according to claim 7, wherein said silicon oxide layer has a three-layer structure including a first silicon oxide film containing neither phosphorus nor boron, a second silicon oxide film containing phosphorus and boron, and a third silicon oxide film containing no boron but containing phosphorus.

13. The ink-jet head according to claim 7, wherein said silicon oxide layer comprises a silicon oxide film that is coated onto one of the first substrate and the second substrate.

14. An ink-jet printing system in which an ink-jet head is provided, said ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated; and an electrode provided on a second substrate of silicon, the electrode facing the oscillation plate via a gap between the oscillation plate and the electrode, the electrode actuating the oscillation plate by electrostatic force upon application of a driving voltage to the electrode;

wherein the first substrate is bonded to the second substrate via a silicon oxide layer, the silicon oxide layer containing phosphorus and/or boron on a surface thereof where the first substrate and the second substrate are bonded together.

15. An ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated;

an electrode provided on a second substrate of silicon, the electrode facing the oscillation plate via a gap between the oscillation plate and the electrode, the electrode actuating the oscillation plate by electrostatic force upon application of a driving voltage to the electrode; and a spacer provided on the second substrate such that the spacer forms the gap between the oscillation plate and the electrode, the spacer having a silicon oxide layer where the first substrate is bonded to the second substrate via the spacer, the silicon oxide layer being provided to have a lowered melting point that allows the bonding of the first substrate and the second substrate at a temperature lower than 1000 deg. C.

16. An ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated;

an electrode provided on a second substrate of silicon, the electrode facing the oscillation plate via a gap between the oscillation plate and the electrode, the electrode actuating the oscillation plate by electrostatic force upon application of a driving voltage to the electrode; and a spacer provided on the second substrate such that the spacer forms the gap between the oscillation plate and the electrode, the spacer having a silicon oxide layer thereon, the silicon oxide layer containing phosphorus and/or boron on a surface thereof where the first substrate is bonded to the second substrate via the spacer.

17. The ink-jet head according to claim 16 wherein the spacer includes the silicon oxide layer on an entire surface of the spacer, and the silicon oxide layer contains phosphorus and/or boron.

18. The ink-jet head according to claim 16 wherein the spacer has no silicon oxide layer that contains phosphorus and/or boron, on a surface thereof where the electrode faces the oscillation plate via the gap between the oscillation plate and the electrode.

19. The ink-jet head according to claim 16 wherein the silicon oxide layer has a two-layer structure including a first silicon oxide film containing neither phosphorus nor boron and a second silicon oxide film containing phosphorus and boron.

20. The ink-jet head according to claim 16 wherein the silicon oxide layer has a three-layer structure including a first silicon oxide film containing neither phosphorus nor boron, a second silicon oxide film containing phosphorus and boron, and a third silicon oxide film containing either phosphorus or boron.

21. The ink-jet head according to claim 16 wherein the spacer includes a second silicon oxide layer provided on the electrode.

22. The ink-jet head according to claim 21 wherein the electrode is made of a polysilicon material containing phosphorus and/or boron as dopants in the polysilicon material, and the second silicon oxide layer of the spacer, forming the gap between the oscillation plate and the electrode, is provided on said electrode of said polysilicon material.

23. The ink-jet head according to claim 22 wherein the second silicon oxide layer of the spacer is formed by oxidation of the polysilicon material of the electrode.

24. An ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated;

an electrode provided on a second substrate of silicon, the electrode facing the oscillation plate via a gap between the oscillation plate and the electrode, the electrode actuating the oscillation plate by electrostatic force upon application of a driving voltage to the electrode; and a spacer provided on the second substrate such that the spacer forms the gap between the oscillation plate and the electrode, the spacer having a silicon oxide film on a surface thereof where the first substrate is bonded to the second substrate via the spacer, and a dummy groove being provided on the silicon oxide film.

25. The ink-jet head according to claim 24 wherein the silicon oxide layer contains phosphorus and/or boron and has a width that is substantially equal to a width of a partition wall provided adjacent to the electrode.

26. The ink-jet head according to claim 24 wherein the first substrate is bonded to the second substrate, the first substrate having a first protective layer on a surface thereof where the first substrate is bonded to the second substrate, the second substrate having a second protective layer on a surface of the electrode, and the first and second protective layers having a structure that is the same as a structure of the silicon oxide layer.

27. An ink-jet printing system in which an ink-jet head is provided, said ink-jet head comprising:

a nozzle discharging an ink drop to a recording medium;

a discharging chamber communicating with the nozzle and containing ink therein;

an oscillation plate provided on a first substrate of silicon, the oscillation plate defining a bottom surface of the discharging chamber, the oscillation plate pressurizing the ink in the discharging chamber when the oscillation plate is actuated;

an electrode provided on a second substrate of silicon, the electrode facing the oscillation plate via a gap between the oscillation plate and the electrode, the electrode actuating the oscillation plate by electrostatic force upon application of a driving voltage to the electrode; and a spacer provided on the second substrate such that the spacer forms the gap between the oscillation plate and the electrode, the spacer having a silicon oxide layer on a surface thereof where the first substrate is bonded to the second substrate via the spacer.

* * * * *